United States Patent [19]

Rautiola

[11] 4,342,017

[45] Jul. 27, 1982

[54] ELECTRICAL RELAY MEANS

[76] Inventor: Norman A. Rautiola, 430 Upton, Reed City, Mich. 49677

[21] Appl. No.: 171,451

[22] Filed: Jul. 23, 1980

[51] Int. Cl.[3] ..... H01H 67/02; H01F 5/04

[52] U.S. Cl. ..... 335/128; 335/250; 335/281; 335/297

[58] Field of Search ..... 335/128, 250, 281, 282, 335/297

[56] References Cited

U.S. PATENT DOCUMENTS

| | | | |
|---|---|---|---|
| 3,054,027 | 9/1962 | Barrick et al. | 335/297 X |
| 3,174,082 | 3/1965 | Yeates | 335/250 X |
| 3,825,865 | 7/1974 | Prouty et al. | 335/281 X |

*Primary Examiner*—L. T. Hix

*Assistant Examiner*—S. D. Schreyer

*Attorney, Agent, or Firm*—Lon H. Romanski

[57] ABSTRACT

An electrical relay assembly is shown having a mounting base carrying a plurality of electrical terminals extending from one side thereof (for connection to associated electrical circuits) and a relay winding and armature at the other side thereof; the ends of the relay winding are effectively isolated as to prevent breakage of the wire comprising the winding due to any vibrations or shock induced as into the mounting base; the armature is provided with bearing surfaces which effectively minimize and reduce frictional resistance to movement of the armature; and a housing is illustrated as being capable of being secured by various mounting apparatus to associated support structure.

56 Claims, 38 Drawing Figures

ELECTRICAL RELAY MEANS

FIELD OF THE INVENTION

This invention relates generally to electrical relay assemblies and more particularly to relay assemblies which are relatively small and are required to have a long operating life along with high efficiency.

BACKGROUND OF THE INVENTION

Various forms of electrical relays are known in the prior art. However, relatively recently, because of changing demands and a trend toward compactness, especially in many consumer goods, the prior art embodiments of electrical relays have not been found acceptable especially when such have to be reduced in physical size in order to be accommodated by a reduced space within the associated apparatus or structure.

Attempts at adapting such prior art electrical relays by merely correspondingly reducing the physical size of the components comprising such relays has not proven to be successful. Generally, among other shortcomings of such reduced-size prior art relays, it has been found that many experience relatively short useful lives and are relatively inefficient requiring relatively large current flow to produce sufficient armature hold-in forces.

Accordingly, the invention as herein disclosed and described is primarily directed to the solution of the aforementioned as well as other attendant and related problems.

SUMMARY OF THE INVENTION

According to the invention, an electrical relay assembly comprises a mounting base carrying a plurality of electrical terminals extending from one side thereof and a relay winding and armature at the other side thereof, the relay winding is effectively isolated as to prevent breakage of the wire comprising the winding due to any vibrations or shock induced as into the mounting base, and the armature is provided with bearing surfaces which effectively minimize and reduce frictional resistance to movement of the armature.

Various general and specific objects, advantages and aspects of the invention will become apparent when reference is made to the following detailed description considered in conjunction with the accompanying drawings.

BRIEF DESCRIPTION OF THE DRAWINGS

In the drawings wherein for purposes of clarity certain details and/or elements may be omitted from one or more views.

DETAILED DESCRIPTION OF THE PREFERRED EMBODIMENT

Figure 1:
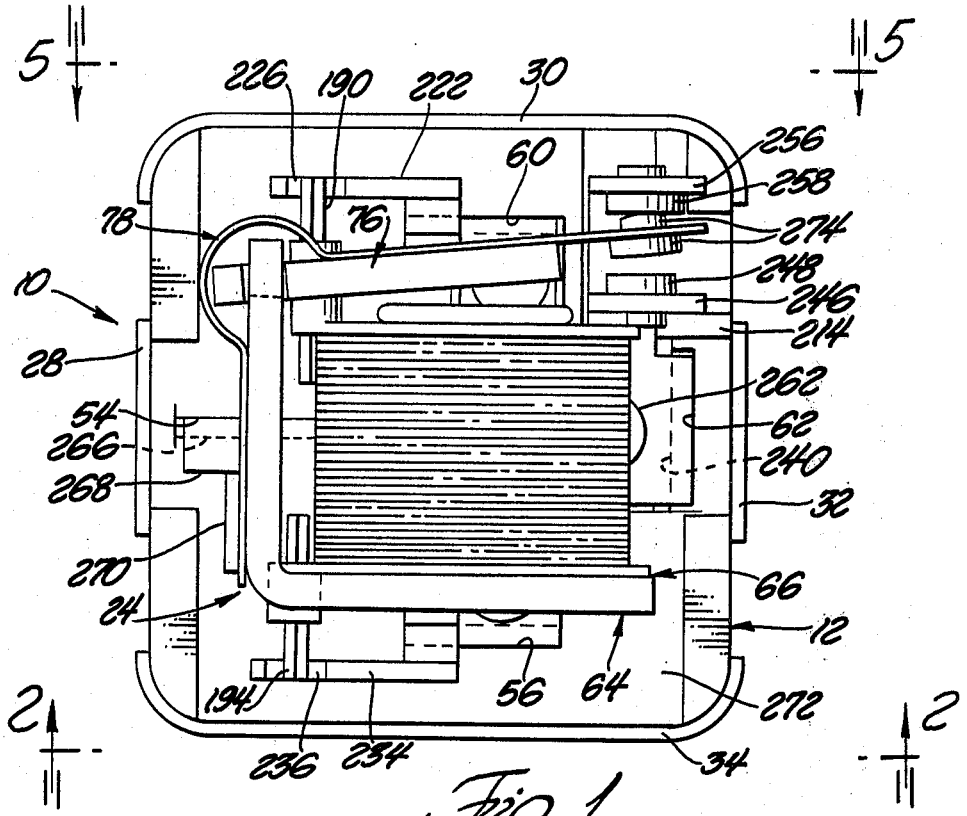
FIG. 1 is a top plan view of a relay assembly, employing teachings of the invention, with an associated cover being removed.

Referring now in greater detail to the drawings, FIGS. 1-5 illustrate a relay assembly 10 as comprising a mounting base or body 12 carrying electrical terminal members 14, 16, 18, 20 and 22, a relay motor assembly 24 and cover or housing means 26.

Figure 3:
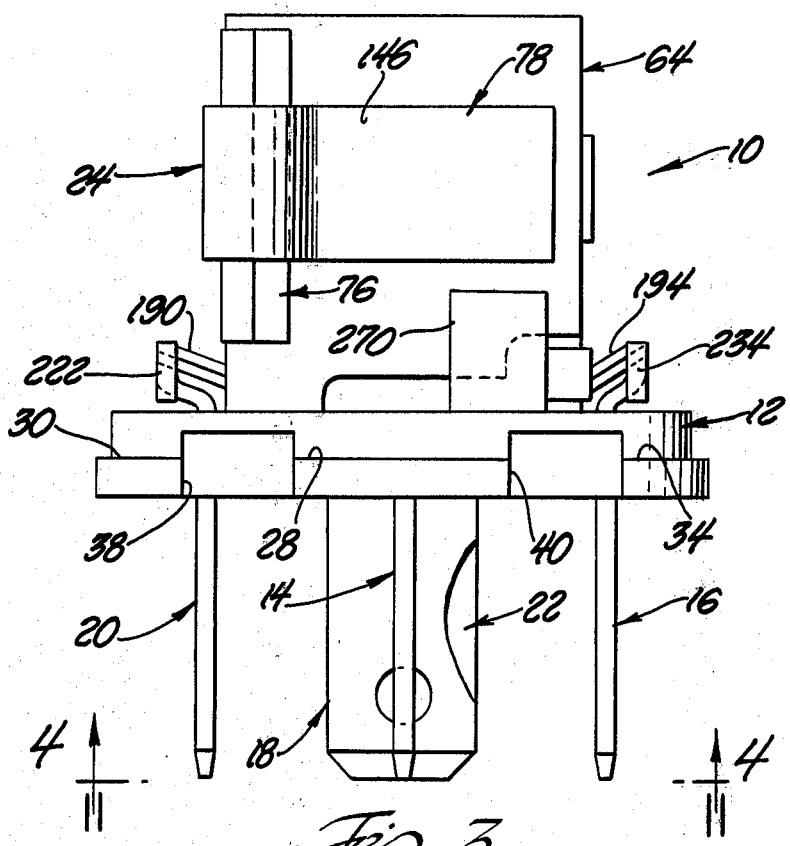
FIG. 3 is a view taken generally on the plane of line 3—3 of FIG. 2 and looking in the direction of the arrows with the cover of FIG. 2 being removed.
Figure 4:
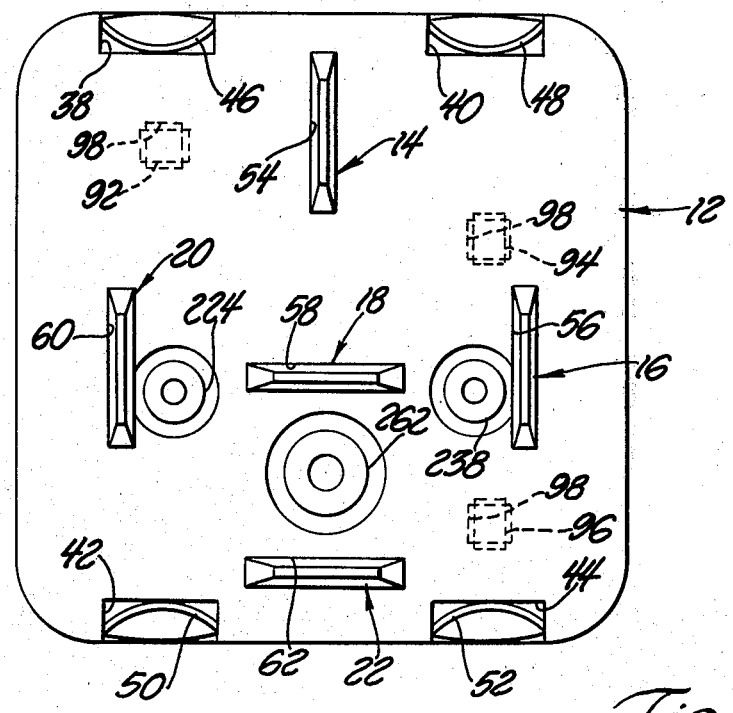
FIG. 4 is a view taken generally on the plane of line 4—4 of FIG. 3 and looking in the direction of the arrows.

The base or body means 12 is shown as comprising a plurality of ledge or flange like surface means 28, 30, 32 and 34 which serve as abutment means for abutably engaging thereagainst the open end 36 of the cover or housing means 26. As best seen in FIGS. 3 and 4, base 12 is also preferably provided with relieved or recess-like portions 38, 40, 42 and 44 for respectively receiving therein tab or ear-like extension portions 46, 48, 50 and 52 of cover means 26. When such tab portions 46, 48, 50 and 52 are indented or generally formed into the respective recesses, such respectively cooperate to lockingly hold the cover means 26 in assembled relationship to base means 12.

Terminal means 14, 16, 18, 20 and 22 respectively extend through accommodating slots 54, 56, 58, 60 and 62 formed in base 12.

Referring also to FIGS. 6-23, the relay motor assembly 24 is illustrated as comprising frame means 64 having operatively connected thereto spool means 66 carrying solenoid winding or coil means 68 with such being operatively secured to the frame means 64 as by cylindrical core means 70 provided as with an enlarged head portion 72 at one end and a peened-over portion 74 at its other end. Also, the frame means 64 is shown as carrying and having operatively connected thereto armature means 76 and spring means 78.

Figure 2:
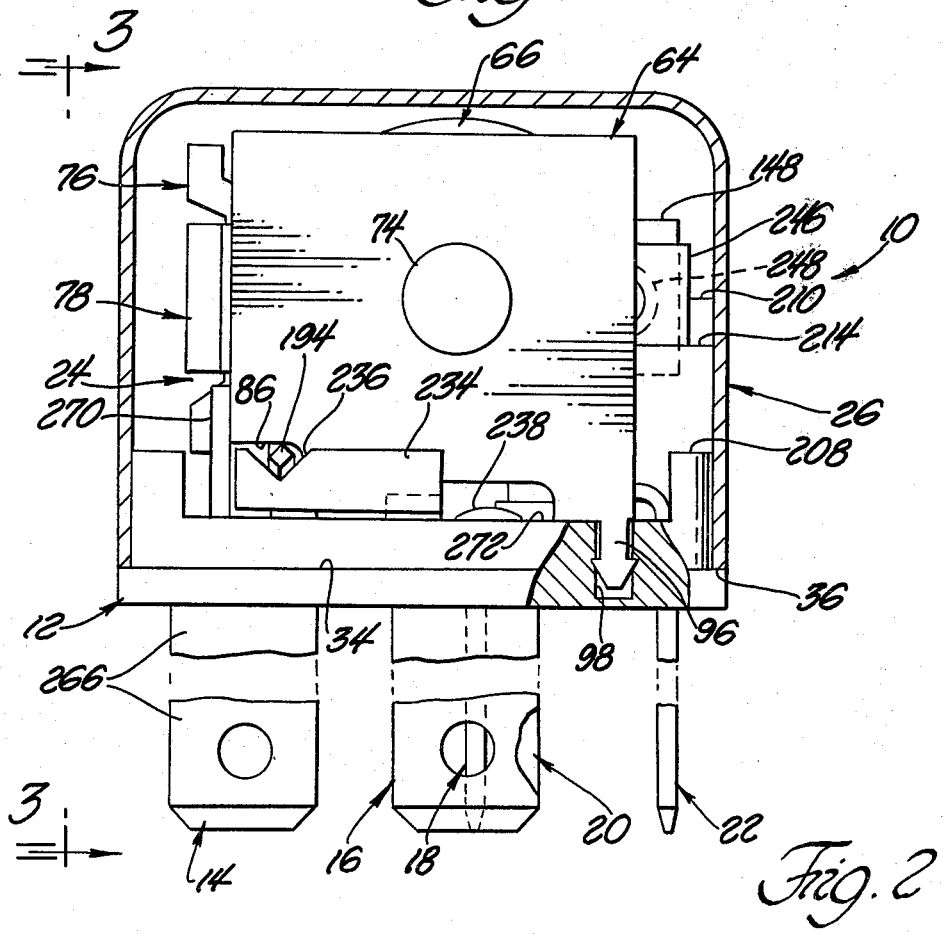
FIG. 2 is a view taken generally on the plane of line 2—2 of FIG. 1 and looking in the direction of the arrows, with a portion thereof broken away and in cross-section and illustrating an associated cover also shown in cross-section.
Figure 6:
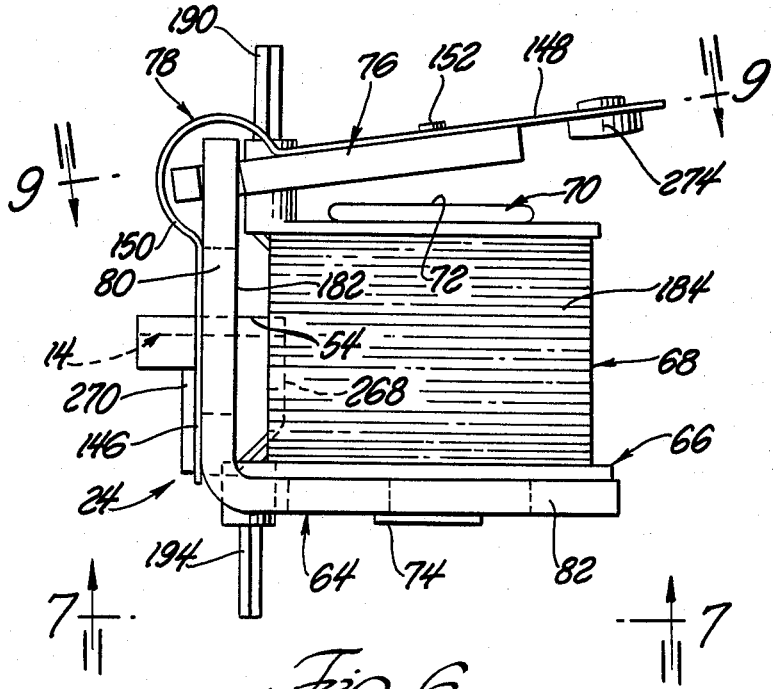
FIG. 6 is a view of a portion of the structure shown in FIG. 1 and illustrated in the same relative position as in FIG. 1.
Figure 7:
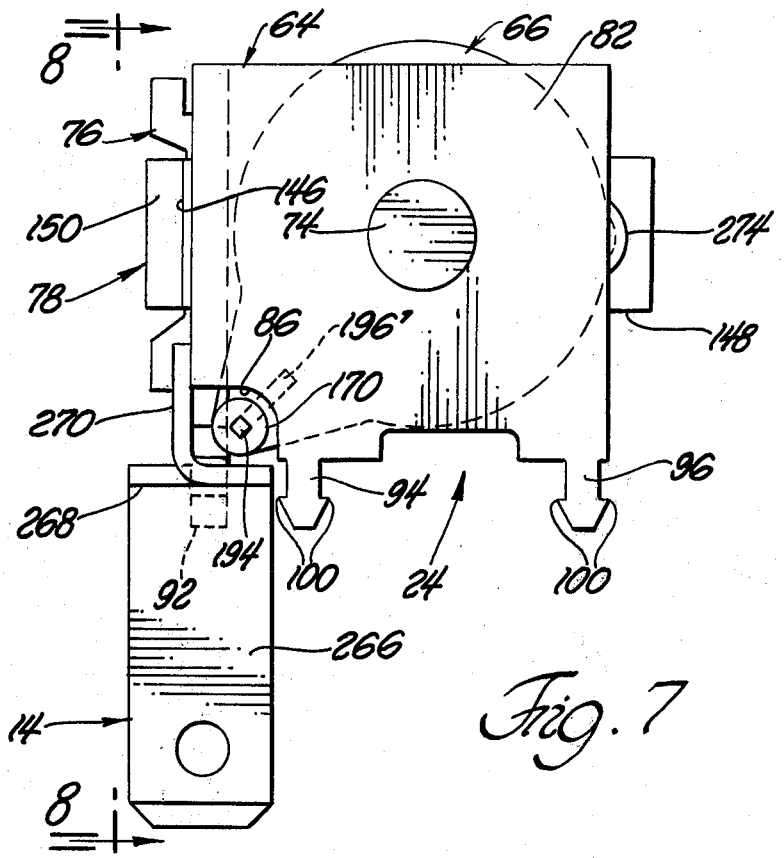
FIG. 7 is a view taken generally on the plane of line 7—7 of FIG. 6 and looking in the direction of the arrows.
Figure 8:
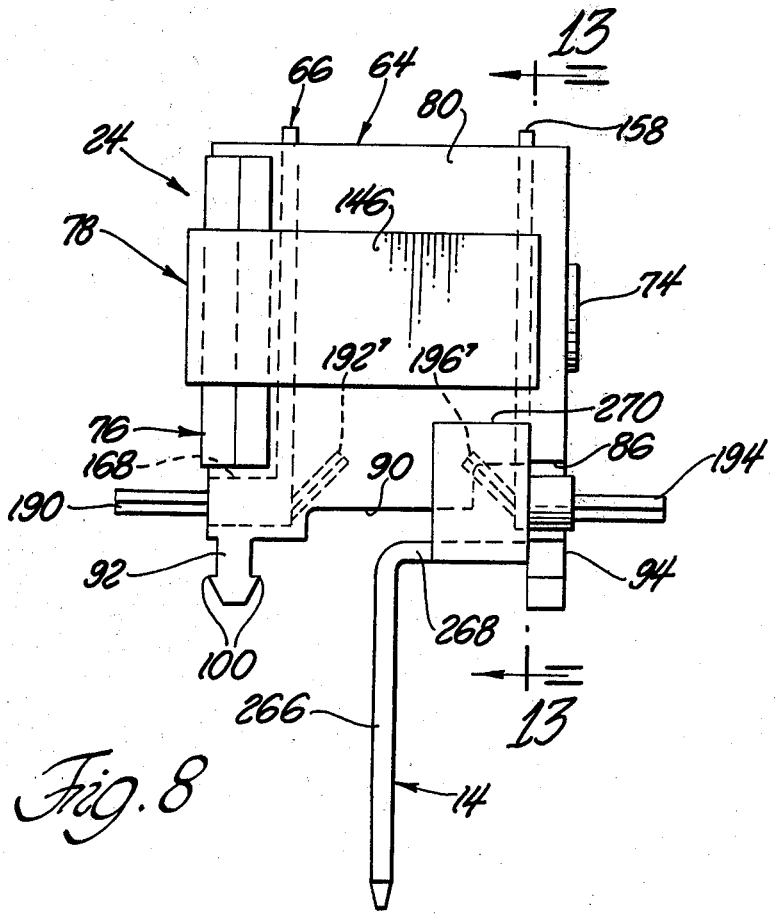
FIG. 8 is a view taken generally on the plane of line 8—8 of FIG. 7 and looking in the direction of the arrows.
Figure 9:
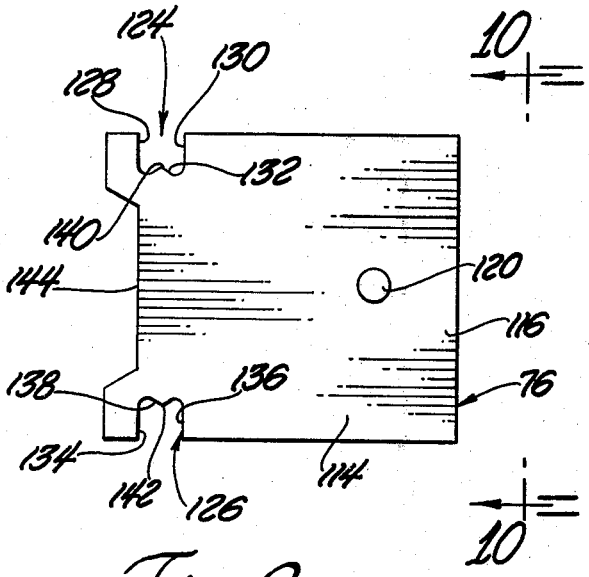
FIG. 9 is a view of one of the elements of FIG. 6 taken generally on the plane of line 9—9 of FIG. 6 and looking in the direction of the arrows.
Figure 10:
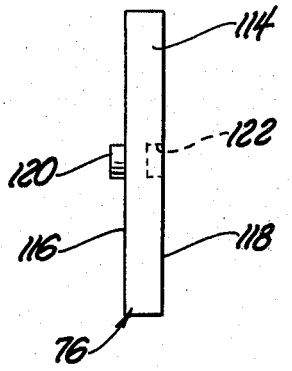
FIG. 10 is a view taken generally on the plane of line 10—10 of FIG. 9 and looking in the direction of the arrows.
Figure 11:
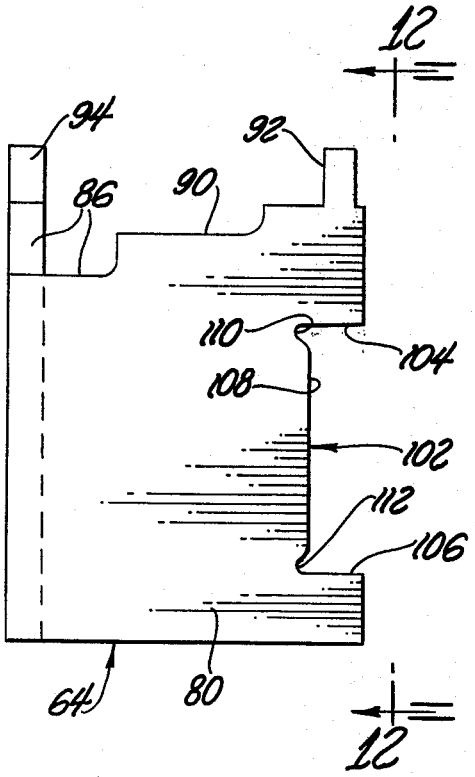
FIG. 11 is a view of one of the elements in, for example, either of FIGS. 5, 6, 7 or 8 and taken, for example, generally in a direction of arrow A of FIG. 5.
Figure 12:
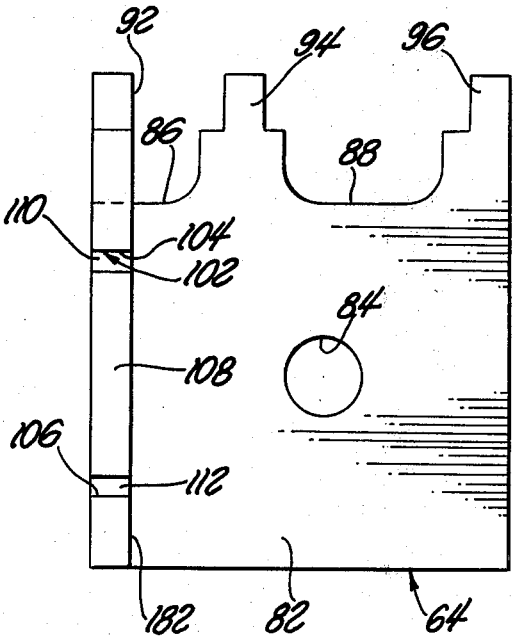
FIG. 12 is a view taken generally on the plane of line 12—12 of FIG. 11 and looking in the direction of the arrows.
Figure 14:
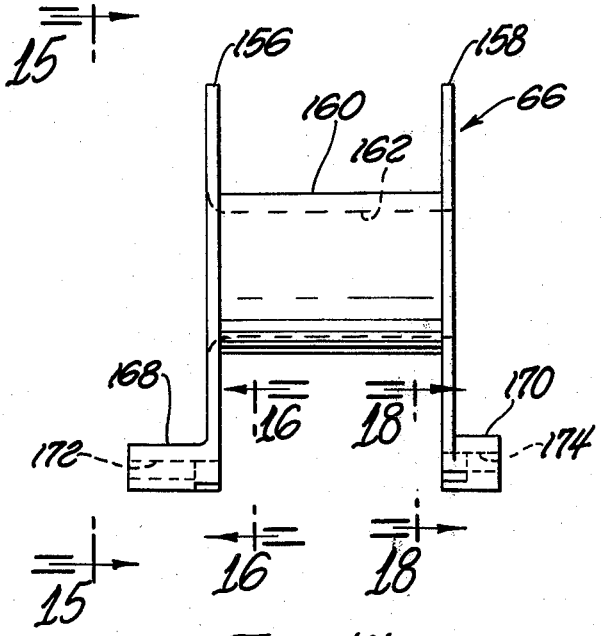
FIG. 14 is a view taken generally on the plane of line 14—14 of FIG. 13 and looking in the direction of the arrows.
Figure 13:
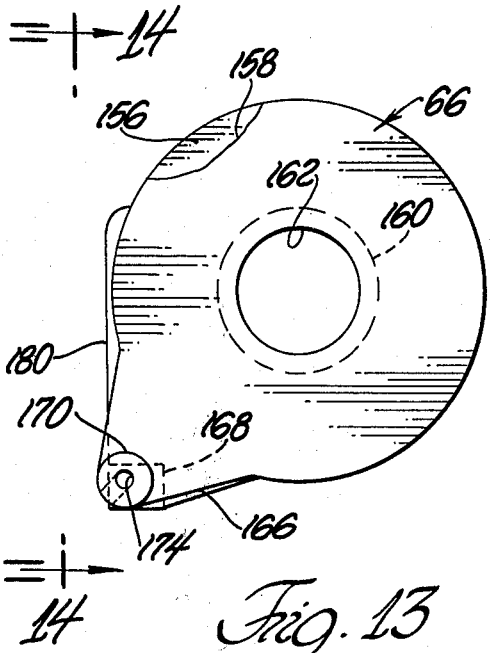
FIG. 13 is a view of one of the elements of, for example, FIGS. 6, 7 or 8, taken generally on the plane of line 13—13 of FIG. 8 and looking in the direction of the arrows.
Figure 15:
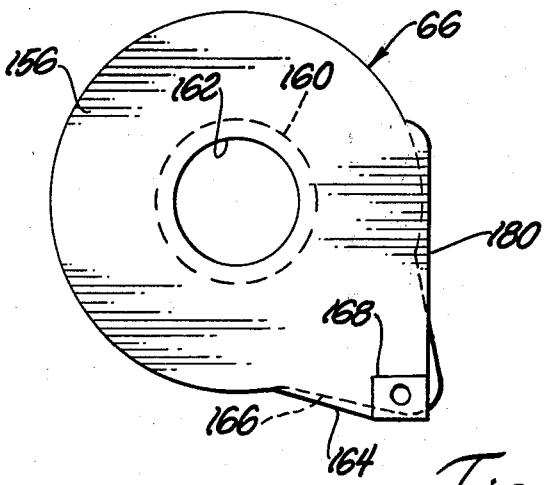
FIG. 15 is a view taken generally on the plane of line 15—15 of FIG. 14 and looking in the direction of the arrows.

The frame means 12, as shown for example in FIGS. 6-12, is preferably of one-piece formed construction and, as viewed in FIG. 6, is of a generally L-shaped configuration with one leg thereof comprising a frame body portion 80 and the other leg thereof comprising a frame body portion 82. An aperture 84 formed through body or wall portion 82 of frame means 64 permits the passage therethrough of a portion of core means 70 for purposes of assembly thereto. As shown in, for example, FIGS. 7, 8, 11 and 12, body portions 80 and 82 are provided as with cut-out or relieved portions 86, 88 and 90 as to, for example, provide clearance for related or associated components. Frame means 64 is also provided with a plurality of extending leg-like portions 92, 94 and 96 which, in assembly with base means 12, are respectively received within a plurality of receiving-recesses one of which is illustrated as at 98 of FIG. 2. The legs 92, 94 and 96 may have any desired configuration. By example, and not by way of limitation, the legs 92, 94 and 96 in FIGS. 11 and 12 are depicted as being straight while the corresponding legs 92, 94 and 96 of FIGS. 2, 7 and 8 are illustrated as being provided with ends having flared-out portions 100 which, in some instances may be desired in order to provide a biting action with respect to the body means 12 when assembled thereto.

As best seen in FIGS. 11 and 12, frame well 80 is provided with a cut-out or opening 102 which, in the preferred embodiment comprises opposed walls or edge surfaces 104 and 106 and a transverse wall or edge surface 108. Further, in the preferred embodiment, walls 104 and 106 each extend somewhat beyond the plane of surface 108 as into respective notch-like or relief portions 110 and 112. The purpose of opening or recess 102 is to operatively accept therein the armature means 76 as to have such armature means assume a position as generally depicted in, for example, FIG. 6 when in assembled relationship.

The armature means 76, as best seen in FIGS. 9 and 10, preferably comprises a main body 114 having opposite generally parallel planar surfaces 116 and 118. A post-like projection 120 may be integrally formed in body 114 as by metal forming whereby metal is displaced outwardly of surface 116 as a consequence of an indentation 122 formed into body 114 from the opposite surface 118.

Figure 5:
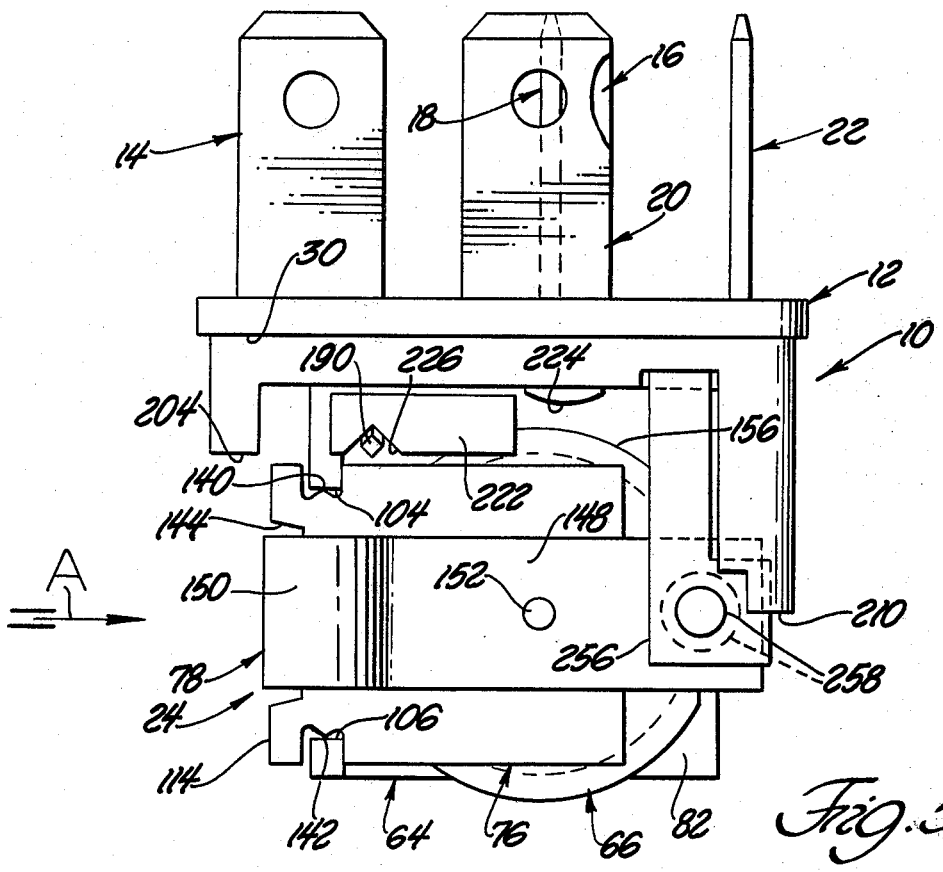
FIG. 5 is a view taken generally on the plane of line 5—5 of FIG. 1 and looking in the direction of the arrows.

Generally at the left end, as viewed in FIG. 9, of armature body 114, recesses or slots 124 and 126 are formed into body 114 at opposite sides thereof. Recess or opening 124 comprises opposed spaced side walls or surfaces 128 and 130 which join with an end wall or edge 132. Similarly, recess or opening 126 comprises opposed spaced side walls 134 and 136 which join with an edge portion or wall 138. As generally depicted, wall or end surface 132 is formed as to be of a configuration generally protruding toward the open end of opening 124. Similarly, wall or end surface 138 is formed as to be of a configuration generally protruding toward the open end of opening 126. In the preferred embodiment opposite ends of wall or end surface 132 join as at an apex 140, which may have a slight radius of curvature instead of a sharp point or edge, and, similarly, the opposite ends of wall or edge surface 138 join as at an apex 142 which, too, may have a slight radius of curvature instead of a sharp point or edge. Preferably, the extreme left end (as viewed in FIG. 9) is also provided with a cut-out or recess portion 144 which serves to reduce the moment of inertia of armature 76 as well as provide for clearance which may be needed for cooperating spring means 78. As best seen in FIGS. 1 and 5, the armature means 76 is operatively received by the outer core means or frame means 64 as by having the body 114 of armature 76 received within opening 102 as between opposed walls 104 and 106 while that portion of frame body 80 defining wall 104 is confined between walls 128 and 130, of armature slot 124, and that portion of frame body 80 defining wall 106 is confined between walls 134 and 136 of armature slot 126. The widths of slots 124 and 126 are slightly greater than the thickness of armature body portion 80 thereby permitting angular movement of armature body 114 relative to wall or body portion 80. However, in the preferred embodiment the dimensional distance from apex 140 to apex 142 is very close to but very slightly less than the dimensional distance between confining walls 104 and 106 of frame means 76. Referring to each of FIGS. 5, 9, 11 and 12, it can be seen that apex-like portion 140 and juxtaposed surface 104 cooperatively define first and second bearing-like surface means while apex-like portion 142 and juxtaposed surface 106 cooperatively define third and fourth bearing-like surface means. As should be apparent, if apex-like portion 140 is considered to be the first bearing-like surface then it, in effect, presents a projecting bearing of very little effective engaging area as compared to the area of the juxtaposed surface 104. Similarly, if apex-like portion 142 is considered to be the third bearing-like surface then it, too, in effect, presents a projecting bearing of very little effective engaging area as compared to the area of the juxtaposed surface 106.

The armature means 76 is operatively connected to the spring means 78 which, in the embodiment illustrated, also serves as electrical conductor and contact means. More particularly, contact means 78 is formed as to have arm portion 146 and 148 (which may be generally of rectangular configuration when viewed as in FIGS. 3 and 5) integrally joined together as by an arcuate bight-like portion 150. The entire leaf means 78 is preferably comprised of copper alloy suitably treated to be of resilient spring quality. Accordingly, when arms 146 and 148 are respectively secured to frame means 64 and armature means 76 the intermediate bight portion 150 serves as a spring serving to, in the embodiment depicted, return the armature means 76 to the position illustrated as in, for example, FIGS. 1 and 6. In the preferred embodiment, arm 148 is provided with an aperture for closely receiving therethrough the projection 120 carried by armature means 76 so that assembly of the arm 148 to armature body 114 may be accomplished simply by passing projection 120 through such aperture (in arm 148) and then deforming, as by peening or the like, the projection 120 against the arm 148 as to form a head-like portion 152 retaining arm 148 and armature body 114 in assembled relationship to each other.

It has been discovered that arm 146 can be secured to frame body portion 80 by sonic welding even though the frame means is preferably made of steel possessing high magnetic properties and, therefore, dissimilar to the leaf means 78 and arm 146, and, even though the thickness of frame body portion 80 is greatly more than the thickness of arm 146. In the preferred embodiment of the invention arm 146 is sonically welded to frame wall portion 80.

Figure 18:
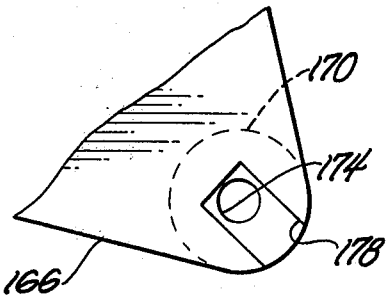
FIG. 18 is an enlarged view of a fragmentary portion of the structure of FIG. 14 taken generally on the plane of line 18—18 of FIG. 14 and looking in the direction of the arrows.
Figure 16:
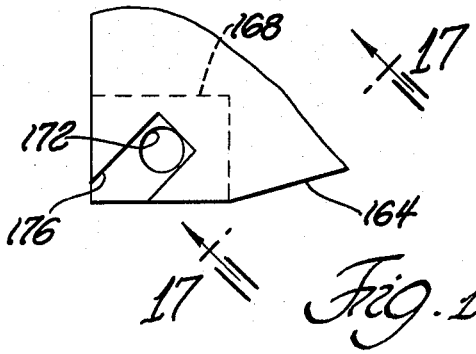
FIG. 16 is an enlarged view of a fragmentary portion of the structure of FIG. 14 taken generally on the plane of line 16—16 of FIG. 14 and looking in the direction of the arrows.
Figure 17:
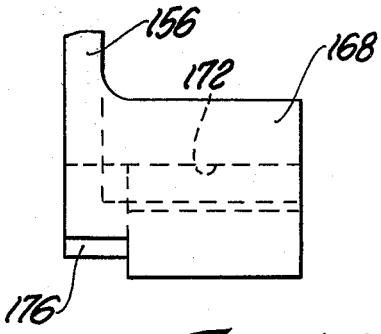
FIG. 17 is a view taken generally on the plane of line 17—17 of FIG. 16 and looking in the direction of the arrows.

Referring in greater detail to FIGS. 13–18, the spool means 66, preferably formed of plastic electrically nonconductive material, is illustrated as being of unitary molded construction and comprising opposed spaced end walls 156 and 158 joined as by a tubular portion 160 defining a passage 162 therethrough as well as through end walls 156 and 158 which passage 162 closely receives therethrough the inner core means 70 (FIG. 6). As generally illustrated in, for example, FIGS. 13 and 15, end walls 156 and 158 may, for the most part, be generally circular in outer configuration. However, in the preferred embodiment, end wall 156 is provided with an integrally formed generally radially outwardly extending arm-like portion or projection 164 while, similarly, end wall 158 is provided with an integrally formed generally radially outwardly extending arm-like portion or projection 166. Arm portions 156 and 158, in turn, respectively, are preferably provided with integrally formed generally transversely extending projections 168 and 170 with projection 168, when viewed as in either FIG. 15 or 16, being of generally rectilinear configuration while projection 170, when viewed as in either FIG. 13 or 18, being of generally circular or cylindrical configuration. As seen in each of FIGS. 13, 15, 16 and 18, preferably, projections 168 and 170 are respectively provided with passages 172 and 174 formed therethrough with each of such passages, when viewed axially, being of generally circular or cylindrical configuration. Further, as best shown in FIGS. 16 and 18, the generally inner end of extension 168 is provided with a slot-like recess 176, preferably radially aligned with the axis of passage 162, while the generally inner end of extension 170 is provided with a slot-like recess 178, also preferably aligned with the axis of passage 162. Also, in the preferred embodiment, end wall 156 is provided with a vertically extending edge or surface 180 which, preferably, enables such surface 180 to abut against the inner surface 182 of frame body portion 80 during assembly of both to each other. The spool means 66, of course, is intended to carry the relay winding or coil means 184 generally about tubular portion 160 and between end walls 156 and 158.

Figure 19:
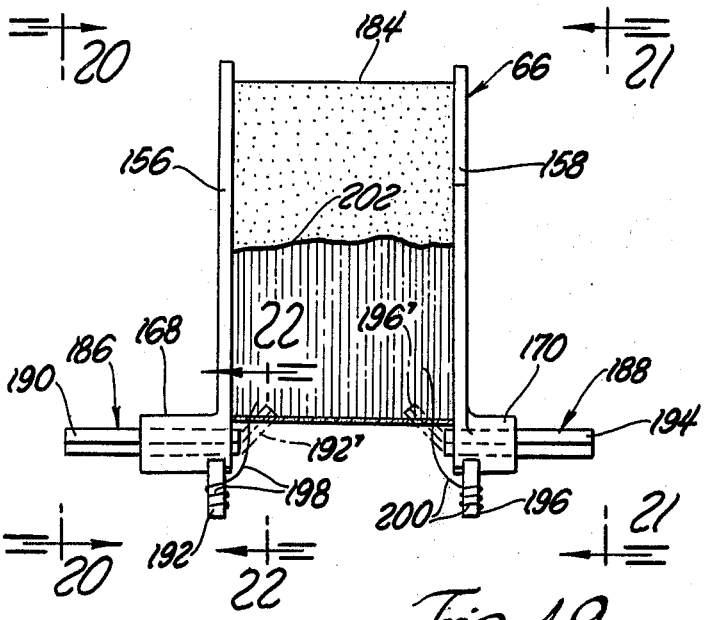
FIG. 19 is a view of one of the sub-assemblies partially shown in hidden line and partially in solid line in FIG. 8 and illustrated in FIG. 19 in the same relative position as shown in FIG. 8.
Figure 20:
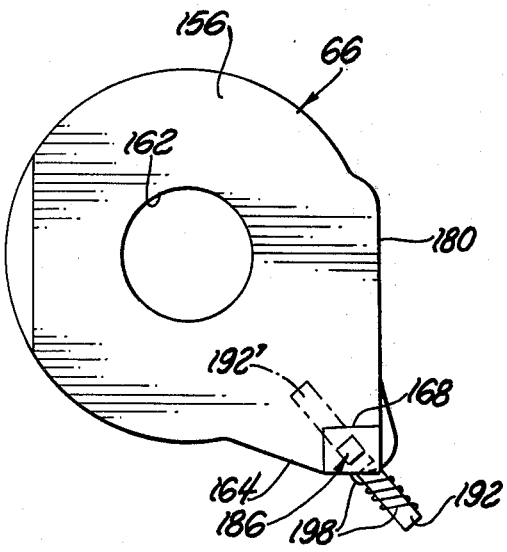
FIG. 20 is a view taken generally on the plane of line 20—20 of FIG. 19 and looking in the direction of the arrows.
Figure 21:
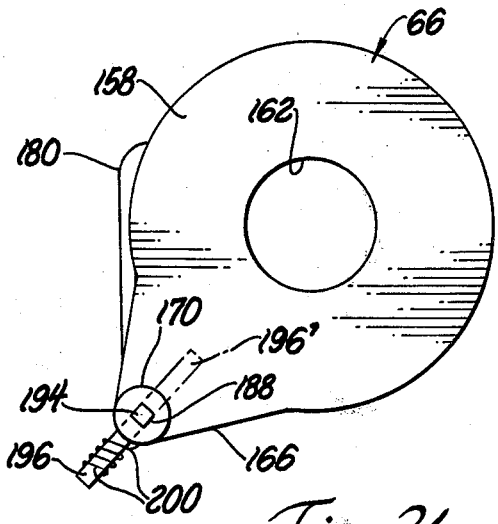
FIG. 21 is a view taken generally on the plane of line 21—21 of FIG. 19 and looking in the direction of the arrows.
Figure 22:
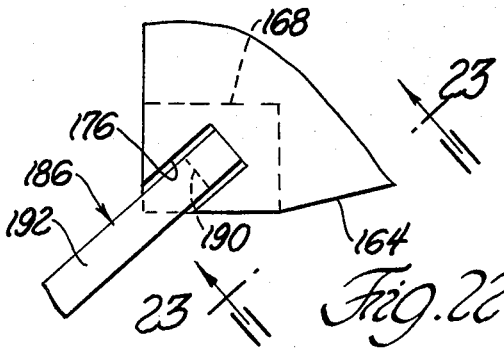
FIG. 22 is an enlarged view of a fragmentary portion of the structure of FIG. 19 taken generally on the plane of line 22—22 and looking in the direction of the arrows.
Figure 23:
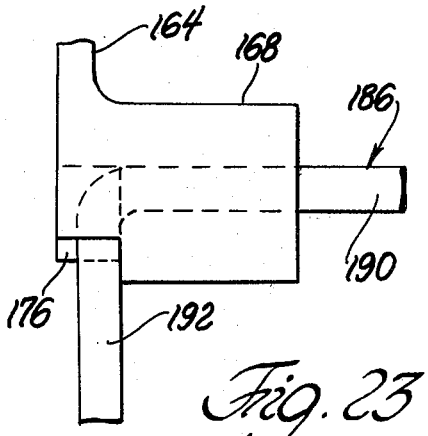
FIG. 23 is a view taken generally on the plane of line 23—23 of FIG. 22 and looking in the direction of the arrows.

Referring in greater detail to FIGS. 19–23, the coil means 184 is illustrated as having been wound onto the spool means 66 and electrically connected to cooperating electrical terminal members 186 and 188, as to be more fully described. As possibly best illustrated in FIGS. 19, 20 and 21, each of terminals 186 and 188 is preferably elongated and generally square in transverse configuration. Further terminal member 186 may be considered as having portions 190 and 192 disposed at, for example, right angle to each other while terminal member 188 may also be considered as having portions 194 and 196 also disposed at, for example, right angle to each other. In the preferred method of construction of the wire coil and spool assembly, terminal 186 is assembled to the spool means 66 as by pressing terminal portion 190 through aperture or passage 172 (FIGS. 14 and 16) until terminal portion 192 is received within slot or recess 176 (FIGS. 16 and 22). Similarly, terminal 188 is assembled to the spool means 66 as by pressing terminal portion 194 through aperture or passage 174 (FIGS. 14 and 18) until terminal portion 196 is received within slot or recess 178 (FIGS. 18 and 19). The fact that the diametral dimension of passages 172 and 174 is less than the diagonal dimension across the corners of the terminals 186 and 186 results in such terminal members 186 and 186 somewhat deflecting the material defining such passages and thereby be press-fitted therein. The wire comprising the coil means 184 is wound onto the bobbin 66 and the ends, as represented by leads 198 and 200, of the coil 184 are respectively connected to terminal portions 192 and 196 (FIGS. 19, 20 and 21) and, preferably, soldered thereto. If desired, the coil means 184 may be covered as by paper or covered, partially or fully, as by a wax as generally depicted at 202. After such attachment of coil leads 198 and 200 to terminal portions 192 and 196, portions 192 and 196 are formed over in a direction generally toward coil means 184 as to respectively assume positions depicted in phantom lines at 192' and 196'. This, of course, results in such terminal portions becoming physically closer to coil means 184 with the attendant result that all possible previously established tension in coil leads 198 and 200 is eliminated and such leads are physically placed in a relaxed force-free condition as between the coil means 184 and respective terminal portions 192 and 196. In at least one successful embodiment of the invention, the coil means 184 was comprised of 1660 turns of 36 gauge magnet wire comprised of copper of 0.005 inch diameter while the terminals 186 and 188 were 0.025 inch, square.

Referring now in greater detail to FIGS. 24–27, the base or body means 12 is illustrated as comprising a plurality of generally upstanding integrally formed body portions 204, 206 and 208, which may be of generally equal height, and a further integrally pedestal-like extension portion 210 which may be provided as with a slot 212 as to at least partially receive a portion of terminal means 18 as to thereby provide stability thereto. Body portions 204, 206, 208 and 210 are preferably provided with outer surfaces adapted for close reception as by associated cover or housing means 26 (FIG. 2). A further upstanding integrally formed extension 214 serves as a generally lateral support for the terminal means 22.

Figure 25:
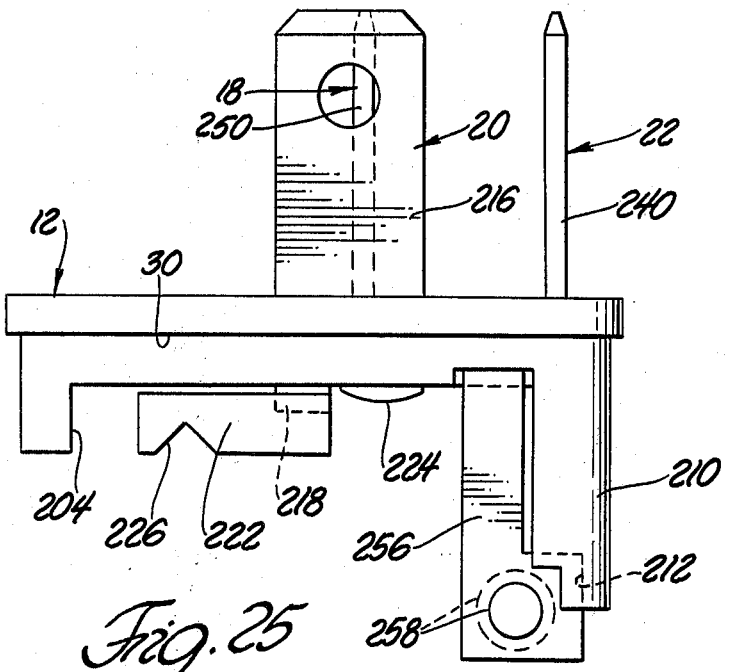
FIG. 25 is a view taken generally on the plane of line 25—25 of FIG. 24 and looking in the direction of the arrows.
Figure 24:
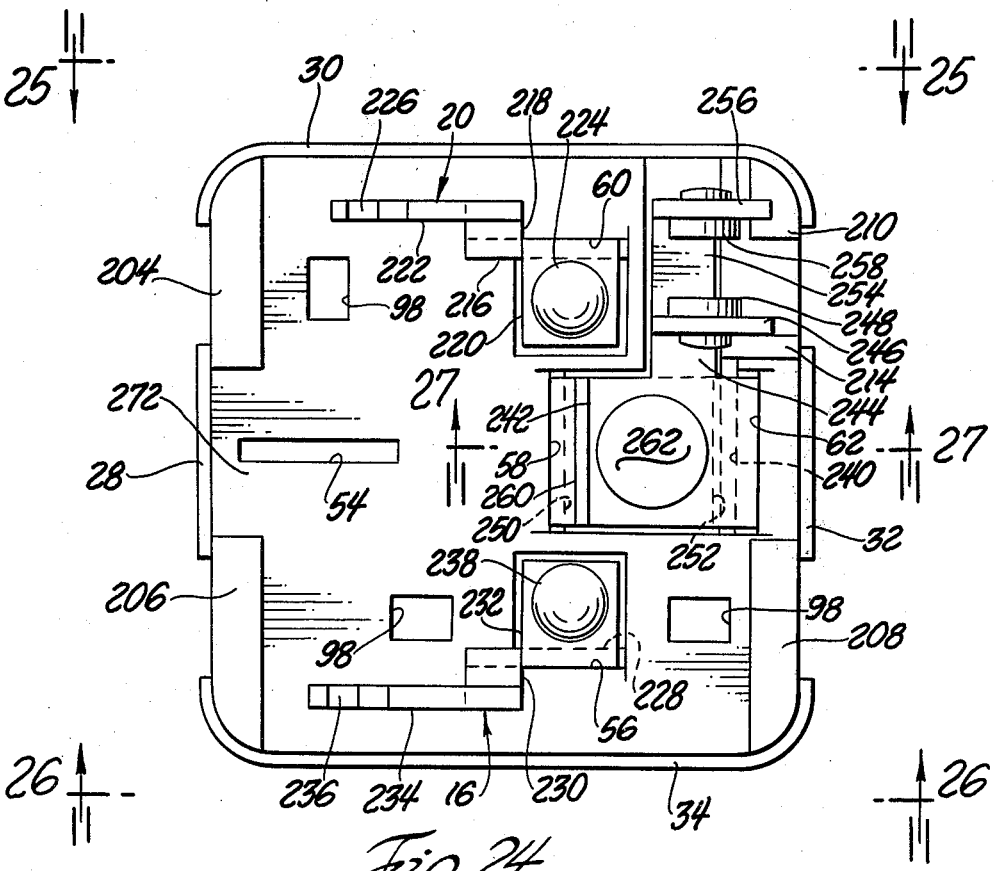
FIG. 24 is a view similar to that of FIG. 1 with the structure of FIG. 6 being removed from the view of FIG. 1.

As best seen in FIGS. 24 and 25, terminal means 20 is illustrated as comprising a blade-like contact or terminal portion 216 which extends through slot 60 in base 12 and is integrally formed with first and second oppositely directed laterally extending body portions 218 and 220 with body portion 218 continuing also generally away from base 12 and terminating in a generally cantilevered arm portion 222. A suitable rivet 224, or the like, extending through terminal body portion 220, serves to physically secure terminal means 20 to base means 12. A V-like notch 226 is formed in arm portion 222 for the reception of coil means 184 terminal means 186 as to be described.

Figure 26:
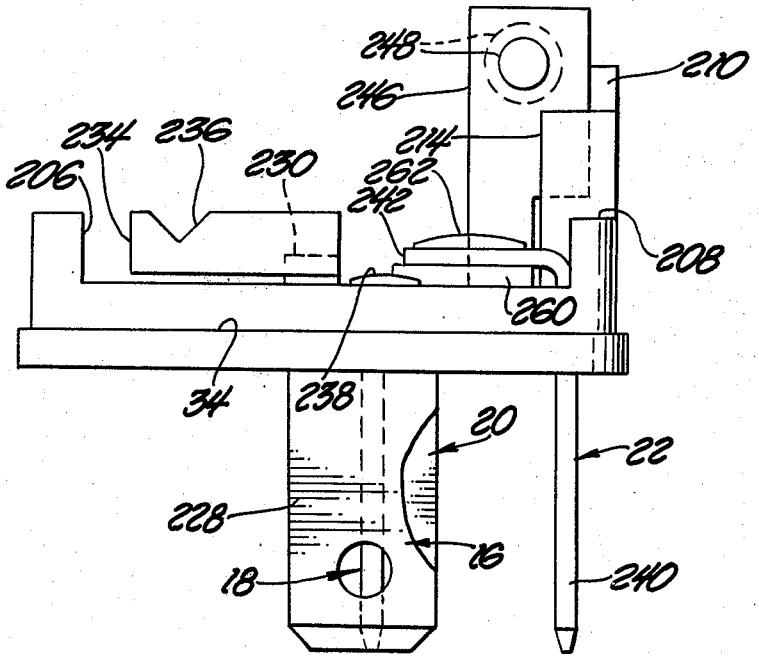
FIG. 26 is a view taken generally on the plane of line 26—26 of FIG. 24 and looking in the direction of the arrows.

As best seen in FIGS. 24 and 26, terminal means 16 is illustrated as comprising a blade-like contact or terminal portion 228 which extends through slot 56 in base 12 and is integrally formed with first and second oppositely directed laterally extending body portions 230 and 232 with body portion 230 continuing also generally away from base means 12 and terminating in a generally cantilevered arm portion 234 provided with a V-like notch 236 formed therein for the reception of coil terminal means 188 as to be described. A suitable rivet 238, or the like, extending through terminal body portion, 232 serves to physically secure terminal means 16 to base means 12.

As best seen in FIGS. 24–27, terminal means 22 is illustrated as comprising a blade-like contact or terminal portion 240 which extends through slot 62 in base means 12 and then continues in a generally laterally disposed direction defining a body portion 242 which, in turn, is integrally formed with a second laterally extending arm-like portion 244 which is integrally formed with an upstanding pedestal-like body portion 246 carrying an electrical contact 248 as near the upper or free end thereof.

Terminal means 18 is illustrated as comprising a bladelike contact or terminal portion 250 which extends through slot 58 in base means 12 and then continues in a generally laterally disposed direction defining a body portion 252 which, in turn, is integrally formed with a second laterally extending arm-like portion 254 which is integrally formed with an upstanding pedestal-like body portion 256 carrying an electrical contact 258 as near the upper or free end thereof.

Figure 27:
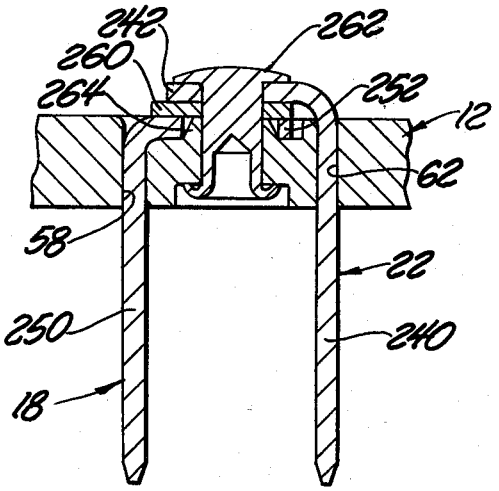
FIG. 27 is a fragmentary cross-sectional view taken generally on the plane of line 27—27 of FIG. 24 and looking in the direction of the arrows.

As generally depicted in FIGS. 24, 26 and 27, body portions 242 and 252 of respective terminal means 22 and 18, as well as the respective lateral arm portions 244 and 254 are electrically isolated from each other as by suitable dielectric spacer means 260. Terminal means 18 and 22 as well as dielectric spacer means 260 may be collectively secured to base means 12 as by a common rivet 262, or the like, extending through body portions 252 and 242 as well as insulator 260 with body portion 252 preferably being nested as against a pilot-like portion 264 of base means 12.

Referring to FIGS. 1–4 and 6–8, terminal means 14 is illustrated as comprising a blade-like contact or terminal portion 266, which as shown in FIGS. 1 and 4 extends through slot 54 in base means 12, having an integrally formed laterally extending body portion 268 which, in turn, has an integrally formed generally upstanding leg portion 270 suitably secured, in electrically conductive relationship, to frame means 64 as against frame body portion 80 as by, for example, soldering.

With the base sub-assembly constructed as generally depicted in FIGS. 24, 25 and 26 and with the coil and armature sub-assembly constructed as generally depicted in FIGS. 6, 7 and 8, the next step is to assemble such sub-assemblies into the overall assembly as generally depicted in, for example, FIGS. 1, 2, 3 and 4. This is accomplished as by passing the blade portion 266 of terminal means 14 (FIGS. 6, 7 and 8) through the slot 54 (FIG. 24) of base means 54 and pressing legs or extensions 92, 94 and 96 of frame means 64 (FIGS. 6, 7 and 8) into the respective recesses or receiving openings 98—98 (FIGS. 2, 4 and 24) of base means 12 until the frame means 64 is firmly seated as against the inner surface 272 of base means 12.

In so doing coil or winding terminal portions 190 and 194 are brought into respective registry with notches 226 and 236 and somewhat deflected by the portions of arms 222 and 234 respectively defining such V-like notches. Terminal portions 190 and 194 thusly received by or cradled by V-like notches 226 and 236 are then preferably securely electrically connected to arms 222 and 234, respectively, as by soldering. In thusly assembling the coil and armature sub-assembly to the base subassembly, the electrical contact means 274, carried by contact leaf means 148, is placed generally between stationary contacts 258 and 248 as to be generally juxtaposed to both.

OPERATION

Figure 28:
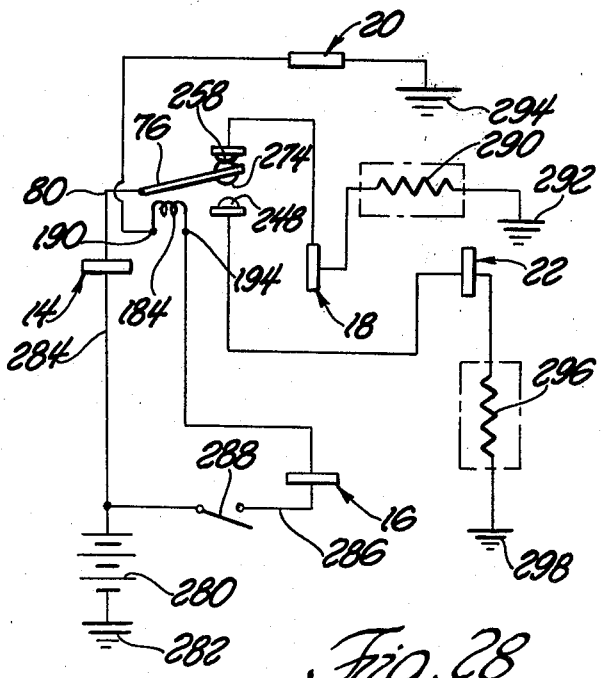
FIG. 28 is a schematic wiring diagram illustrating the relay assembly of FIGS. 1-27 within a selected operating environment.

FIG. 28, in schematic form, illustrates the circuitry of the relay means 10 within an associated environment. That is, a source of electrical potential 280, grounded as at 282, may be electrically connected to terminal means 14 and to terminal means 16 as via respective conductor means 284 and 286 with conductor means 286 comprising switch means 288.

Terminal means 16 is electrically connected as to terminal portion 194 of relay coil 184 with the opposite terminal portion 190 thereof being electrically connected to terminal means 20 grounded as at 294.

Armature means 76 and leaf contact 148 carry contact means 274 which is normally closed against contact means 258. Contact means 274 and leaf 148 are, as through wall portion 80 of frame means 64, electrically connected to terminal means 14.

Fixed contact means 258 is electrically connected as via terminal means 18 to related load means 290 grounded as at 292 while fixed contact means 248 is electrically connected as via terminal means 22 to related load means 296 grounded as at 298.

In FIG. 28, when switch means closes the circuit to terminal means 16, relay coil means 184 becomes energized causing armature means 76 to move generally downwardly resulting in contact means 258 and 274 becoming opened and contact means 248 and 274 becoming closed thereby de-energizing load means 290 and energizing load means 296.

Figure 29:
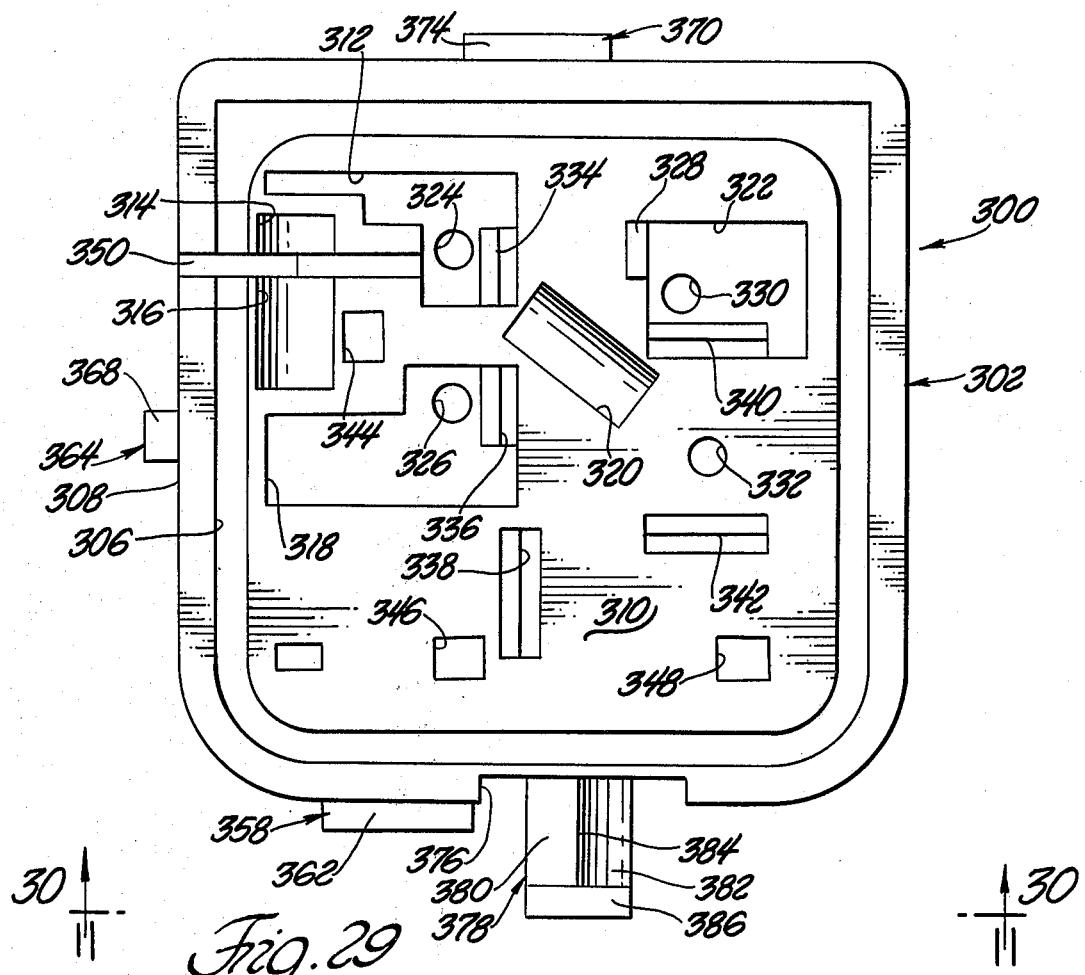
FIG. 29 is a plan view of an alternate embodiment of base means employable in the practice of the invention.
Figure 30:
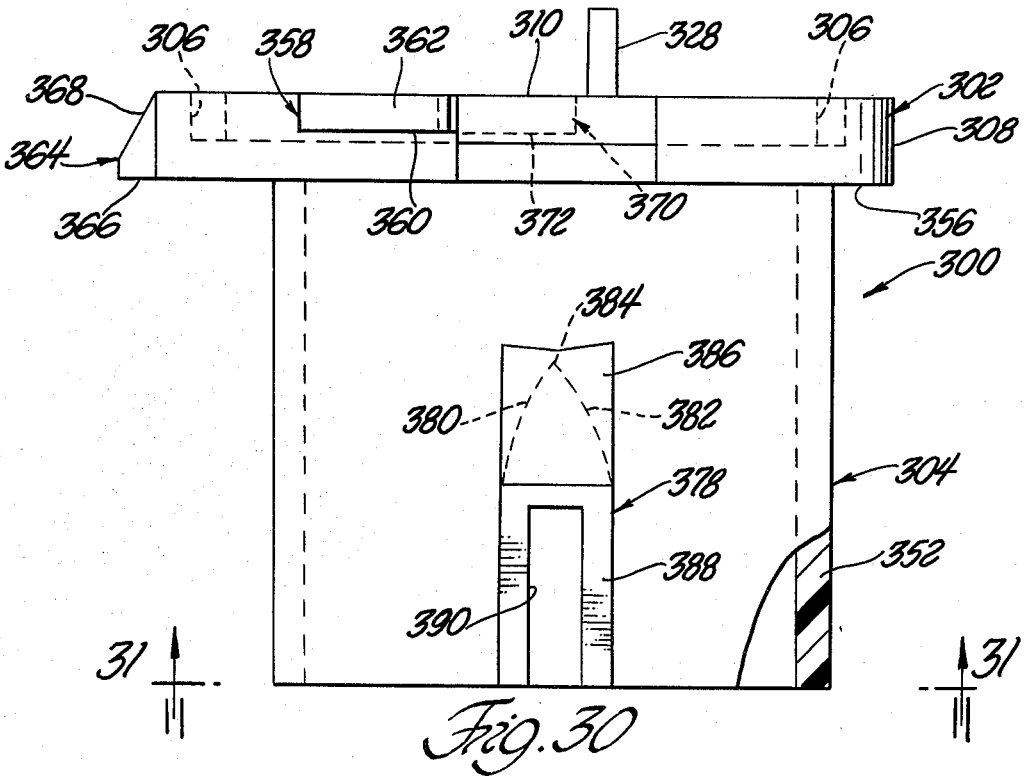
FIG. 30 is an elevational view taken generally on the plane of line 30—30 of FIG. 29 and looking in the direction of the arrows.
Figure 31:
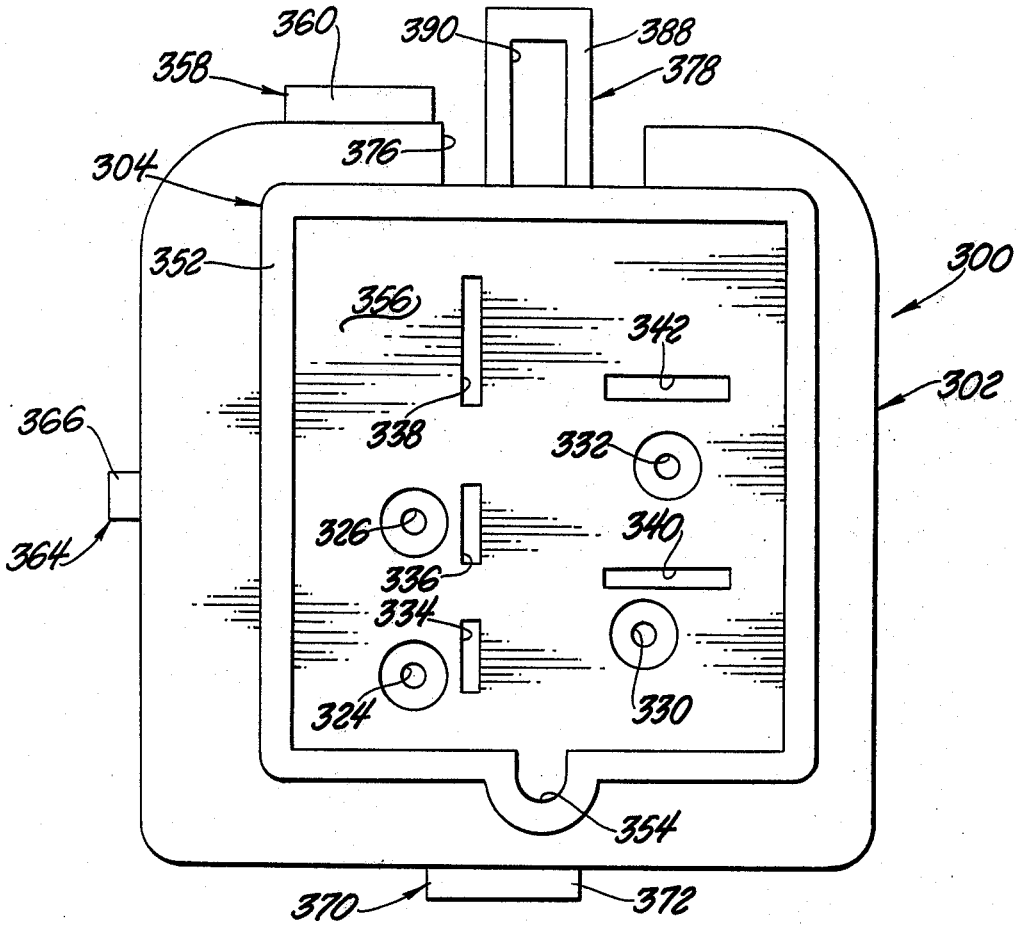
FIG. 31 is a view taken generally on the plane of line 31—31 of FIG. 30 and looking in the direction of the arrows.

FIGS. 29, 30 and 31 illustrate a somewhat modified embodiment of a base means 300 employable in practicing the invention. Referring in greater detail to FIGS. 29, 30 and 31, the base means 300, preferably comprised of dielectric plastic material exhibiting a limited degree of resiliency, is illustrated as comprising a generally transversely extending main body portion 302 with an integrally formed (downwardly as shown in FIG. 30) skirt or shroud portion 304. The main body portion 302 has a generally circumscribing groove or recess 306 formed therein as to be spaced generally inwardly from the outer wall surface 308.

The upper surface 310 of main body portion 302 is, by way of example and not of limitation, shown as having, preferably, a plurality of selectively controured recessed portions as at 312, 314, 316, 318, 320 and 322 which are effective for having seated therein components as illustrated generally in FIGS. 1–28. Various apertures or passages 324, 326, 330 and 332 enable suitable securing means, such as rivets, to extend therethrough and secure the related component to the body portion 302. A plurality of slots 334, 336, 338, 340 and 342 are shown as formed through main body portion 302 as to accommodate the extension therethrough of electrical terminal means functionally equivalent to, for example means 14, 16, 18, 20 and 22 of FIGS. 2, 3, and 4. Body portion 302 may also have integrally formed wall or support portions, as needed or desired, as indicated generally at 328. Further, a plurality of recesses as at 344, 346 and 348 may be provided as to therein receive leg-like extensions of, for example, the related relay coil frame means as generally depicted, for example, at 96 and 98 of FIG. 2. In the preferred form, an elongated recess or groove is also provided in body portion 302 as at 350.

As seen in both FIGS. 30 and 31, the skirt or shroud 304 is comprised as of a continuous wall portion 352 which, preferably, comprises a polarizing means which, in the embodiment illustrated, is defined as by a longitudinal groove or recess 354. As shown in FIG. 31, the slots 334, 336, 338, 340 and 342 extend through the lower surface 356 of main body portion 302 and the respective passages 324, 326, 330 and 332 may be provided with circumscribing counterbores in surface 356 as generally depicted.

Referring to each of FIGS. 29, 30 and 31, a plurality of latching or detent means or members are provided. For example, a first such detent latching means 358, preferably integrally formed with main body means 302, is formed to have a lower disposed (as viewed in FIG. 30) generally flat latching surface 360 and an upper disposed ramp or cam-like surface 362. A second detent latching means 364, preferably integrally formed with main body portion 302, is formed to have a lower (as viewed in FIG. 30) generally flat latching surface 366 and an upper disposed ramp or cam-like surface 368. A third detent latching means 370, preferably integrally formed with main body portion 302, is formed to have a lower (as viewed in FIG. 30) generally flat latching surface 372 and an upper disposed ramp or cam-like surface 374. A cut-out like portion 376 is preferably formed generally in main body portion 302.

In the preferred embodiment, a latching arm 378 is also provided and integrally formed as with the wall portion 352 defining the shroud 304. The latching arm 378 is illustrated as comprising a body having a generally upwardly disposed portion which has oppositely disposed surfaces 380 and 382 generally inclined toward each other as to meet as at 384. Such surfaces 380 and 382 are disposed generally between the outer surface of shroud-defining wall 352 and an eccentrically situated generally vertically extending wall 386. The lower disposed body portion is formed as to have the outer surface 388 thereof be inclined or taper toward the shroud wall 352 and may be provided with a slot-like recess 390.

Figure 34:
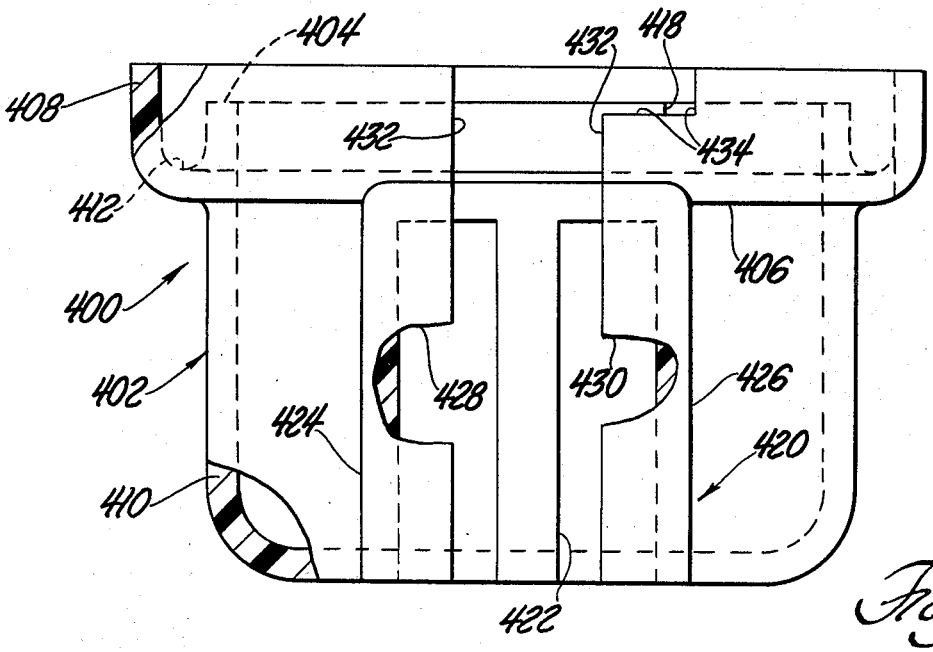
FIG. 34 is a view taken generally on the plane of line 34—34 of FIG. 33 and looking in the direction of the arrows.
Figure 32:
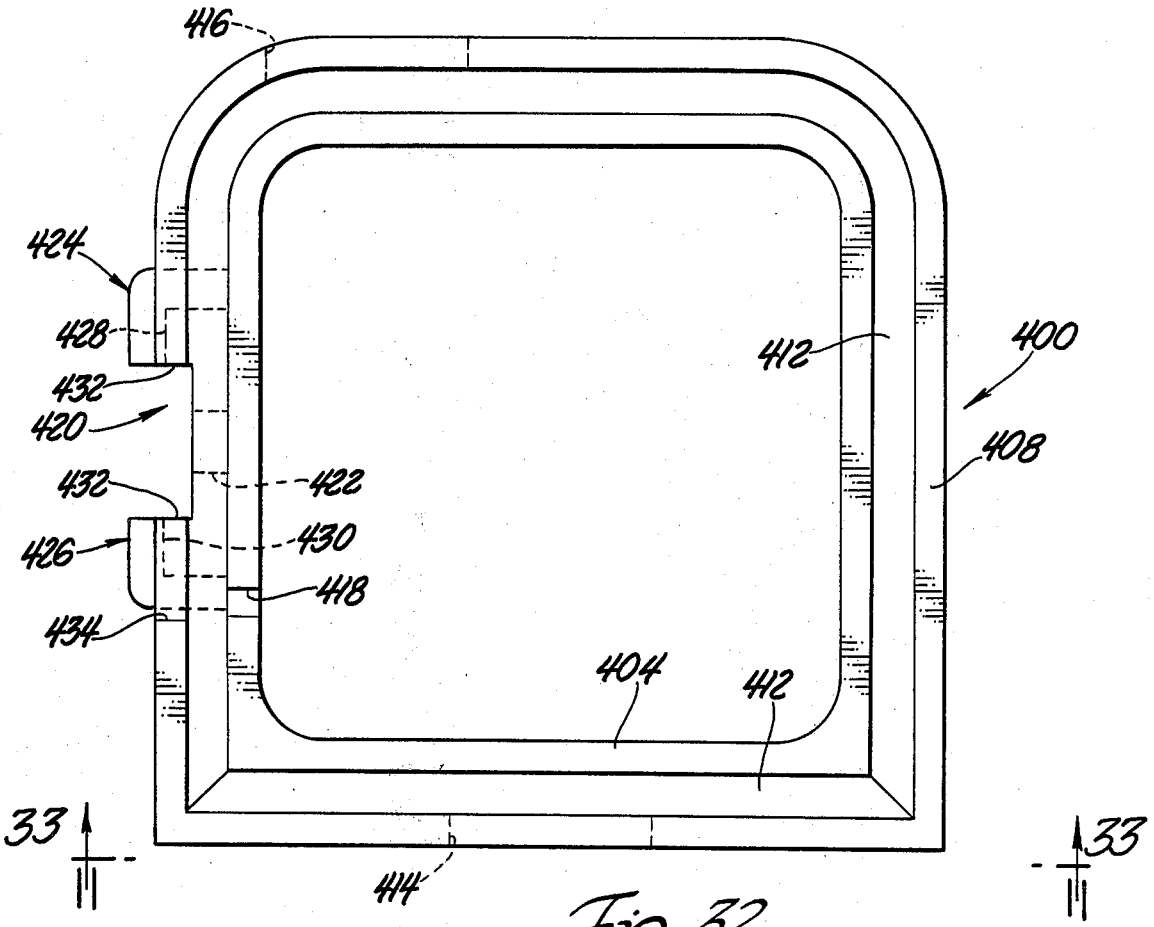
FIG. 32 is a view of a cover or housing means employable, for example, for cooperating with the structure of FIGS. 29-31 for completing a closed assembly.
Figure 33:
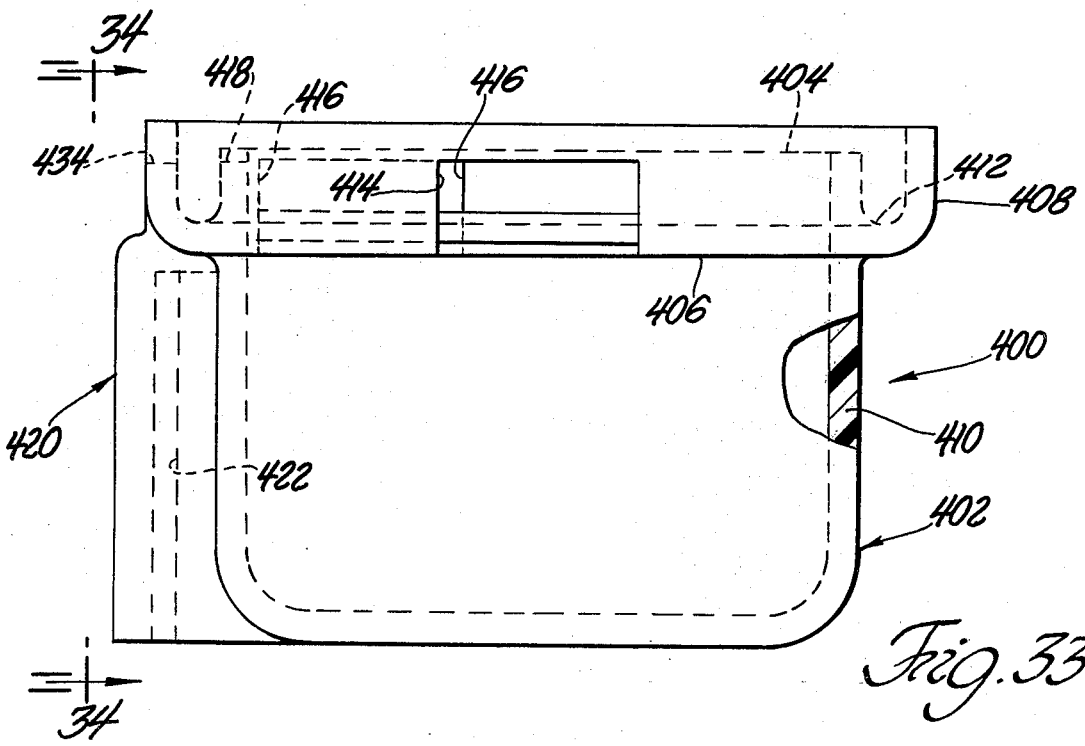
FIG. 33 is a view taken generally on the plane of line 33—33 of FIG. 32 and looking in the direction of the arrows.

Intended for cooperative connection to the base means 300 is a cap or cover means 400 as depicted generally in FIGS. 32, 33 and 34.

Referring in greater detail to FIGS. 32, 33 and 34, the cover means 400, preferably comprised of dielectric plastic material of limited resiliency, is shown as having a main body portion 402 of a generally cup-shaped configuration open as at end 404. A preferably integrally formed flange-like portion 406 extends generally radially outwardly of cup body 402 and has an upwardly (as viewed in FIGS. 33 and 34) directed wall portion 408. As seen in each of FIGS. 32, 33 and 34, wall portion 408 is laterally spaced from wall 410 of cup-like body 402 thereby defining a groove or recess 412 therebetween.

A plurality of openings and or slots are also formed in cover means 400. For example, a first opening 414 (as best seen in FIGS. 32 and 33) is formed in wall portion 408 while a second similar opening 416 is formed in wall portion 408 as to be generally oppositely disposed to opening 414. A slot or groove 418 is formed into the end 404 of wall 410 in such a location as to be generally juxtaposed to slot or recess 350 in base means 300 when the base means 300 and cover means 400 are assembled to each other.

Also preferably formed integrally with cup-like body means 402 is slide-like retainer means 420 which is illustrated as comprising a generally medially disposed rib-like portion 422 and a left (as viewed in FIG. 34) generally L-shaped slide retainer wall 424 and a right generally L-shaped slide retainer wall 426. As best seen in FIG. 32 the leg portion 428 of L-shaped wall means 424 and the leg portion 430 of L-shaped wall means 426 are generally directed toward each other. Preferably a portion of flange 406 and wall 408 is cut-away as at 432 to provide a slot-like continuation of the space generally between guide wall portions 428 and 430. Also, a notch-like portion 434 of wall 408 is cut-away as to provide for access to groove or recess 418.

Figure 35:
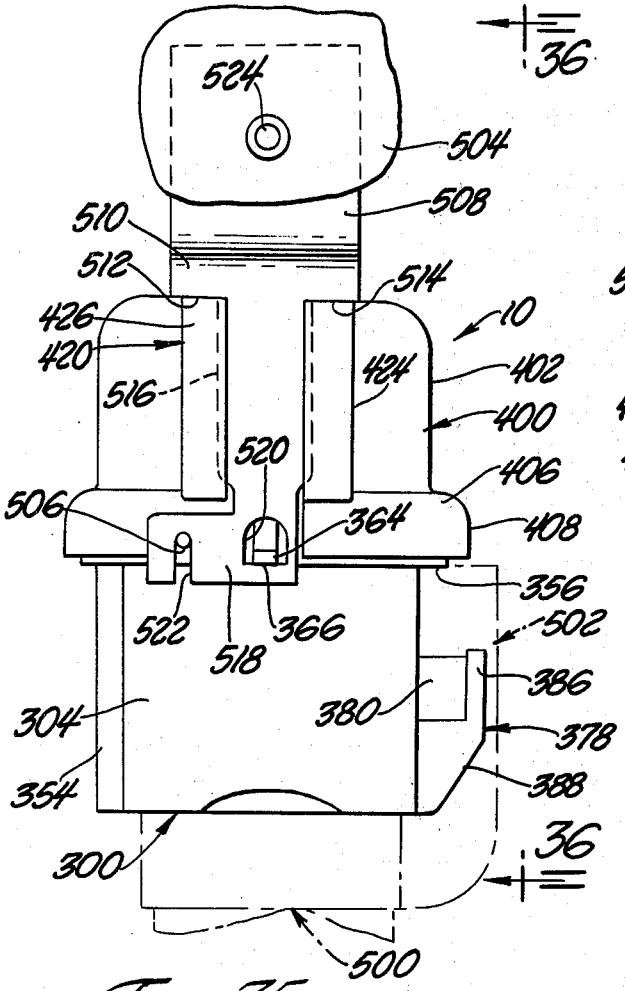
FIG. 35 is an elevational view of the base means of FIGS. 29, 30 and 31 assembled to the cover means of FIGS. 32, 33 and 34.
Figure 36:
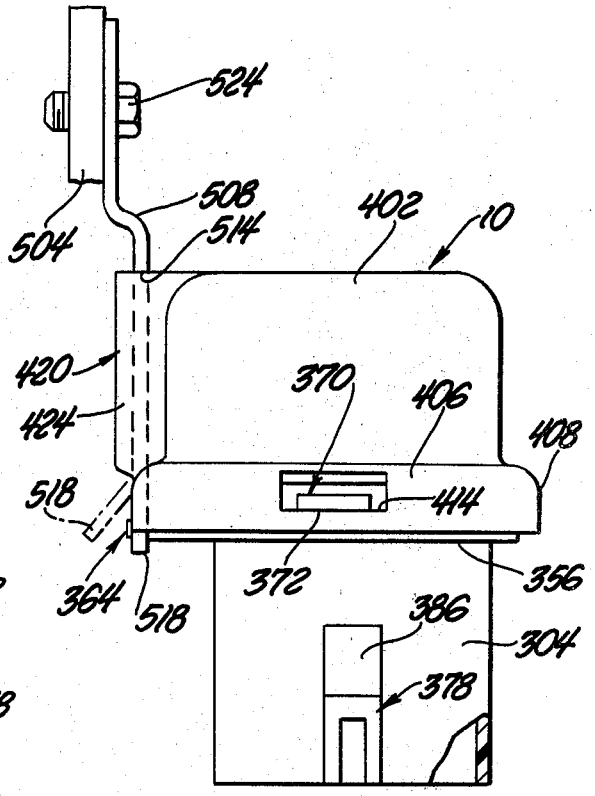
FIG. 36 is a view taken generally on the plane of line 36—36 of FIG. 35 and looking in the direction of the arrows.

FIGS. 35, 36, 37 and 38 illustrate the cover means 400 and base means 300 in assembled condition. FIGS. 35 and 36 illustrate such an assembly as may be used in an arrangement where a mounting bracket is employed to complete an electrical ground connection as between circuitry contained within the assembled base means 300 and cover means 400 and related support structure.

Figure 37:
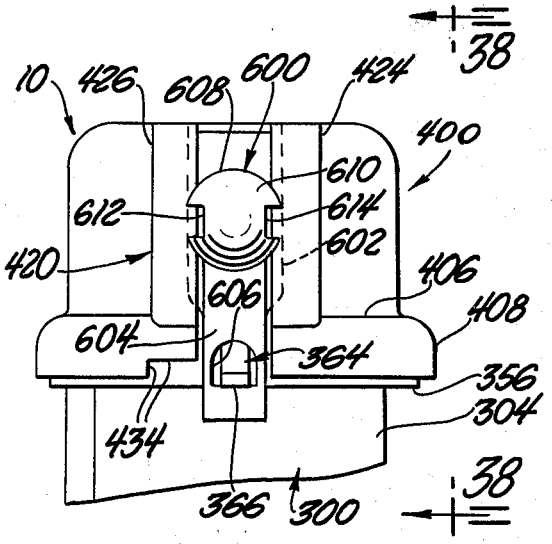
FIG. 37 is a view, similar to a fragmentary portion of FIG. 35, illustrating different method and apparatus for attaching the assembly to related support structure.
Figure 38:
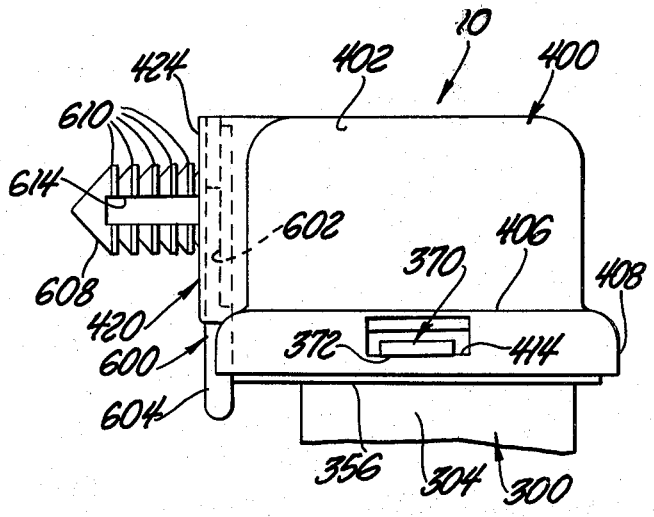
FIG. 38 is a view taken generally on the plane of line 38—38 of FIG. 37 and looking in the direction of the arrows.

FIGS. 37 and 38 illustrate an assembly of means 300 and 400 as may be used in an arrangement where a mounting member is employed to attach the assembly to related support means as by simply pushing the mounting member into a cooperating passage or recess within such support means.

Referring now in greater detail to FIGS. 35 and 36, the base means 300 is illustrated as having the cover means 400 secured thereto with such having been accomplished by pushing cover means 400 downwardly onto base means 300 and in so doing causing portions of cover flange wall 408 to resiliently deflect outwardly as to pass over latch portions 358 and 370 carried by base means 300. When cover means 400 has thusly moved sufficiently relative to base means 300, slot or opening 416 will, generally, receive latch means 358 therein, slot or opening 414 will, generally, receive latch means 370 and the end 418 of wall 410 will be received generally in the groove 306 of base means 300. Once the latch members or portions 358 and 370 are thusly received, the respective surfaces 360 and 372 thereof abutingly engage the respective juxtaposed edge surfaces of latch openings 416 and 414 and thereby prevent the subsequent unintentional removal of cover means 400 from base means 300.

A portion of an associated wiring harness is depicted, in phantom line, at 500 as already being operatively connected as with the electrical terminal means carried within the shroud portion 304 of base means 300. As further generally shown in FIG. 35, harness means 500 may comprise a latching arm portion 502 which operatively engages the arm means 378 of base means 300 to thereby secure the harness 500 against accidental disengagement from base means 300 and the electrical contacts carried thereby.

The embodiment of FIGS. 35 and 36 further illustrates an arrangement where electrical grounding of at least certain circuit means within the relay assembly 10 is desired to be accomplished through related or associated support structure a portion of which is illustrated at 504. In furtherance thereof, electrical lead (such as a wire, for example) means 506 is placed as to be generally in the groove or recess means 350 (FIG. 29) of base means 300, operatively electrically connected to the related certain circuit means carried by the base means 300 and as to extend through the cut-out or clearance portion 418 (FIGS. 32 and 33) and groove means 350 beyond the outer surface of flange wall 408.

A related electrically conductive support bracket 508 serves to both secure or attach the assembly 10 to the support means 504 as well as to complete the electrical circuitry as between conductor means 506 and such support means 504.

In the preferred embodiment, bracket 508, which may be comprised of steel, is illustrated as comprising a relatively wide upper (as viewed in FIG. 35) body portion 510 defining oppositely disposed abutment shoulders 512 and 514 with a medially situated downwardly extending shank-like portion 516 terminating as in an integrally formed latching-connecting portion 518.

In assembling the bracket 508 to assembly 10, the shank portion 516 is slid generally between the opposed L-shaped retainer wall means 424 and 426 and, in order to eliminate the interferance to doing this, which the relatively wide latching connecting portion 518 would otherwise provide, such portion 518 is first bent forwardly, as generally depicted in phantom line in FIG. 36, thereby permitting portion 518 to be outside of the L-shaped means 424 and 426 as the shank 516 is slid under and between them.

When bracket 508 is fully seated, the forwardly bent portion 518 is then bent back toward the base means 300 and cover means 400 to its depicted solid-line position or condition of FIG. 36 and in so doing the lower edge surface of a latching aperture 520, formed in portion 518, operatively engages and secures against the lower edge or surface 366 of latching member or means 364 formed on or carried by base means 300 (see also FIGS. 29 and 30). In the process of thereby bending back the portion 518, the conductor 506 is generally trapped by or received within a slot 522 formed in portion 518 thereby completing the electrical circuit as between the conductor means 506 and bracket 508. If desired, the conductor 506 may be soldered (or the like) to bracket portion 518. Of course, the bracket 508 may, in turn, be secured to the support means 504 by any suitable means as, for example, by a screw 524 (FIG. 36).

In the arrangement illustrated in FIGS. 37 and 38 the relay and housing assembly 10 is provided with connecting means which can effectively be pushed into an aperture or the like of an associated support means (as for example 504 of FIGS. 35 and 36) in order to secure assembly 10 to the support means.

More particularly, the connecting or mounting means 600 is illustrated as comprising a slide-like body portion 602, slidably received by opposed L-shaped retainer wall means 424 and 426 (in the same manner as shank portion 516 of FIGS. 35 and 36 was received), carrying a relatively thicker depending extension 604. The extension, in turn, is provided with an aperture or opening 606 (functionally similar to 520 of FIG. 35) which has its lower edge surface in abutting locking engagement with the lower surface 366 of latching member 364. The further downward movement of mounting means 600 is, of course, precluded by the relatively wide slide body portion 602 being in abutment with the closed ends of the L-shaped retainer wall means 424 and 426.

The mounting means 600 is illustrated as further comprising a mounting portion 608 extending generally transversely to and carried by the slide-like body 602. As best seen in FIG. 38 the mounting member 608 preferably comprises a plurality of axially serially situated generally conical segments or portions 610 which may be provided with axially extending recess or relieved portions 612 and 614. Preferably, the entire mounting means 600 is integrally molded from a plastic material with limited resilience. When the mounting means 600 is attached to the assembly 10, all that needs to be done to secure the assembly 10 to related or associated support structure is to insert the mounting member 608 into a cooperating opening which would cause a partial radial inward deflection of the conical portions 610 as they are inserted into such cooperating opening. In the preferred arrangement, the thickness of the associated support structure would be such as to permit at least one of the conical portions 610 to pass totally through the support structure and again assume its free state whereby the outer portions thereof would engage the reverse side of the support structure and mechanically prevent the withdrawal of the mounting member from the opening in the support structure.

It should be apparent that the invention can be practiced in many forms. For example, the relay means may be of the type wherein the associated contact means comprise either: (a) a double pole single throw normally open switch means; (b) a single pole single throw normally open switch means; (c) a single pole single throw normally closed switch means or (d) a single pole double throw switch means.

It has been discovered that miniaturized relay assemblies employing teachings of the invention exhibit performance characteristics far superior to those of the prior art. For example, relay assemblies of the invention have consistently exhibited voltage drops much lower than the prior art; relays of the invention have shown only 1.0 to 2.0 mv. drop per ampere of current through the contact means while the prior art is in the range of 4.0 to 10.0 mv. per ampere. Relay assemblies of the invention have also shown much higher electrical contact pressure as compared to the prior art. For example, relay assemblies of the invention have produced a minimum of 180.0 grams of contact force (when contacts are closed) compared to the prior art which usually produces less than 100.0 grams of contact force. Also, even though the contact force is greater than the prior art structures, the relays of the invention still require substantially less actuating current, to operate the armature, than the prior art relays.

Among other things, in the preferred embodiment of the invention, the thickness of the outer core or frame means 64 is preferably in the order of 0.060 inch which significantly increases the magnetic flex. Further, the axial length of the coil means 68 is made as short as practical which, in turn, enables leg or wall 80 of outer core or frame 64 to also be made as short as practical thereby increasing the efficiency of the flux and resulting in a corresponding increase in contact closure force.

Also, in the preferred embodiment, the armature body 114 is provided with apex-like thrust-like surfaces 140 and 142 which, even though serving to limit the lateral movement of armature body 114 with respect to frame wall 80, present a very small bearing surface as against surfaces 104 and 106 of frame wall 80 resulting in a significant diminution of frictional forces therebetween. Still further, in the preferred embodiment, leg portion 146 of the contact leaf 78 is ultrasonically welded to leg or wall 80 of outer core or frame means 64. It has been discovered that such is possible even though the metals are dissimilar and that as a consequence thereof a significant reduction in the voltage drop, in the operating circuit, not actuating circuit, is achieved. Also, as generally depicted in at least FIGS. 6, 7, 8, 19, 20, 21, 22 and 23, relatively large bus-bar type terminals 186 and 188 are provided in the preferred embodiment and, as previously stated, the bar or terminal means 186 and 188 serve to absorb most of any and all vibrations, instead of having the coil leads 198 and 200 directly absorb them, and thereby prevent work lardening of such coil leads (due to induced vibrations as in prior art structures) and the possible breakage thereof.

Although only a preferred embodiment and selected alternate embodiments and modifications of the invention have been disclosed and described, it is apparent that other embodiments and modifications of the invention are possible within the scope of the appended claims.

What is claimed is:

1. A relay assembly, comprising bobbin means, said bobbin means comprising a generally tubular body carrying spaced generally transversely extending bobbin walls, coil means situated generally about said tubular body and contained between said spaced bobbin walls, said coil means being adapted to at times be electrically energized, said coil means comprising wire means having first and second end portions, first and second terminal means for connection to associated circuit means, and intermediate first and second connection means, said first intermediate connection means being effective to electrically interconnect said first end portion to said first terminal means and said second intermediate connection means being effective to electrically interconnect said second end portion to said second terminal means, said first intermediate connection means comprising a first electrically conductive connecting member solid in transverse cross-section and substantially larger in transverse cross-section than said wire means and exhibiting a substantially greater resistance to bending than said wire means, said second intermediate connection means comprising a second electrically conductive connecting member solid in transverse cross-section and substantially larger in transverse cross-section than said wire means and exhibiting a substantially greater resistance to bending than said wire means, said first electrically conductive connecting member generally at the area of electrical connection with said first end portion being bent generally toward said coil means, and said second electrically conductive connecting member generally at the area of electrical connection with said second end portion being bent generally toward said coil means, a first relatively enlarged portion formed integrally with one of said spaced bobbin walls and extending generally transversely of said one of said spaced bobbin walls, said first electrically conductive connecting member being carried directly by and extending through said first relatively enlarged portion integrally formed with said one of said spaced bobbin walls, a second relatively enlarged portion formed integrally with an other of said spaced bobbin walls and extending generally transversely of said other of said spaced bobbin walls, said second electrically conductive connecting member being carried directly by and extending through said second relatively enlarged portion integrally formed with said other of said spaced bobbin walls, wherein said first and second electrically conductive connecting members are structurally disconnected from each other except for such structural interconnection as exists through said bobbin walls and bobbin tubular body, and wherein said first and second electrically conductive members are respectively frictionally retained by and in surface-to-surface contact with said first and second relatively enlarged portions formed respectively with said one and said other of said bobbin walls.

2. A relay assembly, comprising bobbin means, said bobbin means comprising a generally tubular body carrying spaced generally transversely extending bobbin wall portions, coil means situated generally about said tubular body and contained between said spaced bobbin wall portions, said coil means being adapted to at times be electrically energized, said coil means comprising wire means having first and second end portions, first and second terminal means for connection to associated circuit means, intermediate first and second connection means, said first intermediate connection means being effective to electrically interconnect said first end portion to said first terminal means and said second intermediate connection means being effective to electrically interconnect said second end portion to said second terminal means, said first intermediate connection means comprising a first electrically conductive connecting member solid in transverse cross-section and substantially larger in transverse cross-section than said wire means and exhibiting a substantially greater resistance to bending than said wire means, said second intermediate connection means comprising a second electrically conductive connecting member solid in transverse cross-section and substantially larger in transverse cross-section than said wire means and exhibiting a substantially greater resistance to bending than said wire means, said first electrically conductive connecting member being generally at the area of electrical connection with said first end portion being bent generally toward said coil means, and said second electrically conductive connecting member generally at the area of electrical connection with said second end portion being bent generally toward said coil means, said first electrically conductive connecting member being carried by one of said spaced bobbin wall portions, said second electrically conductive connecting member being carried by an other of said spaced bobbin wall portions, wherein said first and second electrically conductive connecting members are structurally disconnected from each other except for such structural interconnecting as exists through said bobbin wall portions and bobbin tubular body, and further comprising first core means situated generally externally of said coil means, second core means situated generally internally of said coil means and operatively interconnecting said coil means to said first core means, said first core means comprising first and second core body portions, said first core body portion being situated generally at a first axial end of said coil means generally transversely thereof, said second core body portion being situated generally along a side of said coil means as to be generally parallel to the axis of said coil means, armature means operatively carried by said second core body portion and situated as to be at a second axial end of said coil means generally transversely thereof and normally spaced therefrom, first and second bearing-like surfaces respectively formed on said second core body portion and said armature means as to be juxtaposed to each other, one of said first and second bearing-like surfaces being formed as to present a projecting bearing of very little effective engaging area compared to the area of the other of said first and second bearing-like surfaces, third and fourth bearing-like surfaces respectively formed on said second core body portion and said armature means as to be juxtaposed to each other, one of said third and fourth bearing-like surfaces being formed as to present a projecting bearing of very little effective engaging area compared to the area of the other of said third and fourth bearing-like surfaces, said first and second bearing-like surfaces being disposed at generally one side of said armature means, and said third and fourth bearing-like surfaces being disposed at generally a second side of said armature means opposite to said one side whereby said armature means is effectively contained by said first and second bearing-like surfaces at said one side and said third and fourth bearing-like surfaces at said second side.

3. A relay assembly according to claim 2 wherein said other of said first and second bearing-like surfaces comprises a generally flat area, and wherein said one of said first and second bearing-like surfaces is of a generally V-like configuration with the apex portion of said V-like configuration being juxtaposed to said generally flat area.

4. A relay assembly according to claim 2 wherein said other of said third and fourth bearing-like surfaces comprises a generally flat area, and wherein said one of said third and fourth bearing-like surfaces is of a generally V-like configuration with the apex portion of said V-like configuration being juxtaposed to said generally flat area.

5. A relay assembly according to claim 2 wherein said other of said first and second bearing-like surfaces comprises a first generally flat area, wherein said one of said first and second bearing-like surfaces comprises a first generally V-like configuration with the apex portion thereof being juxtaposed to said first generally flat area, wherein said other of said third and fourth bearing-like surfaces comprises a second generally flat area, wherein said one of said third and fourth bearing-like surfaces comprises a second generally V-like configuration with the apex portion thereof being juxtaposed to said second generally flat area.

6. A relay assembly, comprising base means, said base means comprising dielectric plastic material, said base means further comprising oppositely disposed first and second surface means, first terminal means extending through said base means and having a first relatively rigid connectible terminal portion extending away from said second surface means and a second relatively rigid terminal portion generally juxtaposed to said first surface means, second terminal means extending through said base means and having a third relatively rigid connectible terminal portion extending away from said second surface means and a fourth relatively rigid terminal portion generally juxtaposed to said first surface means, bobbin means, said bobbin means comprising a generally tubular body portion and first and second flangelike bobbin wall portions carried by said tubular body, said first and second bobbin wall portions being generally transverse to said tubular body portion and extending generally radially outwardly thereof, said first and second bobbin wall portions being spaced from each other generally axially of said tubular body portion, coil means comprising electrically conductive coil wire carried by said bobbin means as to be situated generally about said bobbin tubular body portion and axially between said first and second bobbin wall portions, said electrically conductive coil wire comprising first and second coil wire ends, first core means fixedly secured to said base means at said first surface means, said first core means comprising a generally L-shaped configuration and having at least first and second leg portions, leg-like support means carried by said first core means, said leg-like support means being received by said base means as to thereby secure said first core means to said base means as to have both of said first and second leg portions of said first core means generally juxtaposed to said first surface means, second core means extending generally through said bobbin tubular body and fixedly secured to said first leg portion of said first core means, said second core means serving to operatively secure said first bobbin wall portion against said first leg portion to thereby cause said second core means and said second leg portion to be generally parallel to each other and to the axis of said coil means, said first bobbin wall portion comprising an integrally formed enlarged first wall section extending generally transversely to said first bobbin wall portion, said second bobbin wall portion comprising an integrally formed enlarged second wall section extending generally transversely thereof, first electrically conductive intermediate connecting means, second electrically conductive intermediate connecting means, said first intermediate connecting means comprising a cross-sectionally solid first connector substantially greater in cross-sectional area than said coil wire, said second intermediate connecting means comprising a cross-sectionally solid second connector substantially greater in cross-sectional area than said coil wire, said first solid connector being press-fitted through said first enlarged wall section as to have a first portion of said first solid connector extending through a first end of said first enlarged wall section and disposed generally between said first and second bobbin wall portions and as to have a second portion of said first solid connector extending through a second end of said first enlarged wall section opposite to said first end of said first enlarged wall section, said first portion of said first solid connector being electrically connected to said first coil wire end and being bent generally toward said coil means as to thereby eliminate tension stresses in said coil wire leading from said first portion of said first solid connector and to said coil means, said second solid connector being press-fitted through said second enlarged wall section as to have a first portion of said second solid connector extending through a first end of said second enlarged wall section and disposed generally between said first and second bobbin wall portions and as to have a second portion of said second solid connector extending through a second end of said second enlarged wall section opposite to said first end of said second enlarged wall section, said first portion of said second solid connector being electrically connected to said second coil wire end and being bent generally toward said coil as to thereby eliminate tension stresses in said coil wire leading from said first portion of said second solid connector and to said coil means, locating type first recess means formed in said second relatively rigid terminal portion, said second portion of said first solid connector being received by said first recess means and fixedly electrically connected to said second relatively rigid terminal portion, locating type second recess means formed in said fourth relatively rigid terminal portion, said second portion of said second solid connector being received by said second recess means and fixedly electrically connected to said fourth relatively rigid terminal portion, third terminal means extending through said base means and having a fifth relatively rigid connectible terminal portion extending away from said second surface means and a sixth relatively rigid terminal portion generally at said first surface means and electrically connected to said first core means, plate-like electrically conductive spring means, said spring means comprising a first generally flat body portion and a second generally flat body portion, said first and second generally flat body portions being operatively interconnected by an intermediate bowed portion integrally formed with both of said first and second generally flat body portions, said first generally flat body portion being sonically welded to said second leg portion of said first core means as to thereby cause said second generally flat body portion to extend generally transversely of said second core means and be normally spaced from said second bobbin wall portion, an armature member situated generally between said second generally flat body portion and said second core means, first and second bearing-like surfaces respectively formed on said second leg of said first core means and said armature member as to be juxtaposed to each other, one of said first and second bearing-like surfaces being formed as to present a projecting bearing of very little effective engaging area compared to the area of the other of said first and second bearing-like surfaces, third and fourth bearing-like surfaces respectively formed on said second leg of said first core means and said armature member as to be juxtaposed to each other, one of said third and fourth bearing-like surfaces being formed as to present a projecting bearing of very little effective engaging area compared to the area of the other of said third and fourth bearing-like surfaces, said armature member being fixedly secured to said second generally flat body portion for movement in unison therewith, fixed electrical contact means, and fourth terminal means extending away from said second surface means and electrically connected to said fixed electrical contact means, said coil means when electrically energized being effective to cause said armature member and said second generally flat body portion to move toward said second core means and cause said second generally flat body portion to move relative to said fixed electrical contact means.

7. A relay assembly, comprising base means, said base means comprising dielectric plastic material, said base means further comprising oppositely disposed first and second surface means, first terminal means extending through said base means and having a first relatively rigid connectible terminal portion extending away from said second surface means and a second relatively rigid terminal portion generally juxtaposed to said first surface means, second terminal means extending through said base means and having a third relatively rigid connectible terminal portion extending away from said second surface means and a fourth relatively rigid terminal portion generally juxtaposed to said first surface means, bobbin means, said bobbin means comprising a generally tubular body portion and first and second flangelike bobbin wall portions carried by said tubular body, said first and second bobbin wall portions being generally transverse to said tubular body portion and extending generally radially outwardly thereof, said first and second bobbin wall portions being spaced from each other generally axially of said tubular body portion, coil means comprising electrically conductive coil wire carried by said bobbin means as to be situated generally about said bobbin tubular body portion and axially between said first and second bobbin wall portions, said electrically conductive coil wire comprising first and second coil wire ends, first core means fixedly secured to said base means at said first surface means, said first core means comprising a generally L-shaped configuration and having at least first and second leg portions, leg-like support means carried by said first core means, said leg-like support means being received by said base means as to thereby secure said first core means to said base means as to have both of said first and second leg portions of said first core means generally juxtaposed to said first surface means, second core means extending generally through said bobbin tubular body and fixedly secured to said first leg portion of said first core means, said second core means serving to operatively secure said first bobbin wall portion against said first leg portion to thereby cause said second core means and said second leg portion to be generally parallel to each other and to the axis of said coil means, said first bobbin wall portion comprising an integrally formed enlarged first wall section extending generally transversely to said first bobbin wall portion, said second bobbin wall portion comprising an integrally formed enlarged second wall section extending generally transversely thereof, first electrically conductive intermediate connecting means, second electrically conductive intermediate connecting means, said first intermediate connecting means comprising a cross-sectionally solid first connector substantially greater in cross-sectional area than said coil wire, said second intermediate connecting means comprising a cross-sectionally solid second connector substantially greater in cross-sectional area than said coil wire, said first solid connector being press-fitted through said first enlarged wall section as to have a first portion of said first solid connector extending through a first end of said first enlarged wall section and disposed generally between said first and second bobbin wall portions and as to have a second portion of said first solid connector extending through a second end of said first enlarged wall section opposite to said first end of said first enlarged wall section, said first portion of said first solid connector being electrically connected to said first coil wire end and being bent generally toward said coil means as to thereby eliminate tension stresses in said coil wire leading from said first portion of said first solid connector and to said coil means, said second solid connector being press-fitted through said second enlarged wall section as to have a first portion of said second solid connector extending through a first end of said second enlarged wall section and disposed generally between said first and second bobbin wall portions and as to have a second portion of said second solid connector extending through a second end of said second enlarged wall section opposite to said first end of said second enlarged wall section, said first portion of said second solid connector being electrically connected to said second coil wire end and being bent generally toward said coil as to thereby eliminate tension stresses in said coil wire leading from said first portion of said second solid connector and to said coil means, locating type first recess means formed in said second relatively rigid terminal portion, said second portion of said first solid connector being received by said first recess means and fixedly electrically connected to said second relatively rigid terminal portion, locating type second recess means formed in said fourth relatively rigid terminal portion, said second portion of said second solid connector being received by said second recess means and fixedly electrically connected to said fourth relatively rigid terminal portion, third terminal means extending through said base means and having a fifth relatively rigid connectible terminal portion extending away from said second surface means and a sixth relatively rigid terminal portion generally at said first surface means and electrically connected to said first core means, plate-like electrically conductive spring means, said spring means comprising a first generally flat body portion and a second generally flat body portion, said first and second generally flat body portions being operatively interconnected by an intermediate bowed portion integrally formed with both of said first and second generally flat body portions, said first generally flat body portion being sonically welded to said second leg portion of said first core means as to thereby cause said second generally flat body portion to extend generally transversely of said second core means and be normally spaced from said second bobbin wall portion, an armature member situated generally between said second generally flat body portion and said second core means, first and second bearing-like surfaces respectively formed on said second leg of said first core means and said armature member as to be juxtaposed to each other, one of said first and second bearing-like surfaces being formed as to present a projecting bearing of very little effective engaging area compared to the area of the other of said first and second bearing-like surfaces, third and fourth bearing-like surfaces respectively formed on said second leg of said first core means and said armature member as to be juxtaposed to each other, one of said third and fourth bearing-like surfaces being formed as to present a projecting bearing of very little effective engaging area compared to the area of other of said third and fourth bearing-like surfaces, said armature member being fixedly secured to said second generally flat body portion for movement in unison therewith, and fixed electrical contact means, said coil means when electrically energized being effective to cause said armature member and said second generally flat body portion to move toward said second core means and cause said second generally flat body portion to move relative to said fixed electrical contact means.

8. A relay assembly, comprising base means, said base means comprising dielectric plastic material, said base means further comprising oppositely disposed first and second surface means, first terminal means extending through said base means and having a first relatively rigid connectible terminal portion extending away from said second surface means and a second relatively rigid terminal portion generally juxtaposed to said first surface means, second terminal means extending through said base means and having a third relatively rigid connectible terminal portion extending away from said second surface means and a fourth relatively rigid terminal portion generally juxtaposed to said first surface means, bobbin means, said bobbin means comprising a generally tubular body portion and first and second flange-like bobbin wall portions carried by said tubular body, said first and second bobbin wall portions being generally transverse to said tubular body portion and extending generally radially outwardly thereof, said first and second bobbin wall portions being spaced from each other generally axially of said tubular body portion, coil means comprising electrically conductive coil wire carried by said bobbin means as to be situated generally about said bobbin tubular body portion and axially between said first and second bobbin wall portions, said electrically conductive coil wire comprising first and second coil wire ends, first core means fixedly secured to said base means at said first surface means, said first core means comprising a generally L-shaped configuration and having at least first and second leg portions, leg-like support means carried by said first core means, said leg-like support means being received by said base means as to thereby secure said first core means to said base means as to have both of said first and second leg portions of said first core means generally juxtaposed to said first surface means, second core means extending generally through said bobbin tubular body and fixedly secured to said first leg portion of said first core means, said second core means serving to operatively secure said first bobbin wall portion against said first leg portion to thereby cause said second core means and said second leg portion to be generally parallel to each other and to the axis of said coil means, said first bobbin wall portion comprising an integrally formed enlarged first wall section extending generally transversely to said first bobbin wall portion, said second bobbin wall portion comprising an integrally formed enlarged second wall section extending generally transversely thereof, first electrically conductive intermediate connecting means, second electrically conductive intermediate connecting means, said first intermediate connecting means comprising a cross-sectionally solid first connector substantially greater in cross-sectional area than said coil wire, said second intermediate connecting means comprising a cross-sectionally solid second connector substantially greater in cross-sectional area than said coil wire, said first solid connector being press-fitted through said first enlarged wall section as to have a first portion of said first solid connector extending through a first end of said first enlarged wall section and disposed generally between said first and second bobbin wall portions and as to have a second portion of said first solid connector extending through a second end of said first enlarged wall section opposite to said first end of said first enlarged wall section, said first portion of said first solid connector being electrically connected to said first coil wire end and being bent generally toward said coil means as to thereby eliminate tension stresses in said coil wire leading from said first portion of said first solid connector and to said coil means, said second solid connector being press-fitted through said second enlarged wall section as to have a first portion of said second solid connector extending through a first end of said second enlarged wall section and disposed generally between said first and second bobbin wall portions and as to have a second portion of said second solid connector extending through a second end of said second enlarged wall section opposite to said first end of said second enlarged wall section, said first portion of said second solid connector being electrically connected to said second coil wire end and being bent generally toward said coil as to thereby eliminate tension stresses in said coil wire leading from said first portion of said second solid connector and to said coil means, locating type first recess means formed in said second relatively rigid terminal portion, said second portion of said first solid connector being received by said first recess means and fixedly electrically connected to said second relatively rigid terminal portion, locating type second recess means formed in said fourth relatively rigid terminal portion, said second portion of said second solid connector being received by said second recess means and fixedly electrically connected to said fourth relatively rigid terminal portion, third terminal means extending through said base means and having a fifth relatively rigid connectible terminal portion extending away from said second surface means and a sixth relatively rigid terminal portion generally at said first surface means and electrically connected to said first core means, plate-like electrically conductive spring means, said spring means comprising a first generally flat body portion and a second generally flat body portion, said first and second generally flat body portions being operatively interconnected by an intermediate bowed portion integrally formed with both of said first and second generally flat body portions, said first generally flat body portion being operatively secured to said second leg portion of said first core means as to thereby cause said second generally flat body portion to extend generally transversely of said second core means and be normally spaced from said second bobbin wall portion, an armature member situated generally between said second generally flat body portion and said second core means, first and second bearing-like surfaces respectively formed on said second leg of said first core means and said armature member as to be juxtaposed to each other, one of said first and second bearing-like surfaces being formed as to present a projecting bearing of very little effective engaging area compared to the area of the other of said first and second bearing-like surfaces, third and fourth bearing-like surfaces respectively formed on said second leg of said first core means and said armature member as to be juxtaposed to each other, one of said third and fourth bearing-like surfaces being formed as to present a projecting bearing of very little effective engaging area compared to the area of the other of said third and fourth bearing-like surfaces, said armature member being fixedly secured to said second generally flat body portion for movement in unison therewith, and fixed electrical contact means, said coil means when electrically energized being effective to cause said armature member and said second generally flat body portion to move toward said second core means and cause said second generally flat body portion to move relative to said fixed electrical contact means.

9. A relay assembly, comprising base means, said base means comprising dielectric plastic material, said base means further comprising oppositely disposed first and second surface means, first terminal means extending through said base means and having a first relatively rigid connectible terminal portion extending away from said second surface means and a second relatively rigid terminal portion generally juxtaposed to said first surface means, second terminal means extending through said base means and having a third relatively rigid connectible terminal portion extending away from said second surface means and a fourth relatively rigid terminal portion generally juxtaposed to said first surface means, bobbin means, said bobbin means comprising a generally tubular body portion and first and second flange-like bobbin wall portions carried by said tubular body, said first and second bobbin wall portions being generally transverse to said tubular body portion and extending generally radially outwardly thereof, said first and second bobbin wall portions being spaced from each other generally axially of said tubular body portion, coil means comprising electrically conductive coil wire carried by said bobbin means as to be situated generally about said bobbin tubular body portion and axially between said first and second bobbin wall portions, said electrically conductive coil wire comprising first and second coil wire ends, first core means fixedly secured to said base means at said first surface means, said first core means comprising a generally L-shaped configuration and having at least first and second leg portions, leg-like support means carried by said first core means, said leg-like support means being received by said base means as to thereby secure said first core means to said base means as to have both of said first and second leg portions of said first core means generally juxtaposed to said first surface means, second core means extending generally through said bobbin tubular body and fixedly secured to said first leg portion of said first core means, said second core means serving to operatively secure said first bobbin wall portion against said first leg portion to thereby cause said second core means and said second leg portion to be generally parallel to each other and to the axis of said coil means, said first bobbin wall portion comprising an integrally formed enlarged first wall section extending generally transversely to said first bobbin wall portion, said second bobbin wall portion comprising an integrally formed enlarged second wall section extending generally transversely thereof, first electrically conductive intermediate connecting means, second electrically conductive intermediate connecting means, said first intermediate connecting means comprising a cross-sectionally solid first connector substantially greater in cross-sectional area than said coil wire, said second intermediate connecting means comprising a cross-sectionally solid second connector substantially greater in cross-sectional area than said coil wire, said first solid connector being press-fitted through said first enlarged wall section as to have a first portion of said first solid connector extending through a first end of said first enlarged wall section and disposed generally between said first and second bobbin wall portions and as to have a second portion of said first solid connector extending through a second end of said first enlarged wall section opposite to said first end of said first enlarged wall section, said first portion of said first solid connector being electrically connected to said first coil wire end and being bent generally toward said coil means as to thereby eliminate tension stresses in said coil wire leading from said first portion of said first solid connector and to said coil means, said second solid connector being press-fitted through said second enlarged wall section as to have a first portion of said second solid connector extending through a first end of said second enlarged wall section and disposed generally between said first and second bobbin wall portions and as to have a second portion of said second solid connector extending through a second end of said second enlarged wall section opposite to said first end of said second enlarged wall section, said first portion of said second solid connector being electrically connected to said second coil wire end and being bent generally toward said coil as to thereby eliminate tension stresses in said coil wire leading from said first portion of said second solid connector and to said coil means, locating type first recess means formed in said second relatively rigid terminal portion, said second portion of said first solid connector being received by said first recess means and fixedly electrically connected to said second relatively rigid terminal portion, locating type second recess means formed in said fourth relatively rigid terminal portion, said second portion of said second solid connector being received by said second recess means and fixedly electrically connected to said fourth relatively rigid terminal portion, third terminal means extending through said base means and having a fifth relatively rigid connectible terminal portion extending away from said second surface means and a sixth relatively rigid terminal portion generally at said first surface means and electrically connected to said first core means, plate-like electrically conductive spring means, said spring means comprising a first generally flat body portion and a second generally flat body portion, said first and second generally flat body portions being operatively interconnected by an intermediate bowed portion integrally formed with both of said first and second generally flat body portions, said first generally flat body portion being operatively secured to said second leg portion of said first core means as to thereby cause said second generally flat body portion to extend generally transversely of said second core means and be normally spaced from said second bobbin wall portion, an armature member situated generally between said second generally flat body portion and said second core means, said armature member being fixedly secured to said second generally flat body portion for movement in unison therewith, and fixed electrical contact means, said coil means when electrically energized being effective to cause said armature member and said second generally flat body portion to move toward said second core means and cause said second generally flat body portion to move relatively to said fixed electrical contact means.

10. A relay assembly, comprising base means, said base means comprising dielectric plastic material, said base means further comprising oppositely disposed first and second surface means, first terminal means extending through said base means and having a first relatively rigid connectible terminal portion extending away from said second surface means and a second relatively rigid terminal portion generally juxtaposed to said first surface means, second terminal means extending through said base means and having a third relatively rigid connectible terminal portion extending away from said second surface means and a fourth relatively rigid terminal portion generally juxtaposed to said first surface means, bobbin means, said bobbin means comprising a generally tubular body portion and first and second flange-like bobbin wall portions carried by said tubular body, said first and second bobbin wall portions being generally transverse to said tubular body portion and extending generally radially outwardly thereof, said first and second bobbin wall portions being spaced from each other generally axially of said tubular body portion, coil means comprising electrically conductive coil wire carried by said bobbin means as to be situated generally about said bobbin tubular body portion and axially between said first and second bobbin wall portions, said electrically conductive coil wire comprising first and second coil wire ends, first core means fixedly secured to said base means at said first surface means, said first core means comprising a generally L-shaped configuration and having at least first and second leg portions, leg-like support means carried by said first core means, said leg-like support means being received by said base means as to thereby secure said first core means to said base means as to have both of said first and second leg portions of said first core means, generally juxtaposed to said first surface means, second core means extending generally through said bobbin tubular body and fixedly secured to said first leg portion of said first core means, said second core means serving to operatively secure said first bobbin wall portion against said first leg portion to thereby cause said second core means and said second leg portion to be generally parallel to each other and to the axis of said coil means, said first bobbin wall portion comprising an integrally formed enlarged first wall section extending generally transversely to said first bobbin wall portion, said second bobbin wall portion comprising an integrally formed enlarged second wall section extending generally transversely thereof, first electrically conductive intermediate connecting means, second electrically conductive intermediate connecting means, said first intermediate connecting means comprising a cross-sectionally solid first connector substantially greater in cross-sectional area than said coil wire, said second intermediate connecting means comprising a cross-sectionally solid second connector substantially greater in cross-sectional area than said coil wire, said first solid connector being press-fitted through said first enlarged wall section as to have a first portion of said first solid connector extending through a first end of said first enlarged wall section and disposed generally between said first and second bobbin wall portions and as to have a second portion of said first solid connector extending through a second end of said first enlarged wall section opposite to said first end of said first enlarged wall section, said first portion of said first solid connector being electrically connected to said first coil wire end and being bent generally toward said coil means as to thereby eliminate tension stresses in said coil wire leading from said first portion of said first solid connector and to said coil means, said second solid connector being press-fitted through said second enlarged wall section as to have a first portion of said second solid connector extending through a first end of said second enlarged wall section and disposed generally between said first and second bobbin wall portions and as to have a second portion of said second solid connector extending through a second end of said second enlarged wall section opposite to said first end of said second enlarged wall section, said first portion of said second solid connector being electrically connected to said second coil wire end and being bent generally toward said coil as to thereby eliminate tension stresses in said coil wire leading from said first portion of said second solid connector and to said coil means, said second portion of said first solid connector being fixedly electrically connected to said second relatively rigid terminal portion, said second portion of said second solid connector being fixedly electrically connected to said fourth relatively rigid terminal portion, third terminal means extending through said base means and having a fifth relatively rigid connectible terminal portion extending away from said second surface means and a sixth relatively rigid terminal portion generally at said first surface means and electrically connected to said first core means, plate-like electrically conductive spring means, said spring means comprising a first generally flat body portion and a second generally flat body portion, said first and second generally flat body portions being operatively interconnected by an intermediate bowed portion integrally formed with both of said first and second generally flat body portions, said first generally flat body portion being operatively connected to said second leg portion of said first core means as to thereby cause said second generally flat body portion to extend generally transversely of said second core means and be normally spaced from said second bobbin wall portion, an armature member situated generally between said second generally flat body portion and said second core means, said armature member being fixedly secured to said second generally flat body portion for movement in unison therewith, and fixed electrical contact means, said coil means when electrically energized being effective to cause said armature member and said second generally flat body portion to move toward said second core means and cause said second generally flat body portion to move relative to said fixed electrical contact means.

11. A relay assembly according to claim 10 wherein said second relatively rigid terminal portion comprises a first terminal body portion, wherein said fourth relatively rigid terminal portion comprises a second terminal body portion, wherein said first and second terminal body portions are situated as to have said armature member and said first leg portion generally between said first and second terminal body portions, wherein said second portion of said first solid connector in being fixedly electrically connected to said second relatively rigid terminal portion is soldered to said first terminal body portion, and wherein said second portion of said second solid connector in being fixedly electrically connected to said fourth relatively rigid terminal portion is soldered to said second terminal body portion.

12. A relay assembly, comprising base means, said base means comprising dielectric plastic material, said base means further comprising oppositely disposed first and second surface means, first terminal means extending through said base means and having a first relatively rigid connectible terminal portion extending away from said second surface means and a second relatively rigid terminal portion generally juxtaposed to said first surface means, second terminal means extending through said base means and having a third relatively rigid connectible terminal portion extending away from said second surface means and a fourth relatively rigid terminal portion generally juxtaposed to said first surface means, bobbin means, said bobbin means comprising a generally tubular body portion and first and second flange-like bobbin wall portions carried by said tubular body, said first and second bobbin wall portions being generally transverse to said tubular body portion and extending generally radially outwardly thereof, said first and second bobbin wall portions being spaced from each other generally axially of said tubular body portion, coil means comprising electrically conductive coil wire carried by said bobbin means as to be situated generally about said bobbin tubular body portion and axially between said first and second bobbin wall portions, said electrically conductive coil wire comprising first and second coil wire ends, first core means fixedly secured to said base means at said first surface means, said first core means comprising a generally L-shaped configuration and having at least first and second leg portions, said first core means being secured to said base means as to have both of said first and second leg portions generally juxtaposed to said first surface means, second core means extending generally through said bobbin tubular body and fixedly secured to said first leg portion of said first core means, said second core means serving to operatively secure said first bobbin wall portion against said first leg portion to thereby cause said second core means and said second leg portion to be generally parallel to each other and to the axis of said coil means, said first bobbin wall portion comprising an integrally formed enlarged first wall section extending generally transversely to said first bobbin wall portion, said second bobbin wall portion comprising an integrally formed enlarged second wall section extending generally transversely thereof, first electrically conductive intermediate connecting means, second electrically conductive intermediate connecting means, said first intermediate connecting means comprising a cross-sectionally solid first connector substantially greater in cross-sectional area than said coil wire, said second intermediate connecting means comprising a cross-sectionally solid second connector substantially greater in cross-sectional area than said coil wire, said first solid connector being press-fitted through said first enlarged wall section as to have a first portion of said first solid connector extending through a first end of said first enlarged wall section and disposed generally between said first and second bobbin wall portions and as to have a second portion of said first solid connector extending through a second end of said first enlarged wall section opposite to said first end of said first enlarged wall section, said first portion of said first solid connector being electrically connected to said first coil wire end and being bent generally toward said coil means as to thereby eliminate tension stresses in said coil wire leading from said first portion of said first solid connector and to said coil means, said second solid connector being press-fitted through said second enlarged wall section as to have a first portion of said second solid connector extending through a first end of said second enlarged wall section and disposed generally between said first and second bobbin wall portions and as to have a second portion of said second solid connector extending through a second end of said second enlarged wall section opposite to said first end of said second enlarged wall section, said first portion of said second solid connector being electrically connected to said second coil wire end and being bent generally toward said coil as to thereby eliminate tension stresses in said coil wire leading from said first portion of said second solid connector and to said coil means, said second portion of said first solid connector being fixedly electrically connected to said second relatively rigid terminal portion, said second portion of said second solid connector being fixedly electrically connected to said fourth relatively rigid terminal portion, third terminal means extending through said base means and having a fifth relatively rigid connectible terminal portion extending away from said second surface means and a sixth relatively rigid terminal portion generally at said first surface means and electrically connected to said first core means, plate-like electrically conductive spring means, said spring means comprising a first generally flat body portion and a second generally flat body portion, said first and second generally flat body portions being operatively interconnected by an intermediate bowed portion integrally formed with both of said first and second generally flat body portions, said first generally flat body portion being operatively connected to said first core means as to thereby cause said second generally flat body portion to extend generally transversely of said second core means and be normally spaced from said second bobbin wall portion, an armature member situated generally between said second generally flat portion and said second core means, said armature member being fixedly secured to said second generally flat body portion for movement in unison therewith, and fixed electrical contact means, said coil means when electrically energized being effective to cause said armature member and said second generally flat body portion to move toward said second core means and cause said second generally flat body portion to move relative to said fixed electrical contact means.

13. A relay assembly according to claim 12 wherein said second relatively rigid terminal portion comprises a first terminal body portion, wherein said fourth relatively rigid terminal portion comprises a second terminal body portion, wherein said first and second terminal body portions are situated as to have said armature member and said first leg portion generally between said first and second terminal body portions, wherein said second portion of said first solid connector in being fixedly electrically connected to said second relatively rigid terminal portion is soldered to said first terminal body portion, and wherein said second portion of said second solid connector in being fixedly electrically connected to said fourth relatively rigid terminal portion is soldered to said second terminal body portion.

14. A relay assembly according to claim 12 and further comprising first locating surface means carried by said second relatively rigid terminal portion, second locating surface means carried by said fourth relatively rigid terminal portion, wherein said second portion of said first solid connector is fixedly electrically connected to said second relatively rigid terminal portion by being operatively held against said first locating surface means, and wherein said second portion of said second solid connector is fixedly electrically connected to said fourth relatively rigid terminal portion by being operatively held against said second locating surface means.

15. A relay assembly according to claim 14 wherein said first locating surface means comprises a first notch-like recess in said second relatively rigid terminal portion, and wherein said second locating surface means comprises a second notch-like recess in said fourth relatively rigid terminal portion.

16. A relay assembly according to claim 14 wherein each of said first and second solid connectors are generally square in transverse cross-section.

17. A relay assembly according to claim 12 wherein said first locating surface means comprises a first V-like notch formed in said second relatively rigid terminal portion, wherein said second locating surface means comprises a second V-like notch formed in said fourth relatively rigid terminal portion, wherein each of said first and second solid connectors are generally square in transverse cross-section, wherein said second portion of said first solid connector is held in said first V-like notch as to have the said transversely cross-sectionally square configuration thereof nested within said first V-like notch, and wherein said second portion of said second solid connector is held in said second V-like notch as to have the said transversely cross-sectionally square configuration thereof nested within said second V-like notch.

18. A relay assembly according to claim 12 wherein each of said first and second solid connectors are generally square in transverse cross-section.

19. A relay assembly, comprising base means, said base means comprising dielectric plastic material, said base means further comprising oppositely disposed first and second surface means, first terminal means extending through said base means and having a first relatively rigid connectible terminal portion extending away from said second surface means and a second relatively rigid terminal portion generally juxtaposed to said first surface means, second terminal means extending through said base means and having a third relatively rigid connectible terminal portion extending away from said second surface means and a fourth relatively rigid terminal portion generally juxtaposed to said first surface means, bobbin means, said bobbin means comprising a generally tubular body portion and first and second flange-like bobbin wall portions carried by said tubular body, said first and second bobbin wall portions being generally transverse to said tubular body portion and extending generally radially outwardly thereof, said first and second bobbin wall portions being spaced from each other generally axially of said tubular body portion, coil means comprising electrically conductive coil wire carried by said bobbin means as to be situated generally about said bobbin tubular body portion and axially between said first and second bobbin wall portions, said electrically conductive coil wire comprising first and second coil wire ends, first core means fixedly secured to said base means at said first surface means, said first core means comprising a generally L-shaped configuration and having at least first and second leg portions, leg-like support means carried by said first core means, said leg-like support means being received by said base means as to thereby secure said first core means to said base means as to have both of said first and second leg portions of said first core means generally juxtaposed to said first surface means, second core means extending generally through said bobbin tubular body and fixedly secured to said first leg portion of said first core means, said second core means serving to operatively secure said first bobbin wall portion against said first leg portion to thereby cause said second core means and said second leg portion to be generally parallel to each other and to the axis of said coil means, said first bobbin wall portion comprising an integrally formed enlarged first wall section extending generally transversely to said first bobbin wall portion, said second bobbin wall portion comprising an integrally formed enlarged second wall section extending generally transversely thereof, first electrically conductive intermediate connecting means, second electrically conductive intermediate connecting means, said first intermediate connecting means comprising a cross-sectionally solid first connector substantially greater in cross-sectional area than said coil wire, said second intermediate connecting means comprising a cross-sectionally solid second connector substantially greater in cross-sectional area than said coil wire, said first solid connector being press-fitted through said first enlarged wall section as to have a first portion of said first solid connector extending through a first end of said first enlarged wall section and disposed generally between said first and second bobbin wall portions and as to have a second portion of said first solid connector extending through a second end of said first enlarged wall section opposite to said first end of said first enlarged wall section, said first portion of said first solid connector being electrically connected to said first coil wire end and being bent generally toward said coil means as to thereby eliminate tension stresses in said coil wire leading from said first portion of said first solid connector and to said coil means, said second solid connector being press-fitted through said second enlarged wall section as to have a first portion of said second solid connector extending through a first end of said second enlarged wall section and disposed generally between said first and second bobbin wall portions and as to have a second portion of said second solid connector extending through a second end of said second enlarged wall section opposite to said first end of said second enlarged wall section, said first portion of said second solid connector being electrically connected to said second coil wire end and being bent generally toward said coil as to thereby eliminate tension stresses in said coil wire leading from said first portion of said second solid connector and to said coil means, said second portion of said first solid connector being fixedly electrically connected to said second relatively rigid terminal portion, said second portion of said second solid connector being fixedly electrically connected to said fourth relatively rigid terminal portion, third terminal means extending through said base means and having a fifth relatively rigid connectible terminal portion extending away from said second surface means and a sixth relatively rigid terminal portion generally at said first surface means and electrically connected to said first core means, plate-like electrically conductive spring means, said spring means comprising a first generally flat body portion and a second generally flat body portion, said first and second generally flat body portions being operatively interconnected by an intermediate bowed portion integrally formed with both of said first and second generally flat body portions, said first generally flat body portion being sonically welded to said second leg portion of said first core means as to thereby cause said second generally flat body portion to extend generally transversely of said second core means and be normally spaced from said second bobbin wall portion, an armature member situated generally between said second generally flat body portion and said second core means, first and second bearing-like surfaces respectively formed on said second leg of said first core means and said armature member as to be juxtaposed to each other, one of said first and second bearing-like surfaces being formed as to present a projecting bearing of very little effective engaging area compared to the area of the other of said first and second bearing-like surfaces, third and fourth bearing-like surfaces respectively formed on said second leg of said first core means and said armature member as to be juxtaposed to each other, one of said third and fourth bearing-like surfaces being formed as to present a projecting bearing of very little effective engaging area compared to the area of the other of said third and fourth bearing-like surfaces, said armature member being fixedly secured to said second generally flat body portion for movement in unison therewith, fixed electrical contact means, and fourth terminal means extending away from said second surface means and electrically connected to said fixed electrical contact means, said coil means when electrically energized being effective to cause said armature member and said second generally flat body portion to move toward said second core means and cause said second generally flat body portion to move relative to said fixed electrical contact means.

20. A relay assembly according to claim 19 wherein said second relatively rigid terminal portion comprises a first terminal body portion, wherein said fourth relatively rigid terminal portion comprises a second terminal body portion, wherein said first and second terminal body portions are situated as to have said armature member and said first leg portion generally between said first and second terminal body portions, wherein said second portion of said first solid connector is being fixedly electrically connected to said second relatively rigid terminal portion is soldered to said first terminal body portion, and wherein said second portion of said second solid connector in being fixedly electrically connected to said fourth relatively rigid terminal portion is soldered to said second terminal body portion.

21. A relay assembly, comprising base means, said base means comprising dielectric plastic material, said base means further comprising oppositely disposed first and second surface means, first terminal means extending through said base means and having a first relatively rigid connectible terminal portion extending away from said second surface means and a second relatively rigid terminal portion generally juxtaposed to said first surface means, second terminal means extending through said base means and having a third relatively rigid connectible terminal portion extending away from said second surface means and a fourth relatively rigid terminal portion generally juxtaposed to said first surface means, bobbin means, said bobbin means comprising a generally tubular body portion and first and second flange-like bobbin wall portions carried by said tubular body, said first and second bobbin wall portions being generally transverse to said tubular body portion and extending generally radially outwardly thereof, said first and second bobbin wall portions being spaced from each other generally axially of said tubular body portion, coil means comprising electrically conductive coil wire carried by said bobbin means as to be situated generally about said bobbin tubular body portion and axially between said first and second bobbin wall portions, said electrically conductive coil wire comprising first and second coil wire ends, first core means fixedly secured to said base means at said first surface means, said first core means comprising a generally L-shaped configuration and having at least first and second leg portions, leg-like support means carried by said first core means, said leg-like support means being received by said base means as to thereby secure said first core means to said base means as to have both of said first and second leg portions of said first core means generally juxtaposed to said first surface means, second core means extending generally through said bobbin tubular body and fixedly secured to said first leg portion of said first core means, said second core means serving to operatively secure said first bobbin wall portion against said first leg portion to thereby cause said second core means and said second leg portion to be generally parallel to each other and to the axis of said coil means, said first bobbin wall portion comprising an integrally formed enlarged first wall section extending generally transversely to said first bobbin wall portion, said second bobbin wall portion comprising an integrally formed enlarged second wall section extending generally transversely thereof, first electrically conductive intermediate connecting means, second electrically conductive intermediate connecting means, said first intermediate connecting means comprising a cross-sectionally solid first connector substantially greater in cross-sectional area than said coil wire, said second intermediate connecting means comprising a cross-sectionally solid second connector substantially greater in cross-sectional area than said coil wire, said first solid connector being press-fitted through said first enlarged wall section as to have a first portion of said first solid connector extending through a first end of said first enlarged wall section and disposed generally between said first and second bobbin wall portions and as to have a second portion of said first solid connector extending through a second end of said first enlarged wall section opposite to said first end of said first enlarged wall section, said first portion of said first solid connector being electrically connected to said first coil wire end and being bent generally toward said coil means as to thereby eliminate tension stresses in said coil wire leading from said first portion of said first solid connector and to said coil means, said second solid connector being press-fitted through said second enlarged wall section as to have a first portion of said second solid connector extending through a first end of said second enlarged wall section and disposed generally between said first and second bobbin wall portions and as to have a second portion of said second solid connector extending through a second end of said second enlarged wall section opposite to said first end of said second enlarged wall section, said first portion of said second solid connector being electrically connected to said second coil wire end being bent generally toward said coil as to thereby eliminate tension stresses in said coil wire leading from said first portion of said second solid connector and to said coil means, said second portion of said first solid connector being fixedly electrically connected to said second relatively rigid terminal portion, said second portion of said second solid connector being fixedly electrically connected to said fourth relatively rigid terminal portion, third terminal means extending through said base means and having a fifth relatively rigid connectible terminal portion extending away from said second surface means and a sixth relatively rigid terminal portion generally at said first surface means and electrically connected to said first core means, plate-like electrically conductive spring means, said spring means comprising a first generally flat body portion and a second generally flat body portion, said first and second generally flat body portions being operatively interconnected by an intermediate bowed portion integrally formed with both of said first and second generally flat body portions, said first generally flat body portions being sonically welded to said second leg portion of said first core means as to thereby cause said second generally flat body portion to extend generally transversely of said second core means and be normally spaced from said second bobbin wall portion, an armature member situated generally between said second generally flat body portion and said second core means, first and second bearing-like surfaces respectively formed on said second leg of said first core means and said armature member as to be juxtaposed to each other, one of said first and second bearing-like surfaces being formed as to present a projecting bearing of very little effective engaging area compared to the area of the other of said first and second bearing-like surfaces, third and fourth bearing-like surfaces respectively formed on said second leg of said first core means and said armature member as to be juxtaposed to each other, one of said third and fourth bearing-like surfaces being formed as to present a projecting bearing of very little effective engaging area compared to the area of the other of said third and fourth bearing-like surfaces, said armature member being fixedly secured to said second generally flat body portion for movement in unison therewith, and fixed electrical contact means, said coil means when electrically energized being effective to cause said armature member and said second generally flat body portion to move toward said second core means and cause said second generally flat body portion to move relative to said fixed electrical contact means.

22. A relay assembly according to claim 21 wherein said second relatively rigid terminal portion comprises a flat terminal body portion, wherein said fourth relatively rigid terminal portion comprises a second terminal body portion, wherein said first and second terminal body portions are situated as to have said armature member and said first leg portion generally between said first and second terminal body portions, wherein said second portion of said first solid connector in being fixedly electrically connected to said second relatively rigid terminal portion is soldered to said first terminal body portion, and wherein said second portion of said second solid connector in being fixedly electrically connected to said fourth relatively rigid terminal portion is soldered to said second terminal body portion.

23. A relay assembly, comprising base means, said base means comprising dielectric plastic material, said base means further comprising oppositely disposed first and second surface means, first terminal means extending through said base means and having a first relatively rigid connectible terminal portion extending away from said second surface means and a second relatively rigid terminal portion generally juxtaposed to said first surface means, second terminal means extending through said base means and having a third relatively rigid connectible terminal portion extending away from said second surface means and a fourth relatively rigid terminal portion generally juxtaposed to said first surface means, bobbin means, said bobbin means comprising a generally tubular body portion and first and second flange-like bobbin wall portions carried by said tubular body, said first and second bobbin wall portions being generally transverse to said tubular body portion and extending generally radially outwardly thereof, said first and second bobbin wall portions being spaced from each other generally axially of said tubular body portion, coil means comprising electrically conductive coil wire carried by said bobbin means as to be situated generally about said bobbin tubular body portion and axially between said first and second bobbin wall portions, said electrically conductive coil wire comprising first and second coil wire ends, first core means fixedly secured to said base means at said first surface means, said first core means comprising a generally L-shaped configuration and having at least first and second leg portions, leg-like support means carried by said first core means, said leg-like support means being received by said base means as to thereby secure said first core means to said base means as to have both of said first and second leg portions of said first core means generally juxtaposed to said first surface means, second core means extending generally through said bobbin tubular body and fixedly secured to said first leg portion of said first core means, said second core means serving to operatively secure said first bobbin wall portion against said first leg portion to thereby cause said second core means and said second leg portion to be generally parallel to each other and to the axis of said coil means, said first bobbin wall portion comprising an integrally formed enlarged first wall section extending generally transversely to said first bobbin wall portion, said second bobbin wall portion comprising an integrally formed enlarged second wall section extending generally transversely thereof, first electrically conductive intermediate connecting means, second electrically conductive intermediate connecting means, said first intermediate connecting means comprising a cross-sectionally solid first connector substantially greater in cross-sectional area than said coil wire, said second intermediate connecting means comprising a cross-sectionally solid second connector substantially greater in cross-sectional area than said coil wire, said first solid connector being press-fitted through said first enlarged wall section as to have a first portion of said first solid connector extending through a first end of said first enlarged wall section and disposed generally between said first and second bobbin wall portions and as to have a second portion of said first solid connector extending through a second end of said first enlarged wall section opposite to said first end of said first enlarged wall section, said first portion of said first solid connector being electrically connected to said first coil wire end and being bent generally toward said coil means as to thereby eliminate tension stresses in said coil wire leading from said first portion of said first solid connector and to said coil means, said second solid connector being press-fitted through said second enlarged wall section as to have a first portion of said second solid connector extending through a first end of said second enlarged wall section and disposed generally between said first and second bobbin wall portions and as to have a second portion of said second solid connector extending through a second end of said second enlarged wall section opposite to said first end of said second enlarged wall section, said first portion of said second solid connector being electrically connected to said second coil wire end and being bent generally toward said coil as to thereby eliminate tension stresses in said coil wire leading from said first portion of said second solid connector and to said coil means, said portion of said first solid connector being fixedly electrically connected to said second relatively rigid terminal portion, said second portion of said second solid connector being fixedly electrically connected to said fourth relatively rigid terminal portion, third terminal means extending through said base means and having a fifth relatively rigid connectible terminal portion extending away from said second surface means and a sixth relatively rigid terminal portion generally at said first surface means and electrically connected to said first core means, plate-like electrically conductive spring means, said spring means comprising a first generally flat body portion and a second generally flat body portion, said first and second generally flat body portions being operatively interconnected by an intermediate bowed portion integrally formed with both of said first and second generally flat body portions, said first generally flat body portion being operatively connected to said second leg portion of said first core means as to thereby cause said second generally flat body portion to extend generally transversely of said second core means and be normally spaced from said second bobbin wall portion, an armature member situated generally between said second generally flat body portion and said second core means, first and second bearing-like surfaces respectively formed on said second leg of said first core means and said armature member as to be juxtaposed to each other, one of said first and second bearing-like surfaces being formed as to present a projecting bearing of very little effective engaging area compared to the area of the other of said first and second bearing-like surfaces, third and fourth bearing-like surfaces respectively formed on said second leg of said first core means and said armature member as to be juxtaposed to each other, one of said third and fourth bearing-like surfaces being formed as to present a projecting bearing of very little effective engaging area compared to the area of the other of said third and fourth bearing-like surfaces, said armature member being fixedly secured to said second generally flat body portion for movement in unison therewith, and fixed electrical contact means, said coil means when electrically energized being effective to cause said armature member and said second generally flat body portion to move toward said second core means and cause said second generally flat body portion to move relative to said fixed electrical contact means.

24. A relay assembly according to claim 23 wherein said second relatively rigid terminal portion comprises a first terminal body portion, wherein said fourth relatively rigid terminal portion comprises a second terminal body portion, wherein said first and second terminal body portions are situated as to have said armature member and said first leg portion generally between said first and second terminal body portions, wherein said second portion of said first solid connector in being fixedly electrically connected to said second relatively rigid terminal portion is soldered to said first terminal body portion, and wherein said second portion of said second solid connector in being fixedly electrically connected to said fourth relatively rigid terminal portion is soldered to said second terminal body portion.

25. A relay assembly, comprising base means, said base means comprising dielectric plastic material, said base means further comprising oppositely disposed first and second surface means, first terminal means extending through said base means and having a first relatively rigid connectible terminal portion extending away from said second surface means and a second relatively rigid terminal portion generally juxtaposed to said first surface means, second terminal means extending through said base means and having a third relatively rigid connectible terminal portion extending away from said second surface means and a fourth relatively rigid terminal portion generally juxtaposed to said first surface means, bobbin means, said bobbin means comprising a generally tubular body portion and first and second flange-like bobbin wall portions carried by said tubular body, said first and second bobbin wall portions being generally transverse to said tubular body portion and extending generally radially outwardly thereof, said first and second bobbin wall portions being spaced from each other generally axially of said tubular body portion, coil means comprising electrically conductive coil wire carried by said bobbin means as to be situated generally about said bobbin tubular body portion and axially between said first and second bobbin wall portions, said electrically conductive coil wire comprising first and second coil wire ends, first core means fixedly secured to said base means at said first surface means, said first core means comprising a generally L-shaped configuration and having at least first and second leg portions, said first core means being secured to said base means as to have both of said first and second leg portions generally juxtaposed to said first surface means, second core means extending generally through said bobbin tubular body and fixedly secured to said first leg portion of said first core means, said second core means serving to operatively secure said first bobbin wall portion against said first leg portion to thereby cause said second core means and said second leg portion to be generally parallel to each other and to the axis of said coil means, said first bobbin wall portion comprising an integrally formed enlarged first wall section extending generally transversely to said first bobbin wall portion, said second bobbin wall portion comprising an integrally formed enlarged second wall section extending generally transversely thereof, first electrically conductive intermediate connecting means, second electrically conductive intermediate connecting means, said first intermediate connecting means comprising a cross-sectionally solid first connector substantially greater in cross-sectional area than said coil wire, said second intermediate connecting means comprising a cross-sectionally solid second connector substantially greater in cross-sectional area than said coil wire, said first solid connector being press-fitted through said first enlarged wall section as to have a first portion of said first solid connector extending through a first end of said first enlarged wall section and disposed generally between said first and second bobbin wall portions and as to have a second portion of said first solid connector extending through a second end of said first enlarged wall section opposite to said first end of said first enlarged wall section, said first portion of said first solid connector being electrically connected to said first coil wire end and being bent generally toward said coil means as to thereby eliminate tension stresses in said coil wire leading from said first portion of said first solid connector and to said coil means, said second solid connector being press-fitted through said second enlarged wall section as to have a first portion of said second solid connector extending through a first end of said second enlarged wall section and disposed generally between said first and second bobbin wall portions and as to have a second portion of said second solid connector extending through a second end of said second enlarged wall section opposite to said first end of said second enlarged wall section, said first portion of said second solid connector being electrically connected to said second coil wire end and being bent generally toward said coil as to thereby eliminate tension stresses in said coil wire leading from said first portion of said second solid connector and to said coil means, locating type first recess means formed in said second relatively rigid terminal portion, said second portion of said first solid connector being received by said first recess means and fixedly electrically connected to said second relatively rigid terminal portion, locating type second recess means formed in said fourth relatively rigid terminal portion, said second portion of said second solid connector being received by said second recess means and fixedly electrically connected to said fourth relatively rigid terminal portion, third terminal means extending through said base means and having a fifth relatively rigid connectible terminal portion extending away from said second surface means and a sixth relatively rigid terminal portion generally at said first surface means and electrically connected to said first core means, plate-like electrically conductive spring means, said spring means comprising a first generally flat body portion and a second generally flat body portion, said first and second generally flat body portions being operatively interconnected by an intermediate bowed portion integrally formed with both of said first and second generally flat body portions, said first generally flat body portion being sonically welded to said second leg portion of said first core means as to thereby cause said second generally flat body portion to extend generally transversely of said second core means and be normally spaced from said second bobbin wall portion, an armature member situated generally between said second generally flat body portion and said second core means, first and second bearing-like surfaces respectively formed on said second leg of said first core means and said armature member as to be juxtaposed to each other, one of said first and second bearing-like surfaces being formed as to present a projecting bearing of very little effective engaging area compared to the area of the other of said first and second bearing-like surfaces, third and fourth bearing-like surfaces respectively formed on said second leg of said first core means and said armature member as to be juxtaposed to each other, one of said third and fourth bearing-like surfaces being formed as to present a projecting bearing of very little effective engaging area compared to the area of the other of said third and fourth bearing-like surfaces, said armature member being fixedly secured to said second generally flat body portion for movement in unison therewith, fixed electrical contact means, and fourth terminal means extending away from said second surface means and electrically connected to said fixed electrical contact means, said coil means when electrically energized being effective to cause said armature member and said second generally flat body portion to move toward said second core means and cause said second generally flat body portion to move relative to said fixed electrical contact means.

26. A relay assembly, comprising base means, said base means comprising dielectric plastic material, said base means further comprising oppositely disposed first and second surface means, first terminal means extending through said base means and having a first relatively rigid connectible terminal portion extending away from said second surface means and a second relatively rigid terminal portion generally juxtaposed to said first surface means, second terminal means extending through said base means and having a third relatively rigid connectible terminal portion extending away from said second surface means and a fourth relatively rigid terminal portion generally juxtaposed to said first surface means, bobbin means, said bobbin means comprising a generally tubular body portion and first and second flange-like bobbin wall portions carried by said tubular body, said first and second bobbin wall portions being generally transverse to said tubular body portion and extending generally radially outwardly thereof, said first and second bobbin wall portions being spaced from each other generally axially of said tubular body portion, coil means comprising electrically conductive coil wire carried by said bobbin means as to be situated generally about said bobbin tubular body portion and axially between said first and second bobbin wall portions, said electrically conductive coil wire comprising first and second coil wire ends, first core means fixedly secured to said base means at said first surface means, said first core means comprising a generally L-shaped configuration and having at least first and second leg portions, said first core means being secured to said base means as to have both of said first and second leg portions generally juxtaposed to said first surface means, second core means extending generally through said bobbin tubular body and fixedly secured to said first leg portion of said first core means, said second core means serving to operatively secure said first bobbin wall portion against said first leg portion to thereby cause said second core means and said second leg portion to be generally parallel to each other and to the axis of said coil means, said first bobbin wall portion comprising an integrally formed enlarged first wall section extending generally transversely to said first bobbin wall portion, said second bobbin wall portion comprising an integrally formed enlarged second wall section extending generally transversely thereof, first electrically conductive intermediate connecting means, second electrically conductive intermediate connecting means, said first intermediate connecting means comprising a cross-sectionally solid first connector substantially greater in cross-sectional area than said coil wire, said second intermediate connecting means comprising a cross-sectionally solid second connector substantially greater in cross-sectional area than said coil wire, said first solid connector being press-fitted through said first enlarged wall section as to have a first portion of said first solid connector extending through a first end of said first enlarged wall section and disposed generally between said first and second bobbin wall portions and as to have a second portion of said first solid connector extending through a second end of said first enlarged wall section opposite to said first end of said first enlarged wall section, said first portion of said first solid connector being electrically connected to said first coil wire end and being bent generally toward said coil means as to thereby eliminate tension stresses in said coil wire leading from said first portion of said first solid connector and to said coil means, said second solid connector being press-fitted through said second enlarged wall section as to have a first portion of said second solid connector extending through a first end of said second enlarged wall section and disposed generally between said first and second bobbin wall portions and as to have a second portion of said second solid connector extending through a second end of said second enlarged wall section opposite to said first end of said second enlarged wall section, said first portion of said second solid connector being electrically connected to said second coil wire end and being bent generally toward said coil as to thereby eliminate tension stresses in said coil wire leading from said first portion of said second solid connector and to said coil means, locating type first recess means formed in said second relatively rigid terminal portion, said second portion of said first solid connector being received by said first recess means and fixedly electrically connected to said second relatively rigid terminal portion, locating type second recess means formed in said fourth relatively rigid terminal portion, said second portion of said second solid connector being received by said second recess means and fixedly electrically connected to said fourth relatively rigid terminal portion, third terminal means extending through said base means and having a fifth relatively rigid connectible terminal portion extending away from said second surface means and a sixth relatively rigid terminal portion generally at said first surface means and electrically connected to said first core means, plate-like electrically conductive spring means, said spring means comprising a first generally flat body portion and a second generally flat body portion, said first and second generally flat body portions being operatively interconnected by an intermediate bowed portion integrally formed with both of said first and second generally flat body portions, said first generally flat body portion being sonically welded to said second leg portion of said first core means as to thereby cause said second generally flat body portion to extend generally transversely of said second core means and be normally spaced from said second bobbin wall portion, an armature member situated generally between said second generally flat body portion and said second core means, first and second bearing-like surfaces respectively formed on said second leg of said first core means and said armature member as to be juxtaposed to each other, one of said first and second bearing-like surfaces being formed as to present a projecting bearing of very little effective engaging area compared to the area of the other of said first and second bearing-like surfaces, third and fourth bearing-like surfaces respectively formed on said second leg of said first core means and said armature member as to be juxtaposed to each other, one of said third and fourth bearing-like surfaces being formed as to present a projecting bearing of very little effective engaging area compared to the area of the other of said third and fourth bearing-like surfaces, said armature member being fixedly secured to said second generally flat body portion for movement in unison therewith, and fixed electrical contact means, said coil means when electrically energized being effective to cause said armature member and said second generally flat body portion to move toward said second core means and cause said second generally flat body portion to move relative to said fixed electrical contact means.

27. A relay assembly, comprising base means, said base means comprising dielectric plastic material, said base means further comprising oppositely disposed first and second surface means, first terminal means extending through said base means and having a first relatively rigid connectible terminal portion extending away from said second surface means and a second relatively rigid terminal portion generally juxtaposed to said first surface means, second terminal means extending through said base means and having a third relatively rigid connectible terminal portion extending away from said second surface means and a fourth relatively rigid terminal portion generally juxtaposed to said first surface means, bobbin means, said bobbin means comprising a generally tubular body portion and first and second flange-like bobbin wall portions carried by said tubular body, said first and second bobbin wall portions being generally transverse to said tubular body portion and extending generally radially outwardly thereof, said first and second bobbin wall portions being spaced from each other generally axially of said tubular body portion, coil means comprising electrically conductive coil wire carried by said bobbin means as to be situated generally about said bobbin tubular body portion and axially between said first and second bobbin wall portions, said electrically conductive coil wire comprising first and second coil wire ends, first core means fixedly secured to said base means at said first surface means, said first core means comprising a generally L-shaped configuration and having at least first and second leg portions, said first core means being secured to said base means as to have both of said first and second leg portions generally juxtaposed to said first surface means, second core means extending generally through said bobbin tubular body and fixedly secured to said first leg portion of said first core means, said second core means serving to operatively secure said first bobbin wall portion against said first leg portion to thereby cause said second core means and said second leg portion to be generally parallel to each other and to the axis of said coil means, said first bobbin wall portion comprising an integrally formed enlarged first wall section extending generally transversely to said first bobbin wall portion, said second bobbin wall portion comprising an integrally formed enlarged second wall section extending generally transversely thereof, first electrically conductive intermediate connecting means, second electrically conductive intermediate connecting means, said first intermediate connecting means comprising a cross-sectionally solid first connector substantially greater in cross-sectional area than said coil wire, said second intermediate connecting means comprising a cross-sectionally solid second connector substantially greater in cross-sectional area than said coil wire, said first solid connector being press-fitted through said first enlarged wall section as to have a first portion of said first solid connector extending through a first end of said first enlarged wall section and disposed generally between said first and second bobbin wall portions and as to have a second portion of said first solid connector extending through a second end of said first enlarged wall section opposite to said first end of said first enlarged wall section, said first portion of said first solid connector being electrically connected to said first coil wire end and being bent generally toward said coil means as to thereby eliminate tension stresses in said coil wire leading from said first portion of said first solid connector and to said coil means, said second solid connector being press-fitted through said second enlarged wall section as to have a first portion of said second solid connector extending through a first end of said second enlarged wall section and disposed generally between said first and second bobbin wall portions and as to have a second portion of said second solid connector extending through a second end of said second enlarged wall section opposite to said first end of said second enlarged wall section, said first portion of said second solid connector being electrically connected to said second coil wire end and being bent generally toward said coil as to thereby eliminate tension stresses in said coil wire leading from said first portion of said second solid connector and to said coil means, locating type first recess means formed in said second relatively rigid terminal portion, said second portion of said first solid connector being received by said first recess means and fixedly electrically connected to said second relatively rigid terminal portion, locating type second recess means formed in said fourth relatively rigid terminal portion, said second portion of said second solid connector being received by said second recess means and fixedly electrically connected to said fourth relatively rigid terminal portion, third terminal means extending through said base means and having a fifth relatively rigid connectible terminal portion extending away from said second surface means and a sixth relatively rigid terminal portion generally at said first surface means and electrically connected to said first core means, plate-like electrically conductive spring means, said spring means comprising a first generally flat body portion and a second generally flat body portion, said first and second generally flat body portions being operatively interconnected by an intermediate bowed portion integrally formed with both of said first and second generally flat body portions, said first generally flat body portion being operatively connected to said second leg portion of said first core means as to thereby cause said second generally flat body portion to extend generally transversely of said second core means and be normally spaced from said second bobbin wall portion, an armature member situated generally between said second generally flat body portion and said second core means, first and second bearing-like surfaces respectively formed on said second leg of said first core means and said armature member as to be juxtaposed to each other, one of said first and second bearing-like surfaces being formed as to present a projecting bearing of very little effective engaging area compared to the area of the other of said first and second bearing-like surfaces, third and fourth bearing-like surfaces respectively formed on said second leg of said first core means and said armature member as to be juxtaposed to each other, one of said third and fourth bearing-like surfaces being formed as to present a projecting bearing of very little effective engaging area compared to the area of the other of said third and fourth bearing-like surfaces, said armature member being fixedly secured to said second generally flat body portion for movement in unison therewith, and fixed electrical contact means, said coil means when electrically energized being effective to cause said armature member and said second generally flat body portion to move toward said second core means and cause said second generally flat body portion to move relative to said fixed electrical contact means.

28. A relay assembly, comprising base means, said base means comprising dielectric plastic material, said base means further comprising oppositely disposed first and second surface means, first terminal means extending through said base means and having a first relatively rigid connectible terminal portion extending away from said second surface means and a second relatively rigid terminal portion generally juxtaposed to said first surface means, second terminal means extending through said base means and having a third relatively rigid connectible terminal portion extending away from said second surface means and a fourth relatively rigid terminal portion generally juxtaposed to said first surface means, bobbin means, said bobbin means comprising a generally tubular body portion and first and second flange-like bobbin wall portions carried by said tubular body, said first and second bobbin wall portions being generally transverse to said tubular body portion and extending generally radially outwardly thereof, said first and second bobbin wall portions being spaced from each other generally axially of said tubular body portion, coil means comprising electrically conductive coil wire carried by said bobbin means as to be situated generally about said bobbin tubular body portion and axially between said first and second bobbin wall portions, said electrically conductive coil wire comprising first and second coil wire ends, first core means fixedly secured to said base means at said first surface means, said first core means comprising a generally L-shaped configuration and having at least first and second leg portions, said first core means being secured to said base means as to have both of said first and second leg portions generally juxtaposed to said first surface means, second core means extending generally through said bobbin tubular body and fixedly secured to said first leg portion of said first core means, said second core means serving to operatively secure said first bobbin wall portion against said first leg portion to thereby cause said second core means and said second leg portion to be generally parallel to each other and to the axis of said coil means, said first bobbin wall portion comprising an integrally formed enlarged first wall section extending generally transversely to said first bobbin wall portion, said second bobbin wall portion comprising an integrally formed enlarged second wall section extending generally transversely thereof, first electrically conductive intermediate connecting means, second electrically conductive intermediate connecting means, said first intermediate connecting means comprising a cross-sectionally solid first connector substantially greater in cross-sectional area than said coil wire, said second intermediate connecting means comprising a cross-sectionally solid second connector substantially greater in cross-sectional area than said coil wire, said first solid connector being press-fitted through said first enlarged wall section as to have a first portion of said first solid connector extending through a first end of said first enlarged wall section and disposed generally between said first and second bobbin wall portions and as to have a second portion of said first solid connector extending through a second end of said first enlarged wall section opposite to said first end of said first enlarged wall section, said first portion of said first solid connector being electrically connected to said first coil wire end and being bent generally toward said coil means as to thereby eliminate tension stresses in said coil wire leading from said first portion of said first solid connector and to said coil means, said second solid connector being press-fitted through said second enlarged wall section as to have a first portion of said second solid connector extending through a first end of said second enlarged wall section and disposed generally between said first and second bobbin wall portions and as to have a second portion of said second solid connector extending through a second end of said second enlarged wall section opposite to said first end of said second enlarged wall section, said first portion of said second solid connector being electrically connected to said second coil wire end and being bent generally toward said coil as to thereby eliminate tension stresses in said coil wire leading from said first portion of said second solid connector and to said coil means, locating type first recess means formed in said second relatively rigid terminal portion, said second portion of said first solid connector being received by said first recess means and fixedly electrically connected to said second relatively rigid terminal portion, locating type second recess means formed in said fourth relatively rigid terminal portion, said second portion of said second solid connector being received by said second recess means and fixedly electrically connected to said fourth relatively rigid terminal portion, third terminal means extending through said base means and having a fifth relatively rigid connectible terminal portion extending away from said second surface means and a sixth relatively rigid terminal portion generally at said first surface means and electrically connected to said first core means, plate-like electrically conductive spring means, said spring means comprising a first generally flat body portion and a second generally flat body portion, said first and second generally flat body portions being operatively interconnected by an intermediate bowed portion integrally formed with both of said first and second generally flat body portions, said first generally flat body portion being operatively connected to said second leg portion of said first core means as to thereby cause said second generally flat body portion to extend generally transversely of said second core means and be normally spaced from said second bobbin wall portion, an armature member situated generally between said second generally flat body portion and said second core means, said armature member being fixedly secured to said second generally flat body portion for movement in unison therewith, and fixed electrical contact means, said coil means when electrically energized being effective to cause said armature member and said second generally flat body portion to move toward said second core means and cause said second generally flat body portion to move relative to said fixed electrical contact means.

29. A relay assembly, comprising base means, said base means comprising dielectric plastic material, said base means further comprising oppositely disposed first and second surface means, first terminal means extending through said base means and having a first relatively rigid connectible terminal portion extending away from said second surface means and a second relatively rigid terminal portion generally juxtaposed to said first surface means, second terminal means extending through said base means and having a third relatively rigid connectible terminal portion extending away from said second surface means and a fourth relatively rigid terminal portion generally juxtaposed to said first surface means, bobbin means, said bobbin means comprising a generally tubular body portion and first and second flange-like bobbin wall portions carried by said tubular body, said first and second bobbin wall portions being generally transverse to said tubular body portion and extending generally radially outwardly thereof, said first and second bobbin wall portions being spaced from each other generally axially of said tubular body portion, coil means comprising electrically conductive coil wire carried by said bobbin means as to be situated generally about said bobbin tubular body portion and axially between said first and second bobbin wall portions, said electrically conductive coil wire comprising first and second coil wire ends, first core means fixedly secured to said base means at said first surface means, said first core means comprising a generally L-shaped configuration and having at least first and second leg portions, said first core means being secured to said base means as to have both of said first and second leg portions generally juxtaposed to said first surface means, second core means extending generally through said bobbin tubular body and fixedly secured to said first leg portion of said first core means, said second core means serving to operatively secure said first bobbin wall portion against said first leg portion to thereby cause said second core means and said second leg portion to be generally parallel to each other and to the axis of said coil means, said first bobbin wall portion comprising an integrally formed enlarged first wall section extending generally transversely to said first bobbin wall portion, said second bobbin wall portion comprising an integrally formed enlarged second wall section extending generally transversely thereof, first electrically conductive intermediate connecting means, second electrically conductive intermediate connecting means, said first intermediate connecting means comprising a cross-sectionally solid first connector substantially greater in cross-sectional area than said coil wire, said second intermediate connecting means comprising a cross-sectionally solid second connector substantially greater in cross-sectional area than said coil wire, said first solid connector being press-fitted through said first enlarged wall section as to have a first portion of said first solid connector extending through a first end of said first enlarged wall section and disposed generally between said first and second bobbin wall portions and as to have a second portion of said first solid connector extending through a second end of said first enlarged wall section opposite to said first end of said first enlarged wall section, said first portion of said first solid connector being electrically connected to said first coil wire end and being bent generally toward said coil means to thereby eliminate tension stresses in said coil wire leading from said first portion of said first solid connector and to said coil means, said second solid connector being press-fitted through said second enlarged wall section as to have a first portion of said second solid connector extending through a first end of said second enlarged wall section and disposed generally between said first and second bobbin wall portions and as to have a second portion of said second solid connector extending through a second end of said second enlarged wall section opposite to said first end of said second enlarged wall section, said first portion of said second solid connector being electrically connected to said second coil wire end and being bent generally toward said coil as to thereby eliminate tension stresses in said coil wire leading from said first portion of said second solid connector and to said coil means, said second portion of said first solid connector being fixedly electrically connected to said second relatively rigid terminal portion, said second portion of said second solid connector being fixedly electrically connected to said fourth relatively rigid terminal portion, third terminal means extending through said base means and having a fifth relatively rigid connectible terminal portion extending away from said second surface means and a sixth relatively rigid terminal portion generally at said first surface means and electrically connected to said first core means, plate-like electrically conductive spring means, said spring means comprising a first generally flat body portion and a second generally flat body portion, said first and second generally flat body portions being operatively interconnected by an intermediate bowed portion integrally formed with both of said first and second generally flat body portions, said first generally flat body portion being sonically welded to said second leg portion of said first core means as to thereby cause said second generally flat body portion to extend generally transversely of said second core means and be normally spaced from said second bobbin wall portion, an armature member situated generally between said second generally flat body portion and said second core means, first and second bearing-like surfaces respectively formed on said second leg of said first core means and said armature member as to be juxtaposed to each other, one of said first and second bearing-like surfaces being formed as to present a projecting bearing of very little effective engaging area compared to the area of the other of said first and second bearing-like surfaces, third and fourth bearing-like surfaces respectively formed on said second leg of said first core means and said armature member as to be juxtaposed to each other, one of said third and fourth bearing-like surfaces being formed as to present a projecting bearing of very little effective engaging area compared to the area of the other of said third and fourth bearing-like surfaces, said armature member being fixedly secured to said second generally flat body portion for movement in unison therewith, fixed electrical contact means, and fourth terminal means extending away from said second surface means and electrically connected to said fixed electrical contact means, said coil means when electrically energized being effective to cause said armature member and said second generally flat body portion to move toward said second core means and cause said second generally flat body portion to move relative to said fixed electrical contact means.

30. A relay assembly according to claim 29 wherein said second relatively rigid terminal portion comprises a first terminal body portion, wherein said fourth relatively rigid terminal portion comprises a second terminal body portion, wherein said first and second terminal body portions are situated as to have said armature member and said first leg portion generally between said first and second terminal body portions, wherein said second portion of said first solid connector in being fixedly electrically connected to said second relatively rigid terminal portion is soldered to said first terminal body portion, and wherein said second portion of said second solid connector in being fixedly electrically connected to said fourth relatively rigid terminal portion is soldered to said second terminal body portion.

31. A relay assembly, comprising base means, said base means comprising dielectric plastic material, said base means further comprising oppositely disposed first and second surface means, first terminal means extending through said base means and having a first relatively rigid connectible terminal portion extending away from said second surface means and a second relatively rigid terminal portion generally juxtaposed to said first surface means, second terminal means extending through said base means and having a third relatively rigid connectible terminal portion extending away from said second surface means and a fourth relatively rigid terminal portion generally juxtaposed to said first surface means, bobbin means, said bobbin means comprising a generally tubular body portion and first and second flange-like bobbin wall portions carried by said tubular body, said first and second bobbin wall portions being generally transverse to said tubular body portion and extending generally radially outwardly thereof, said first and second bobbin wall portions being spaced from each other generally axially of said tubular body portion, coil means comprising electrically conductive coil wire carried by said bobbin means as to be situated generally about said bobbin tubular body portion and axially between said first and second bobbin wall portions, said electrically conductive coil wire comprising first and second coil wire ends, first core means fixedly secured to said base means at said first surface means, said first core means comprising a generally L-shaped configuration and having at least first and second leg portions, said first core means being secured to said base means as to have both of said first and second leg portions generally juxtaposed to said first surface means, second core means extending generally through said bobbin tubular body and fixedly secured to said first leg portion of said first core means, said second core means serving to operatively secure said first bobbin wall portion against said first leg portion to thereby cause said second core means and said second leg portion to be generally parallel to each other and to the axis of said coil means, said first bobbin wall portion comprising an integrally formed enlarged first wall section extending generally transversely to said first bobbin wall portion, said second bobbin wall portion comprising an integrally formed enlarged second wall section extending generally transversely thereof, first electrically conductive intermediate connecting means, second electrically conductive intermediate connecting means, said first intermediate connecting means comprising a cross-sectionally solid first connector substantially greater in cross-sectional area than said coil wire, said second intermediate connecting means comprising a cross-sectionally solid second connector substantially greater in cross-sectional area than said coil wire, said first solid connector being press-fitted through said first enlarged wall section as to have a first portion of said first solid connector extending through a first end of said first enlarged wall section and disposed generally between said first and second bobbin wall portions and as to have a second portion of said first solid connector extending through a second end of said first enlarged wall section opposite to said first end of said first enlarged wall section, said first portion of said first solid connector being electrically connected to said first coil wire end and being bent generally toward said coil means as to thereby eliminate tension stresses in said coil wire leading from said first portion of said first solid connector and to said coil means, said second solid connector being press-fitted through said second enlarged wall section as to have a first portion of said second solid connector extending through a first end of said second enlarged wall section and disposed generally between said first and second bobbin wall portions and as to have a second portion of said second solid connector extending through a second end of said second enlarged wall section opposite to said first end of said second enlarged wall section, said first portion of said second solid connector being electrically connected to said second coil wire end and being bent generally toward said coil as to thereby eliminate tension stresses in said coil wire leading from said first portion of said second solid connector and to said coil means, said second portion of said first solid connector being fixedly electrically connected to said second relatively rigid terminal portion, said second portion of said second solid connector being fixedly electrically connected to said fourth relatively rigid terminal portion, third terminal means extending through said base means and having a fifth relatively rigid connectible terminal portion extending away from said second surface means and a sixth relatively rigid terminal portion generally at said first surface means and electrically connected to said first core means, plate-like electrically conductive spring means, said spring means comprising a first generally flat body portion and a second generally flat body portion, said first and second generally flat body portions being operatively interconnected by an intermediate bowed portion integrally formed with both of said first and second generally flat body portions, said first generally flat body portion being sonically welded to said second leg portion of said first core means as to thereby cause said second generally flat body portion to extend generally transversely of said second core means and be normally spaced from said second bobbin wall portion, an armature member situated generally between said second generally flat body portion and said second core means, first and second bearing-like surfaces respectively formed on said second leg of said first core means and said armature member as to be juxtaposed to each other, one of said first and second bearing-like surfaces being formed as to present a projecting bearing of very little effective engaging area compared to the area of the other of said first and second bearing-like surfaces, third and fourth bearing-like surfaces respectively formed on said second leg of said first core means and said armature member as to be juxtaposed to each other, one of said third and fourth bearing-like surfaces being formed as to present a projecting bearing of very little effective engaging area compared to the area of the other of said third and fourth bearing-like surfaces, said armature member being fixedly secured to said second generally flat body portion for movement in unison therewith, and fixed electrical contact means, said coil means when electrically energized being effective to cause said armature member and said second generally flat body portion to move toward said second core means and cause said second generally flat body portion to move relative to said fixed electrical contact means.

32. A relay assembly, comprising base means, said base means comprising dielectric plastic material, said base means further comprising oppositely disposed first and second surface means, first terminal means extending through said base means and having a first relatively rigid connectible terminal portion extending away from said second surface means and a second relatively rigid terminal portion generally juxtaposed to said first surface means, second terminal means extending through said base means and having a third relatively rigid connectible terminal portion extending away from said second surface means and a fourth relatively rigid terminal portion generally juxtaposed to said first surface means, bobbin means, said bobbin means comprising a generally tubular body portion and first and second flange-like bobbin wall portions carried by said tubular body, said first and second bobbin wall portions being generally transverse to said tubular body portion and extending generally radially outwardly thereof, said first and second bobbin wall portions being spaced from each other generally axially of said tubular body portion, coil means comprising electrically conductive coil wire carried by said bobbin means as to be situated generally about said bobbin tubular body portion and axially between said first and second bobbin wall portions, said electrically conductive coil wire comprising first and second coil wire ends, first core means fixedly secured to said base means at said first surface means, said first core means comprising a generally L-shaped configuration and having at least first and second leg portions, said first core means being secured to said base means as to have both of said first and second leg portions generally juxtaposed to said first surface means, second core means extending generally through said bobbin tubular body and fixedly secured to said first leg portion of said first core means, said second core means serving to operatively secure said first bobbin wall portion against said first leg portion to thereby cause said second core means and said second leg portion to be generally parallel to each other and to the axis of said coil means, said first bobbin wall portion comprising an integrally formed enlarged first wall section extending generally transversely to said first bobbin wall portion, said second bobbin wall portion comprising an integrally formed enlarged second wall section extending generally transversely thereof, first electrically conductive intermediate connecting means, second electrically conductive intermediate connecting means, said first intermediate connecting means comprising a cross-sectional solid first connector substantially greater in cross-sectional area than said coil wire, said second intermediate connecting means comprising a cross-sectionally solid second connector substantially greater in cross-sectional area than said coil wire, said first solid connector being press-fitted through said first enlarged wall section as to have a first portion of said first solid connector extending through a first end of said first enlarged wall section and disposed generally between said first and second bobbin wall portions and as to have a second portion of said first solid connector extending through a second end of said first enlarged wall section opposite to said first end of said first enlarged wall section, said first portion of said first solid connector being electrically connected to said first coil wire end and being bent generally toward said coil means as to thereby eliminate tension stresses in said coil wire leading from said first portion of said first solid connector and to said coil means, said second solid connector being press-fitted through said second enlarged wall section as to have a first portion of said second solid connector extending through a first end of said second enlarged wall section and disposed generally between said first and second bobbin wall portions and as to have a second portion of said second solid connector extending through a second end of said second enlarged wall section opposite to said first end of said second enlarged wall section, said first portion of said second solid connector being electrically connected to said second coil wire end and being bent generally toward said coil as to thereby eliminate tension stresses in said coil wire leading from said first portion of said second solid connector and to said coil means, said second portion of said first solid connector being fixedly electrically connected to said second relatively rigid terminal portion, said second portion of said second solid connector being fixedly electrically connected to said fourth relatively rigid terminal portion, third terminal means extending through said base means and having a fifth relatively rigid connectible terminal portion extending away from said second surface means and a sixth relatively rigid terminal portion generally at said first surface means and electrically connected to said first core means, plate-like electrically conductive spring means, said spring means comprising a first generally flat body portion and a second generally flat body portion, said first and second generally flat body portions being operatively interconnected by an intermediate bowed portion integrally formed with both of said first and second generally flat body portions, said first generally flat body portion being operatively connected to said second leg portion of said first core means as to thereby cause said second generally flat body portion to extend generally transversely of said second core means and be normally spaced from said second bobbin wall portion, an armature member situated generally between said second generally flat body portion and said second core means, first and second bearing-like surfaces respectively formed on said second leg of said first core means and said armature member as to be juxtaposed to each other, one of said first and second bearing-like surfaces being formed as to present a projecting bearing of very little effective engaging area compared to the area of the other of said first and second bearing-like surfaces, third and fourth bearing-like surfaces respectively formed on said second leg of said first core means and said armature member as to be juxtaposed to each other, one of said third and fourth bearing-like surfaces being formed as to present a projecting bearing of very little effective engaging area compared to the area of the other of said third and fourth bearing-like surfaces, said armature member being fixedly secured to said second generally flat body portion for movement in unison therewith, and fixed electrical contact means, said coil means when electrically energized being effective to cause said armature member and said second generally flat body portion to move toward said second core means and cause said second generally flat body portion to move relative to said fixed electrical contact means.

33. A relay assembly according to claim 32 wherein said second relatively rigid terminal portion comprises a first terminal body portion, wherein said fourth relatively rigid terminal portion comprises a second terminal body portion, wherein said first and second terminal body portions are situated as to have said armature member and said first leg portion generally between said first and second terminal body portions, wherein said second portion of said first solid connector in being fixedly electrically connected to said second relatively rigid terminal portion is soldered to said first terminal body portion, and wherein said second portion of said second solid connector in being fixedly electrically connected to said fourth relatively rigid terminal portion is soldered to said second terminal body portion.

34. A relay assembly, comprising base means, said base means comprising dielectric plastic material, said base means further comprising oppositely disposed first and second surface means, first terminal means extending through said base means and having a first relatively rigid connectible terminal portion extending away from said second surface means and a second relatively rigid terminal portion generally juxtaposed to said first surface means, second terminal means extending through said base means and having a third relatively rigid connectible terminal portion extending away from said second surface means and a fourth relatively rigid terminal portion generally juxtaposed to said first surface means, bobbin means, said bobbin means comprising a generally tubular body portion and first and second flange-like bobbin wall portions carried by said tubular body, said first and second bobbin wall portions being generally transverse to said tubular body portion and extending generally radially outwardly thereof, said first and second bobbin wall portions being spaced from each other generally axially of said tubular body portion, coil means comprising electrically conductive coil wire carried by said bobbin means as to be situated generally about said bobbin tubular body portion and axially between said first and second bobbin wall portions, said electrically conductive coil wire comprising first and second coil wire ends, first core means fixedly secured to said base means at said first surface means, said first core means comprising a generally L-shaped configuration and having at least first and second leg portions, said first core means being secured to said base means as to have both of said first and second leg portions generally juxtaposed to said first surface means, second core means extending generally through said bobbin tubular body and fixedly secured to said first leg portion of said first core means, said second core means serving to operatively secure said first bobbin wall portion against said first leg portion to thereby cause said second core means and said second leg portion to be generally parallel to each other and to the axis of said coil means, said first bobbin wall portion comprising an integrally formed enlarged first wall section extending generally transversely to said first bobbin wall portion, said second bobbin wall portion comprising an integrally formed enlarged second wall section extending generally transversely thereof, first electrically conductive intermediate connecting means, second electrically conductive intermediate connecting means, said first intermediate connecting means comprising a cross-sectionally solid first connector substantially greater in cross-sectional area than said coil wire, said second intermediate connecting means comprising a cross-sectionally solid second connector substantially greater in cross-sectional area than said coil wire, said first solid connector being press-fitted through said first enlarged wall section as to have a first portion of said first solid connector extending through a first end of said first enlarged wall section and disposed generally between said first and second bobbin wall portions and as to have a second portion of said first solid connector extending through a second end of said first enlarged wall section opposite to said first end of said first enlarged wall section, said first portion of said first solid connector being electrically connected to said first coil wire end and being bent generally toward said coil means as to thereby eliminate tension stresses in said coil wire leading from said first portion of said first solid connector and to said coil means, said second solid connector being press-fitted through said second enlarged wall section as to have a first portion of said second solid connector extending through a first end of said second enlarged wall section and disposed generally between said first and second bobbin wall portions and as to have a second portion of said second solid connector extending through a second end of said second enlarged wall section opposite to said first end of said second enlarged wall section, said first portion of said second solid connector being electrically connected to said second coil wire end and being bent generally toward said coil as to thereby eliminate tension stresses in said coil wire leading from said first portion of said second solid connector and to said coil means, said second portion of said first solid connector being fixedly electrically connected to said second relatively rigid terminal portion, said second portion of said second solid connector being fixedly electrically connected to said fourth relatively rigid terminal portion, third terminal means extending through said base means and having a fifth relatively rigid connectible terminal portion extending away from said second surface means and a sixth relatively rigid terminal portion generally at said first surface means and electrically connected to said first core means, plate-like electrically conductive spring means, said spring means comprising a first generally flat body portion and a second generally flat body portion, said first and second generally flat body portions being operatively interconnected by an intermediate bowed portion integrally formed with both of said first and second generally flat body portions, said first generally flat body portion being sonically welded to said second leg portion of said first core means as to thereby cause said second generally flat body portion to extend generally transversely of said second core means and be normally spaced from said second bobbin wall portion, an armature member situated generally between said second generally flat body portion and said second core means, said armature member being fixedly secured to said second generally flat body portion for movement in unison therewith, fixed electrical contact means, and fourth terminal means extending away from said second surface means and electrically connected to said fixed electrical contact means, said coil means when electrically energized being effective to cause said armature member and said second generally flat body portion to move toward said second core means and cause said second generally flat body portion to move relative to said fixed electrical contact means.

35. A relay assembly, comprising base means, said base means comprising dielectric plastic material, said base means further comprising oppositely disposed first and second surface means, first terminal means extending through said base means and having a first relatively rigid connectible terminal portion extending away from said second surface means and a second relatively rigid terminal portion generally juxtaposed to said first surface means, second terminal means extending through said base means and having a third relatively rigid connectible terminal portion extending away from said second surface means and a fourth relatively rigid terminal portion generally juxtaposed to said first surface means, bobbin means, said bobbin means comprising a generally tubular body portion and first and second flange-like bobbin wall portions carried by said tubular body, said first and second bobbin wall portions being generally transverse to said tubular body portion and extending generally radially outwardly thereof, said first and second bobbin wall portions being spaced from each other generally axially of said tubular body portion, coil means comprising electrically conductive coil wire carried by said bobbin means as to be situated generally about said bobbin tubular body portion and axially between said first and second bobbin wall portions, said electrically conductive coil wire comprising first and second coil wire ends, first core means fixedly secured to said base means at said first surface means, said first core means comprising a generally L-shaped configuration and having at least first and second leg portions, said first core means being secured to said base means as to have both of said first and second leg portions generally juxtaposed to said first surface means, second core means extending generally through said bobbin tubular body and fixedly secured to said first leg portion of said first core means, said second core means serving to operatively secure said first bobbin wall portion against said first leg portion to thereby cause said second core means and said second leg portion to be generally parallel to each other and to the axis of said coil means, said first bobbin wall portion comprising an integrally formed enlarged first wall section extending generally transversely to said first bobbin wall portion, said second bobbin wall portion comprising an integrally formed enlarged second wall section extending generally transversely thereof, first electrically conductive intermediate connecting means, second electrically conductive intermediate connecting means, said first intermediate connecting means comprising a cross-sectionally solid first connector substantially greater in cross-sectional area than said coil wire, said second intermediate connecting means comprising a cross-sectionally solid second connector substantially greater in cross-sectional area than said coil wire, said first solid connector being press-fitted through said first enlarged wall section as to have a first portion of said first solid connector extending through a first end of said first enlarged wall section and disposed generally between said first and second bobbin wall portions and as to have a second portion of said first solid connector extending through a second end of said first enlarged wall section opposite to said first end of said first enlarged wall section, said first portion of said first solid connector being electrically connected to said first coil wire end and being bent generally toward said coil means as to thereby eliminate tension stresses in said coil wire leading from said first portion of said first solid connector and to said coil means, said second solid connector being press-fitted through said second enlarged wall section as to have a first portion of said second solid connector extending through a first end of said second enlarged wall section and disposed generally between said first and second bobbin wall portions and as to have a second portion of said second solid connector extending through a second end of said second enlarged wall section opposite to said first end of said second enlarged wall section, said first portion of said second solid connector being electrically connected to said second coil wire end and being bent generally toward said coil as to thereby eliminate tension stresses in said coil wire leading from said first portion of said second solid connector and to said coil means, said second portion of said first solid connector being fixedly electrically connected to said second relatively rigid terminal portion, said second portion of said second solid connector being fixedly electrically connected to said fourth relatively rigid terminal portion, third terminal means extending through said base means and having a fifth relatively rigid connectible terminal portion extending away from said second surface means and a sixth relatively rigid terminal portion generally at said first surface means and electrically connected to said first core means, plate-like electrically conductive spring means, said spring means comprising a first generally flat body portion and a second generally flat body portion, said first and second generally flat body portions being operatively interconnected by an intermediate bowed portion integrally formed with both of said first and second generally flat body portions, said first generally flat body portion being sonically welded to said second leg portion of said first core means as to thereby cause said second generally flat body portion to extend generally transversely of said second core means and be normally spaced from said second bobbin wall portion, an armature member situated generally between said second generally flat body portion and said second core means, said armature member being fixedly secured to said second generally flat body portion for movement in unison therewith, and fixed electrical contact means, said coil means when electrically energized being effective to cause said armature member and said second generally flat body portion to move toward said second core means and cause said second generally flat body portion to move relative to said fixed electrical contact means.

36. A relay assembly, comprising base means, said base means comprising dielectric plastic material, said base means further comprising oppositely disposed first and second surface means, first terminal means extending through said base means and having a first relatively rigid connectible terminal portion extending away from said second surface means and a second relatively rigid terminal portion generally juxtaposed to said first surface means, second terminal means extending through said base means and having a third relatively rigid connectible terminal portion extending away from said second surface means and a fourth relatively rigid terminal portion generally juxtaposed to said first surface means, bobbin means, said bobbin means comprising a generally tubular body portion and first and second flange-like bobbin wall portions carried by said tubular body, said first and second bobbin wall portions being generally transverse to said tubular body portion and extending generally radially outwardly thereof, said first and second bobbin wall portions being spaced from each other generally axially of said tubular body portion, coil means comprising electrically conductive coil wire carried by said bobbin means as to be situated generally about said bobbin tubular body portion and axially between said first and second bobbin wall portions, said electrically conductive coil wire comprising first and second coil wire ends, first core means fixedly secured to said base means at said first surface means, said first core means comprising a generally L-shaped configuration and having at least first and second leg portions, said first core means being secured to said base means as to have both of said first and second leg portions generally juxtaposed to said first surface means, second core means extending generally through said bobbin tubular body and fixedly secured to said first leg portion of said first core means, said second core means serving to operatively secure said first bobbin wall portion against said first leg portion to thereby cause said second core means and said second leg portion to be generally parallel to each other and to the axis of said coil means, said first bobbin wall portion comprising an integrally formed enlarged first wall section extending generally transversely to said first bobbin wall portion, said second bobbin wall portion comprising an integrally formed enlarged second wall section extending generally transversely thereof, first electrically conductive intermediate connecting means, second electrically conductive intermediate connecting means, said first intermediate connecting means comprising a cross-sectionally solid first connector substantially greater in cross-sectional area than said coil wire, said second intermediate connecting means comprising a cross-sectionally solid second connector substantially greater in cross-sectional area than said coil wire, said first solid connector being press-fitted through said first enlarged wall section as to have a first portion of said first solid connector extending through a first end of said first enlarged wall section and disposed generally between said first and second bobbin wall portions and as to have a second portion of said first solid connector extending through a second end of said first enlarged wall section opposite to said first end of said first enlarged wall section, said first portion of said first solid connector being electrically connected to said first coil wire end and being bent generally toward said coil means as to thereby eliminate tension stresses in said coil wire leading from said first portion of said first solid connector and to said coil means, said second solid connector being press-fitted through said second enlarged wall section as to have a first portion of said second solid connector extending through a first end of said second enlarged wall section and disposed generally between said first and second bobbin wall portions and as to have a second portion of said second solid connector extending through a second end of said second enlarged wall section opposite to said first end of said second enlarged wall section, said first portion of said second solid connector being electrically connected to said second coil wire end and being bent generally toward said coil as to thereby eliminate tension stresses in said coil wire leading from said first portion of said second solid connector and to said coil means, said second portion of said first solid connector being fixedly electrically connected to said second relatively rigid terminal portion, said second portion of said second solid connector being fixedly electrically connected to said fourth relatively rigid terminal portion, third terminal means extending through said base means and having a fifth relatively rigid connectible terminal portion extending away from said second surface means and a sixth relatively rigid terminal portion generally at said first surface means and electrically connected to said first core means, plate-like electrically conductive spring means, said spring means comprising a first generally flat body portion and a second generally flat body portion, said first and second generally flat body portions being operatively interconnected by an intermediate bowed portion integrally formed with both of said first and second generally flat body portions, said first generally flat body portion being operatively connected to said second leg portion of said first core means as to thereby cause said second generally flat body portion to extend generally transversely of said second core means and be normally spaced from said second bobbin wall portion, an armature member situated generally between said second generally flat body portion and said second core means, said armature member being fixedly secured to said second generally flat body portion for movement in unison therewith, fixed electrical contact means, and fourth terminal means extending away from said second surface means and electrically connected to said fixed electrical contact means, said coil means when electrically energized being effective to cause said armature member and said second generally flat body portion to move toward said second core means and cause said second generally flat body portion to move relative to said fixed electrical contact means.

37. A relay assembly, comprising base means, said base means comprising dielectric plastic material, said base means further comprising oppositely disposed first and second surface means, first terminal means extending through said base means and having a first relatively rigid connectible terminal portion extending away from said second surface means and a second relatively rigid terminal portion generally juxtaposed to said first surface means, second terminal means extending through said base means and having a third relatively rigid connectible terminal portion extending away from said second surface means and a fourth relatively rigid terminal portion generally juxtaposed to said first surface means, bobbin means, said bobbin means comprising a generally tubular body portion and first and second flange-like bobbin wall portions carried by said tubular body, said first and second bobbin wall portions being generally transverse to said tubular body portion and extending generally radially outwardly thereof, said first and second bobbin wall portions being spaced from each other generally axially of said tubular body portion, coil means comprising electrically conductive coil wire carried by said bobbin means as to be situated generally about said bobbin tubular body portion and axially between said first and second bobbin wall portions, said electrically conductive coil wire comprising first and second coil wire ends, first core means fixedly secured to said base means at said first surface means, said first core means comprising a generally L-shaped configuration and having at least first and second leg portions, leg-like support means carried by said first core means, said leg-like support means being received by said base means as to thereby secure said first core means to said base means as to have both of said first and second leg portions of said first core means generally juxtaposed to said first surface means, second core means extending generally through said bobbin tubular body and fixedly secured to said first leg portion of said first core means, said second core means serving to operatively secure said first bobbin wall portion against said first leg portion to thereby cause said second core means and said second leg portion to be generally parallel to each other and to the axis of said coil means, said first bobbin wall portion comprising an integrally formed enlarged first wall section extending generally transversely to said first bobbin wall portion, said second bobbin wall portion comprising an integrally formed enlarged second wall section extending generally transversely thereof, first electrically conductive intermediate connecting means, second electrically conductive intermediate connecting means, said first intermediate connecting means comprising a cross-sectionally solid first connector substantially greater in cross-sectional area than said coil wire, said second intermediate connecting means comprising a cross-sectionally solid second connector substantially greater in cross-sectional area than said coil wire, said first solid connector being press-fitted through said first enlarged wall section as to have a first portion of said first solid connector extending through a first end of said first enlarged wall section and disposed generally between said first and second bobbin wall portions and as to have a second portion of said first solid connector extending through a second end of said first enlarged wall section opposite to said first end of said first enlarged wall section, said first portion of said first solid connector being electrically connected to said first coil wire end and being bent generally toward said coil means as to thereby eliminate tension stresses in said coil wire leading from said first portion of said first solid connector and to said coil means, said second solid connector being press-fitted through said second enlarged wall section as to have a first portion of said second solid connector extending through a first end of said second enlarged wall section and disposed generally between said first and second bobbin wall portions and as to have a second portion of said second solid connector extending through a second end of said second enlarged wall section opposite to said first end of said second enlarged wall section, said first portion of said second solid connector being electrically connected to said second coil wire end and being bent generally towards said coil as to thereby eliminate tension stresses in said coil wire leading from said first portion of said second solid connector and to said coil means, said second portion of said first solid connector being fixedly electrically connected to said second relatively rigid terminal portion, said second portion of said second solid connector being fixedly electrically connected to said fourth relatively rigid terminal portion, third terminal means extending through said base means and having a fifth relatively rigid connectible terminal portion extending away from said second surface means and a sixth relatively rigid terminal portion generally at said first surface means and electrically connected to said first core means, plate-like electrically conductive spring means, said spring means comprising a first generally flat body portion and a second generally flat body portion, said first and second generally flat body portions being operatively interconnected by an intermediate bowed portion integrally formed with both of said first and second generally flat body portions, said first generally flat body portion being sonically welded to said second leg portion of said first core means as to thereby cause said second generally flat body portion to extend generally transversely of said second core means and be normally spaced from said second bobbin wall portion, an armature member situated generally between said second generally flat body portion and said second core means, said armature member being fixedly secured to said second generally flat body portion for movement in unison therewith, fixed electrical contact means, and fourth terminal means extending away from said second surface means and electrically connected to said fixed electrical contact means, said coil means when electrically energized being effective to cause said armature member and said second generally flat body portion to move toward said second core means and cause said second generally flat body portion to move relative to said fixed electrical contact means.

38. A relay assembly according to claim 37 wherein said second relatively rigid terminal portion comprises a first terminal body portion, wherein said fourth relatively rigid terminal portion comprises a second terminal body portion, wherein said first and second terminal body portions are situated as to have said armature member and said first leg portion generally between said first and second terminal body portions, wherein said second portion of said first solid connector in being fixedly electrically connected to said second relatively rigid terminal portion is soldered to said first terminal body portion, and wherein said second portion of said second solid connector in being fixedly electrically connected to said fourth relatively rigid terminal portion is soldered to said second terminal body portion.

39. A relay assembly, comprising base means, said base means comprising dielectric plastic material, said base means further comprising oppositely disposed first and second surface means, first terminal means extending through said base means and having a first relatively rigid connectible terminal portion extending away from said second surface means and a second relatively rigid terminal portion generally juxtaposed to said first surface means, second terminal means extending through said base means and having a third relatively rigid connectible terminal portion extending away from said second surface means and a fourth relatively rigid terminal portion generally juxtaposed to said first surface means, bobbin means, said bobbin means comprising a generally tubular body portion and first and second flange-like bobbin wall portions carried by said tubular body, said first and second bobbin wall portions being generally transverse to said tubular body portion and extending generally radially outwardly thereof, said first and second bobbin wall portions being spaced from each other generally axially of said tubular body portion, coil means comprising electrically conductive coil wire carried by said bobbin means as to be situated generally about said bobbin tubular body portion and axially between said first and second bobbin wall portions, said electrically conductive coil wire comprising first and second coil wire ends, first core means fixedly secured to said base means at said first surface means, said first core means comprising a generally L-shaped configuration and having at least first and second leg portions, leg-like support means carried by said first core means, said leg-like support means being received by said base means as to thereby secure said first core means to said base means as to have both of said first and second leg portions of said first core means generally juxtaposed to said first surface means, second core means extending generally through said bobbin tubular body and fixedly secured to said first leg portion of said first core means, said second core means serving to operatively secure said first bobbin wall portion against said first leg portion to thereby cause said second core means and said second leg portion to be generally parallel to each other and to the axis of said coil means, said first bobbin wall portion comprising an integrally formed enlarged first wall section extending generally transversely to said first bobbin wall portion, said second bobbin wall portion comprising an integrally formed enlarged second wall section extending generally transversely thereof, first electrically conductive intermediate connecting means, second electrically conductive intermediate connecting means, said first intermediate connecting means comprising a cross-sectionally solid first connector substantially greater in cross-sectional area than said coil wire, said second intermediate connecting means comprising a cross-sectionally solid second connector substantially greater in cross-sectional area than said coil wire, said first solid connector being press-fitted through said first enlarged wall section as to have a first portion of said first solid connector extending through a first end of said first enlarged wall section and disposed generally between said first and second bobbin wall portions and as to have a second portion of said first solid connector extending through a second end of said first enlarged wall section opposite to said first end of said first enlarged wall section, said first portion of said first solid connector being electrically connected to said first coil wire end and being bent generally toward said coil means as to thereby eliminate tension stresses in said coil wire leading from said first portion of said first solid connector and to said coil means, said second solid connector being press-fitted through said second enlarged wall section as to have a first portion of said second solid connector extending through a first end of said second enlarged wall section and disposed generally between said first and second bobbin wall portions and as to have a second portion of said second solid connector extending through a second end of said second enlarged wall section opposite to said first end of said second enlarged wall section, said first portion of said second solid connector being electrically connected to said second coil wire end and being bent generally toward said coil as to thereby eliminate tension stresses in said coil wire leading from said first portion of said second solid connector and to said coil means, said second portion of said first solid connector being fixedly electrically connected to said second relatively rigid terminal portion, said second portion of said second solid connector being fixedly electrically connected to said fourth relatively rigid terminal portion, third terminal means extending through said base means and having a fifth relatively rigid connectible terminal portion extending away from said second surface means and a sixth relatively rigid terminal portion generally at said first surface means and electrically connected to said first core means, plate-like electrically conductive spring means, said spring means comprising a first generally flat body portion and a second generally flat body portion, said first and second generally flat body portions being operatively interconnected by an intermediate bowed portion integrally formed with both of said first and second generally flat body portions, said first generally flat body portion being sonically welded to said second leg portion of said first core means as to thereby cause said second generally flat body portion to extend generally transversely of said second core means and be normally spaced from said second bobbin wall portion, an armature member situated generally between said second generally flat body portion and said second core means, said armature member being fixedly secured to said second generally flat body portion for movement in unison therewith, and fixed electrical contact means, said coil means when electrically energized being effective to cause said armature member and said second generally flat body portion to move toward said second core means and cause said second generally flat body portion to move relative to said fixed electrical contact means.

40. A relay assembly according to claim 39 wherein said second relatively rigid terminal portion comprises a first terminal body portion, wherein said fourth relatively rigid terminal portion comprises a second terminal body portion, wherein said first and second terminal body portions are situated as to have said armature member and said first leg portion generally between said first and second terminal body portions, wherein said second portion of said first solid connector in being fixedly electrically connected to said second relatively rigid terminal portion is soldered to said first terminal body portion, and wherein said second portion of said second solid connector in being fixedly electrically connected to said fourth relatively rigid terminal portion is soldered to said second terminal body portion.

41. A relay assembly, comprising base means, said base means comprising dielectric plastic material, said base means further comprising oppositely disposed first and second surface means, first terminal means extending through said base means and having a first relatively rigid connectible terminal portion extending away from said second surface means and a second relatively rigid terminal portion generally juxtaposed to said first surface means, second terminal means extending through said base means and having a third relatively rigid connectible terminal portion extending away from said second surface means and a fourth relatively rigid terminal portion generally juxtaposed to said first surface means, bobbin means, said bobbin means comprising a generally tubular body portion and first and second flange-like bobbin wall portions carried by said tubular body, said first and second bobbin wall portions being generally transverse to said tubular body portion and extending generally radially outwardly thereof, said first and second bobbin wall portions being spaced from each other generally axially of said tubular body portion, coil means comprising electrically conductive coil wire carried by said bobbin means as to be situated generally about said bobbin tubular body portion and axially between said first and second bobbin wall portions, said electrically conductive coil wire comprising first and second coil wire ends, first core means fixedly secured to said base means at said first surface means, said first core means comprising a generally L-shaped configuration and having at least first and second leg portions, leg-like support means carried by said first core means, said leg-like support means being received by said base means as to thereby secure said first core means to said base means as to have both of said first and second leg portions of said first core means generally juxtaposed to said first surface means, second core means extending generally through said bobbin tubular body and fixedly secured to said first leg portion of said first core means, said second core means serving to operatively secure said first bobbin wall portion against said first leg portion to thereby cause said second core means and said second leg portion to be generally parallel to each other and to the axis of said coil means, said first bobbin wall portion comprising an integrally formed enlarged first wall section extending generally transversely to said first bobbin wall portion, said second bobbin wall portion comprising an integrally formed enlarged second wall section extending generally transversely thereof, first electrically conductive intermediate connecting means, second electrically conductive intermediate connecting means, said first intermediate connecting means comprising a cross-sectionally solid first connector substantially greater in cross-sectional area than said coil wire, said second intermediate connecting means comprising a cross-sectionally solid second connector substantially greater in cross-sectional area than said coil wire, said first solid connector being press-fitted through said first enlarged wall section as to have a first portion of said first solid connector extending through a first end of said first enlarged wall section and disposed generally between said first and second bobbin wall portions and as to have a second portion of said first solid connector extending through a second end of said first enlarged wall section opposite to said first end of said first enlarged wall section, said first portion of said first solid connector being electrically connected to said first coil wire end and being bent generally toward said coil means as to thereby eliminate tension stresses in said coil wire leading from said first portion of said first solid connector and to said coil means, said second solid connector being press-fitted through said second enlarged wall section as to have a first portion of said second solid connector extending through a first end of said second enlarged wall section and disposed generally between said first and second bobbin wall portions and as to have a second portion of said second solid connector extending through a second end of said second enlarged wall section opposite to said first end of said second enlarged wall section, said first portion of said second solid connector being electrically connected to said second coil wire end and being bent generally toward said coil as to thereby eliminate tension stresses in said coil wire leading from said first portion of said second solid connector and to said coil means, said second portion of said first solid connector being fixedly electrically connected to said second relatively rigid terminal portion, said second portion of said second solid connector being fixedly electrically connected to said fourth relatively rigid terminal portion, third terminal means extending through said base means and having a fifth relatively rigid connectible terminal portion extending away from said second surface means and a sixth relatively rigid terminal portion generally at said first surface means and electrically connected to said first core means, plate-like electrically conductive spring means, said spring means comprising a first generally flat body portion and a second generally flat body portion, said first and second generally flat body portions being operatively interconnected by an intermediate bowed portion integrally formed with both of said first and second generally flat body portions, said first generally flat body portion being operatively connected to said second leg portion of said first core means as to thereby cause said second generally flat body portion to extend generally transversely of said second core means and be normally spaced from said second bobbin wall portion, an armature member situated generally between said second generally flat body portion and said second core means, said armature member being fixedly secured to said second generally flat body portion for movement in unison therewith, fixed electrical contact means, and fourth terminal means extending away from said second surface means and electrically connected to said fixed electrical contact means, said coil means when electrically energized being effective to cause said armature member and said second generally flat body portion to move toward said second core means and cause said second generally flat body portion to move relative to said fixed electrical contact means.

42. A relay assembly according to claim 41 wherein said second relatively rigid terminal portion comprises a first terminal body portion, wherein said fourth relatively rigid terminal portion comprises a second terminal body portion, wherein said first and second terminal body portions are situated as to have said armature member and said first leg portion generally between said first and second terminal body portions, wherein said second portion of said first solid connector in being fixedly electrically connected to said second relatively rigid terminal portion is soldered to said first terminal body portion, and wherein said second portion of said second solid connector in being fixedly electrically connected to said fourth relatively rigid terminal portion is soldered to said second terminal body portion.

43. A relay assembly, comprising base means, said base means comprising dielectric plastic material, said base means further comprising oppositely disposed first and second surface means, first terminal means extending through said base means and having a first relatively rigid connectible terminal portion extending away from said second surface means and a second relatively rigid terminal portion generally juxtaposed to said first surface means, second terminal means extending through said base means and having a third relatively rigid connectible terminal portion extending away from said second surface means and a fourth relatively rigid terminal portion generally juxtaposed to said first surface means, bobbin means, said bobbin means comprising a generally tubular body portion and first and second flange-like bobbin wall portions carried by said tubular body, said first and second bobbin wall portions being generally transverse to said tubular body portion and extending generally radially outwardly thereof, said first and second bobbin wall portions being spaced from each other generally axially of said tubular body portion, coil means comprising electrically conductive coil wire carried by said bobbin means as to be situated generally about said bobbin tubular body portion and axially between said first and second bobbin wall portions, said electrically conductive coil wire comprising first and second coil wire ends, first core means fixedly secured to said base means at said first surface means, said first core means comprising a generally L-shaped configuration and having at least first and second leg portions, said first core means being secured to said base means as to have both of said first and second leg portions generally juxtaposed to said first surface means, second core means extending generally through said bobbin tubular body and fixedly secured to said first leg portion of said first core means, said second core means serving to operatively secure said first bobbin wall portion against said first leg portion to thereby cause said second core means and said second leg portion to be generally parallel to each other and to the axis of said coil means, said first bobbin wall portion comprising an integrally formed enlarged first wall section extending generally transversely to said first bobbin wall portion, said second bobbin wall portion comprising an integrally formed enlarged second wall section extending generally transversely thereof, first electrically conductive intermediate connecting means, second electrically conductive intermediate connecting means, said first intermediate connecting means comprising a cross-sectionally solid first connector substantially greater in cross-sectional area than said coil wire, said second intermediate connecting means comprising a cross-sectionally solid second connector substantially greater in cross-sectional area than said coil wire, said first solid connector being press-fitted through said first enlarged wall section as to have a first portion of said first solid connector extending through a first end of said first enlarged wall section and disposed generally between said first and second bobbin wall portions and as to have a second portion of said first solid connector extending through a second end of said first enlarged wall section opposite to said first end of said first enlarged wall section, said first portion of said first solid connector being electrically connected to said first coil wire end and being bent generally toward said coil means as to thereby eliminate tension stresses in said coil wire leading from said first portion of said first solid connector and to said coil means, said second solid connector being press-fitted through said second enlarged wall section as to have a first portion of said second solid connector extending through a first end of said second enlarged wall section and disposed generally between said first and second bobbin wall portions and as to have a second portion of said second solid connector extending through a second end of said second enlarged wall section opposite to said first end of said second enlarged wall section, said first portion of said second solid connector being electrically connected to said second coil wire end and being bent generally toward said coil as to thereby eliminate tension stresses in said coil wire leading from said first portion of said second solid connector and to said coil means, locating type first recess means formed in said second relatively rigid terminal portion, said second portion of said first solid connector being received by said first recess means and fixedly electrically connected to said second relatively rigid terminal portion, locating type second recess means formed in said fourth relatively rigid terminal portion, said second portion of said second solid connector being received by said second recess means and fixedly electrically connected to said fourth relatively rigid terminal portion, third terminal means extending through said base means and having a fifth relatively rigid connectible terminal portion extending away from said second surface means and a sixth relatively rigid terminal portion generally at said first surface means and electrically connected to said first core means, plate-like electrically conductive spring means, said spring means comprising a first generally flat body portion and a second generally flat body portion, said first and second generally flat body portions being operatively interconnected by an intermediate bowed portion integrally formed with both of said first and second generally flat body portions, said first generally flat body portion being sonically welded to said second leg portion of said first core means as to thereby cause said second generally flat body portion to extend generally transversely of said second core means and be normally spaced from said second bobbin wall portion, an armature member situated generally between said second generally flat body portion and said second core means, said armature member being fixedly secured to said second generally flat body portion for movement in unison therewith, fixed electrical contact means, and fourth terminal means extending away from said second surface means and electrically connected to said fixed electrical contact means, said coil means when electrically energized being effective to cause said armature member and said second generally flat body portion to move toward said second core means and cause said second generally flat body portion to move relative to said fixed electrical contact means.

44. A relay assembly, comprising base means, said base means comprising dielectric plastic material, said base means further comprising oppositely disposed first and second surface means, first terminal means extending through said base means and having a first relatively rigid connectible terminal portion extending away from said second surface means and a second relatively rigid terminal portion generally juxtaposed to said first surface means, second terminal means extending through said base means and having a third relatively rigid connectible terminal portion extending away from said second surface means and a fourth relatively rigid terminal portion generally juxtaposed to said first surface means, bobbin means, said bobbin means comprising a generally tubular body portion and first and second flange-like bobbin wall portions carried by said tubular body, said first and second bobbin wall portions being generally transverse to said tubular body portion and extending generally radially outwardly thereof, said first and second bobbin wall portions being spaced from each other generally axially of said tubular body portion, coil means comprising electrically conductive coil wire carried by said bobbin means as to be situated generally about said bobbin tubular body portion and axially between said first and second bobbin wall portions, said electrically conductive coil wire comprising first and second coil wire ends, first core means fixedly secured to said base means at said first surface means, said first core means comprising a generally L-shaped configuration and having at least first and second leg portions, said first core means being secured to said base means as to have both of said first and second leg portions generally juxtaposed to said first surface means, second core means extending generally through said bobbin tubular body and fixedly secured to said first leg portion of said first core means, said second core means serving to operatively secure said first bobbin wall portion against said first leg portion to thereby cause said second core means and said second leg portion to be generally parallel to each other and to the axis of said coil means, said first bobbin wall portion comprising an integrally formed enlarged first wall section extending generally transversely to said first bobbin wall portion, said second bobbin wall portion comprising an integrally formed enlarged second wall section extending generally transversely thereof, first electrically conductive intermediate connecting means, second electrically conductive intermediate connecting means, said first intermediate connecting means comprising a cross-sectionally solid first connector substantially greater in cross-sectional area than said coil wire, said second intermediate connecting means comprising a cross-sectionally solid second connector substantially greater in cross-sectional area than said coil wire, said first solid connector being press-fitted through said first enlarged wall section as to have a first portion of said first solid connector extending through a first end of said first enlarged wall section and disposed generally between said first and second bobbin wall portions and as to have a second portion of said first solid connector extending through a second end of said first enlarged wall section opposite to said first end of said first enlarged wall section, said first portion of said first solid connector being electrically connected to said first coil wire end and being bent generally toward said coil means as to thereby eliminate tension stresses in said coil wire leading from said first portion of said first solid connector and to said coil means, said second solid connector being press-fitted through said second enlarged wall section as to have a first portion of said second solid connector extending through a first end of said second enlarged wall section and disposed generally between said first and second bobbin wall portions and as to have a second portion of said second solid connector extending through a second end of said second enlarged wall section opposite to said first end of said second enlarged wall section, said first portion of said second solid connector being electrically connected to said second coil wire end and being bent generally toward said coil as to thereby eliminate tension stresses in said coil wire leading from said first portion of said second solid connector and to said coil means, locating type first recess means formed in said second relatively rigid terminal portion, said second portion of said first solid connector being received by said first recess means and fixedly electrically connected to said second relatively rigid terminal portion, locating type second recess means formed in said fourth relatively rigid terminal portion, said second portion of said second solid connector being received by said second recess means and fixedly electrically connected to said fourth relatively rigid terminal portion, third terminal means extending through said base means and having a fifth relatively rigid connectible terminal portion extending away from said second surface means and a sixth relatively rigid terminal portion generally at said first surface means and electrically connected to said first core means, plate-like electrically conductive spring means, said spring means comprising a first generally flat body portion and a second generally flat body portion, said first and second generally flat body portions being operatively interconnected by an intermediate bowed portion integrally formed with both of said first and second generally flat body portions, said first generally flat body portion being sonically welded to said second leg portion of said first core means as to thereby cause said second generally flat body portion to extend generally transversely of said second core means and be normally spaced from said second bobbin wall portion, an armature member situated generally between said second generally flat body portion and said second core means, said armature member being fixedly secured to said second generally flat body portion for movement in unison therewith, and fixed electrical contact means, said coil means when electrically energized being effective to cause said armature member and said second generally flat body portion to move toward said second core means and cause said second generally flat body portion to move relative to said fixed electrical contact means.

45. A relay assembly, comprising base means, said base means comprising dielectric plastic material, said base means further comprising oppositely disposed first and second surface means, first terminal means extending through said base means and having a first relatively rigid connectible terminal portion extending away from said second surface means and a second relatively rigid terminal portion generally juxtaposed to said first surface means, second terminal means extending through said base means and having a third relatively rigid connectible terminal portion extending away from said second surface means and a fourth relatively rigid terminal portion generally juxtaposed to said first surface means, bobbin means, said bobbin means comprising a generally tubular body portion and first and second flange-like bobbin wall portions carried by said tubular body, said first and second bobbin wall portions being generally transverse to said tubular body portion and extending generally radially outwardly thereof, said first and second bobbin wall portions being spaced from each other generally axially of said tubular body portion, coil means comprising electrically conductive coil wire carried by said bobbin means as to be situated generally about said bobbin tubular body portion and axially between said first and second bobbin wall portions, said electrically conductive coil wire comprising first and second coil wire ends, first core means fixedly secured to said base means at said first surface means, said first core means comprising a generally L-shaped configuration and having at least first and second leg portions, said first core means being secured to said base means as to have both of said first and second leg portions generally juxtaposed to said first surface means, second core means extending generally through said bobbin tubular body and fixedly secured to said first leg portion of said first core means, said second core means serving to operatively secure said first bobbin wall portion against said first leg portion to thereby cause said second core means and said second leg portion to be generally parallel to each other and to the axis of said coil means, said first bobbin wall portion comprising an integrally formed enlarged first wall section extending generally transversely to said first bobbin wall portion, said second bobbin wall portion comprising an integrally formed enlarged second wall section extending generally transversely thereof, first electrically conductive intermediate connecting means, second electrically conductive intermediate connecting means, and first intermediate connecting means comprising a cross-sectionally solid first connector substantially greater in cross-sectional area than said coil wire, said second intermediate connecting means comprising a cross-sectionally solid second connector substantially greater in cross-sectional area than said coil wire, said first solid connector being press-fitted through said first enlarged wall section as to have a first portion of said first solid connector extending through a first end of said first enlarged wall section and disposed generally between said first and second bobbin wall portions and as to have a second portion of said first solid connector extending through a second end of said first enlarged wall section opposite to said first end of said first enlarged wall section, said first portion of said first solid connector being electrically connected to said first coil wire end and being bent generally toward said coil means as to thereby eliminate tension stresses in said coil wire leading from said first portion of said first solid connector and to said coil means, said second solid connector being press-fitted through said second enlarged wall section as to have a first portion of said second solid connector extending through a first end of said second enlarged wall section and disposed generally between said first and second bobbin wall portions and as to have a second portion of said second solid connector extending through a second end of said second enlarged wall section opposite to said first end of said second enlarged wall section, said first portion of said second solid connector being electrically connected to said second coil wire end and being bent generally toward said coil as to thereby eliminate tension stresses in said coil wire leading from said first portion of said second solid connector and to said coil means, locating type first recess means formed in said second relatively rigid terminal portion, said second portion of said first solid connector being received by said first recess means and fixedly electrically connected to said second relatively rigid terminal portion, locating type second recess means formed in said fourth relatively rigid terminal portion, said second portion of said second solid connector being received by said second recess means and fixedly electrically connected to said fourth relatively rigid terminal portion, third terminal means extending through said base means and having a fifth relatively rigid connectible terminal portion extending away from said second surface means and a sixth relatively rigid terminal portion generally at said first surface means and electrically connected to said first core means, plate-like electrically conductive spring means, said spring means comprising a first generally flat body portion and a second generally flat body portion, said first and second generally flat body portions being operatively interconnected by an intermediate bowed portion integrally formed with both of said first and second generally flat body portions, said first generally flat body portion being operatively connected to said second leg portion of said first core means as to thereby cause said second generally flat body portion to extend generally transversely of said second core means and be normally spaced from said second bobbin wall portion, an armature member situated generally between said second generally flat body portion and said second core means, said armature member being fixedly secured to said second generally flat body portion for movement in unison therewith, fixed electrical contact means, and fourth terminal means extending away from said second surface means and electrically connected to said fixed electrical contact means, said coil means when electrically energized being effective to cause said armature member and said second generally flat body portion to move toward said second core means and cause said second generally flat body portion to move relative to said fixed electrical contact means.

46. A relay assembly, comprising base means, said base means comprising dielectric plastic material, said base means further comprising oppositely disposed first and second surface means, first terminal means extending through said base means and having a first relatively rigid connectible terminal portion extending away from said second surface means and a second relatively rigid terminal portion generally juxtaposed to said first surface means, second terminal means extending through said base means and having a third relatively rigid connectible terminal portion extending away from said second surface means and a fourth relatively rigid terminal portion generally juxtaposed to said first surface means, bobbin means, said bobbin means comprising a generally tubular body portion and first and second flangelike bobbin wall portions carried by said tubular body, said first and second bobbin wall portions being generally transverse to said tubular body portion and extending generally radially outwardly thereof, said first and second bobbin wall portions being spaced from each other generally axially of said tubular body portion, coil means comprising electrically conductive coil wire carried by said bobbin means as to be situated generally about said bobbin tubular body portion and axially between said first and second bobbin wall portions, said electrically conductive coil wire comprising first and second coil wire ends, first core means fixedly secured to said base means at said first surface means, said first core means comprising a generally L-shaped configuration and having at least first and second leg portions, said first core means being secured to said base means as to have both of said first and second leg portions generally juxtaposed to said first surface means, second core means extending generally through said bobbin tubular body and fixedly secured to said first leg portion of said first core means, said second core means serving to operatively secure said first bobbin wall portion against said first leg portion to thereby cause said second core means and said second leg portion to be generally parallel to each other and to the axis of said coil means, said first bobbin wall portion comprising an integrally formed enlarged first wall section extending generally transversely to said first bobbin wall portion, said second bobbin wall portion comprising an integrally formed enlarged second wall section extending generally transversely thereof, first electrically conductive intermediate connecting means, second electrically conductive intermediate connecting means, said first intermediate connecting means comprising a cross-sectionally solid first connector substantially greater in cross-sectional area than said coil wire, said second intermediate connecting means comprising a cross-sectionally solid second connector substantially greater in cross-sectional area than said coil wire, said first solid connector being press-fitted through said first enlarged wall section as to have a first portion of said first solid connector extending through a first end of said first enlarged wall section and disposed generally between said first and second bobbin wall portions and as to have a second portion of said first solid connector extending through a second end of said first enlarged wall section opposite to said first end of said first enlarged wall section, said first portion of said first solid connector being electrically connected to said first coil wire end and being bent generally toward said coil means as to thereby eliminate tension stresses in said coil wire leading from said first portion of said first solid connector and to said coil means, said second solid connector being press-fitted through said second enlarged wall section as to have a first portion of said second solid connector extending through a first end of said second enlarged wall section and disposed generally between said first and second bobbin wall portions and as to have a second portion of said second solid connector extending through a second end of said second enlarged wall section opposite to said first end of said second enlarged wall section, said first portion of said second solid connector being electrically connected to said second coil wire end and being bent generally toward said coil as to thereby eliminate tension stresses in said coil wire leading from said first portion of said second solid connector and to said coil means, said second portion of said first solid connector being fixedly electrically connected to said second relatively rigid terminal portion, said second portion of said second solid connector being fixedly electrically connected to said fourth relatively rigid terminal portion, third terminal means extending through said base means and having a fifth relatively rigid connectible terminal portion extending away from said second surface means and a sixth relatively rigid terminal portion generally at said first surface means and electrically connected to said first core means, plate-like electrically conductive spring means, said spring means comprising a first generally flat body portion and a second generally flat body portion, said first and second generally flat body portions being operatively interconnected by an intermediate bowed portion integrally formed with both of said first and second generally flat body portions, said first generally flat body portion being operatively connected to said second leg portion of said first core means as to thereby cause said second generally flat body portion to extend generally transversely of said second core means and be normally spaced from said second bobbin wall portion, an armature member situated generally between said second generally flat body portion and said second core means, said armature member being fixedly secured to said second generally flat body portion for movment in unison therewith, a generally medially situated recess formed in said second leg portion of said first core means and having generally oppositely disposed first and second generally flat wall surfaces, said armature member having first and second notch-like recesses formed at opposite sides thereof, said armature member being generally received in said medially situated recess in a manner whereby said first generally flat wall surface is received within said first notch-like recess and said second generally flat wall surface is received within said second notch-like recess, and fixed electrical contact means, said coil means when electrically energized being effective to cause said armature member and said second generally flat body portion to move toward said second core means and cause said second generally flat body portion to move relative to said fixed electrical contact means.

47. A relay assembly according to claim 46 wherein said first notch-like recess comprises a first contacting surface of very small area compared to said first generally flat wall surface and juxtaposed to said first generally flat wall surface, and wherein said second notch-like recess comprises a second contacting surface of very small area compared to said second generally flat wall surface and juxtaposed to said second generally flat wall surface.

48. A relay assembly, comprising base means, said base means comprising dielectric plastic material, said base means further comprising oppositely disposed first and second surface means, first terminal means extending through said base means and having a first relatively rigid connectible terminal portion extending away from said second surface means and a second relatively rigid terminal portion generally juxtaposed to said first surface means, second terminal means extending through said base means and having a third relatively rigid connectible terminal portion extending away from said second surface means and a fourth relatively rigid terminal portion generally juxtaposed to said first surface means, bobbin means, said bobbin means comprising a generally tubular body portion and first and second flange-like bobbin wall portions carried by said tubular body, said first and second bobbin wall portions being generally transverse to said tubular body portion and extending generally radially outwardly thereof, said first and second bobbin wall portions being spaced from each other generally axially of said tubular body portion, coil means comprising electrically conductive coil wire carried by said bobbin means as to be situated generally about said bobbin tubular body portion and axially between said first and second bobbin wall portions, said electrically conductive coil wire comprising first and second coil wire ends, first core means fixedly secured to said base means at said first surface means, said first core means comprising a generally L-shaped configuration and having at least first and second leg portions, said first core means being secured to said base means as to have both of said first and second leg portions generally juxtaposed to said first surface means, second core means extending generally through said bobbin tubular body and fixedly secured to said first leg portion of said first core means, said second core means serving to operatively secure said first bobbin wall portion against said first leg portion to thereby cause said second core means and said second leg portion to be generally parallel to each other and to the axis of said coil means, said first bobbin wall portion comprising an integrally formed enlarged first wall section extending generally transversely to said first bobbin wall portion, said second bobbin wall portion comprising an integrally formed enlarged second wall section extending generally transversely thereof, first electrically conductive intermediate connecting means, second electrically conductive intermediate connecting means, said first intermediate connecting means comprising a cross-sectionally solid first connector substantially greater in cross-sectional area than said coil wire, said second intermediate connecting means comprising a cross-sectionally solid second connector substantially greater in cross-sectional area than said coil wire, said first solid connector being fitted through said first enlarged wall section as to have a first portion of said first solid connector extending through a first end of said first enlarged wall section and disposed generally between said first and second bobbin wall portions and as to have a second portion of said first solid connector extending through a second end of said first enlarged wall section opposite to said first end of said first enlarged wall section, said first portion of said first solid connector being electrically connected to said first coil wire end and extending generally toward said coil means as to thereby eliminate tension stresses in said coil wire leading from said first portion of said first solid connector and to said coil means, said second solid connector being fitted through said second enlarged wall section as to have a first portion of said second solid connector extending through a first end of said second enlarged wall section and disposed generally between said first and second bobbin wall portions and as to have a second portion of said second solid connector extending through a second end of said second enlarged wall section opposite to said first end of said second enlarged wall section, said first portion of said second solid connector being electrically connected to said second coil wire end and extending generally toward said coil as to thereby eliminate tension stresses in said coil wire leading from said first portion of said second solid connector and to said coil means, said second portion of said first solid connector being fixedly electrically connected to said second relatively rigid terminal portion, said second portion of said second solid connector being fixedly electrically connected to said fourth relatively rigid terminal portion, third terminal means extending through said base means and having a fifth relatively rigid connectible terminal portion extending away from said second surface means and a sixth relatively rigid terminal portion generally at said first surface means and electrically connected to said first core means, electrically conductive spring means, said spring means comprisng a first body portion and a second body portion, said first and second body portions being operatively interconnected by an intermediate bowed portion integrally formed with both of said first and second body portions, said first generally flat body portion being operatively connected to said first core means as to thereby cause said second body portion to extend generally transversely of said second core means and be normally spaced from said second bobbin wall portion, an armature member situated generally between said second body portion and said second core means, said armature member being fixedly secured to said second body portion for movement in unison therewith, and fixed electrical contact means, said coil means when electrically energized being effective to cause said armature member and said second body portion to move toward said second core means and cause said second body portion to move relative to said fixed electrical contact means.

49. A relay assembly, comprising base means, said base means comprising dielectric plastic material, said base means further comprising oppositely disposed first and second surface means, first terminal means extending through said base means and having a first relatively rigid connectible terminal portion extending away from said second surface means and a second relatively rigid terminal portion generally juxtaposed to said first surface means, second terminal means extending through said base means and having a third relatively rigid connectible terminal portion extending away from said second surface means and a fourth relatively rigid terminal portion generally juxtaposed to said first surface means, bobbin means, said bobbin means comprising a generally tubular body portion and first and second flange-like bobbin wall portions carried by said tubular body, said first and second bobbin wall portions being generally transverse to said tubular body portion and extending generally radially outwardly thereof, said first and second bobbin wall portions being spaced from each other generally axially of said tubular body portion, coil means comprising electrically conductive coil wire carried by said bobbin means as to be situated generally about said bobbin tubular body portion and axially between said first and second bobbin wall portions, said electrically conductive coil wire comprising first and second coil wire ends, first core means fixedly secured to said base means at said first surface means, said first core means comprising a generally L-shaped configuration and having at least first and second leg portions, said first core means being secured to said base means as to have both of said first and second leg portions generally juxtaposed to said first surface means, second core means extending generally through said bobbin tubular body and fixedly secured to said first leg portion of said first core means, said second core means serving to operatively secure said first bobbin wall portion against said first leg portion to thereby cause said second core means and said second leg portion to be generally parallel to each other and to the axis of said coil means, said first bobbin wall portion comprising an integrally formed enlarged first wall section extending generally transversely to said first bobbin wall portion, said second bobbin wall portion comprising an integrally formed enlarged second wall section extending generally transversely thereof, first electrically conductive intermediate connecting means, second electrically conductive intermediate connecting means, said first intermediate connecting means comprising a cross-sectionally solid first connector substantially greater in cross-sectional area than said coil wire, said second intermediate connecting means comprising a cross-sectionally solid second connector substantially greater in cross-sectional area than said coil wire, said first solid connector being fitted through said first enlarged wall section as to have a first portion of said first solid connector extending through a first end of said first enlarged wall section and disposed generally between said first and second bobbin wall portions and as to have a second portion of said first solid connector extending through a second end of said first enlarged wall section opposite to said first end of said first enlarged wall section, said first portion of said first solid connector being electrically connected to said first coil wire end and extending generally toward said coil means as to thereby eliminate tension stresses in said coil wire leading from said first portion of said first solid connector and to said coil means, said second solid connector being fitted through said second enlarged wall section as to have a first portion of said second solid connector extending through a first end of said second enlarged wall section and disposed generally between said first and second bobbin wall portions and as to have a second portion of said second solid connector extending through a second end of said second enlarged wall section opposite to said first end of said second enlarged wall section, said first portion of said second solid connector being electrically connected to said second coil wire end and extending generally toward said coil as to thereby eliminate tension stresses in said coil wire leading from said first portion of said second solid connector and to said coil means, said second portion of said first solid connector being fixedly electrically connected to said second relatively rigid terminal portion, said second portion of said second solid connector being fixedly electrically connected to said fourth relatively rigid terminal portion, third terminal means extending through said base means and having a fifth relatively rigid connectible terminal portion extending away from said second surface means and a sixth relatively rigid terminal portion generally at said first surface means and electrically connected to said first core means, electrically conductive spring means, said spring means comprising a first body portion and a second generally flat body portion, said first and second body portions being operatively interconnected by an intermediate bowed portion integrally formed with both of said first and second body portions, said first generally flat body portion being operatively connected to said first core means as to thereby cause said second generally flat body portion to extend generally transversely of said second core means and be normally spaced from said second bobbin wall portion, an armature member situated generally between said second body portion and said second core means, said armature member being fixedly secured to said second body portion for movement in unison therewith, and fixed electrical contact means, said coil means when electrically energized being effective to cause said armature member and said second body portion to move toward said second core means and cause said second body portion to move relative to said fixed electrical contact means, said first surface means of said base means comprising an upstanding pedestallike support portion for supporting said fixed electrical contact means.

50. A relay assembly, comprising base means, said base means comprising dielectric plastic material, said base means further comprising oppositely disposed first and second surface means, first terminal means extending through said base means and having a first relatively rigid connectible terminal portion extending away from said second surface means and a second relatively rigid terminal portion generally juxtaposed to said first surface means, second terminal means extending through said base means and having a third relatively rigid connectible terminal portion extending away from said second surface means and a fourth relatively rigid terminal portion generally juxtaposed to said first surface means, bobbin means, said bobbin means comprising a generally tubular body portion and first and second flangelike bobbin wall portions carried by said tubular body, said first and second bobbin wall portions being generally transverse to said tubular body portion and extending generally radially outwardly thereof, said first and second bobbin wall portions being spaced from each other generally axially of said tubular body portion, coil means comprising electrically conductive coil wire carried by said bobbin means as to be situated generally about said bobbin tubular body portion and axially between said first and second bobbin wall portions, said electrically conductive coil wire comprising first and second coil wire ends, first core means fixedly secured to said base means at said first surface means, said first core means comprising a generally L-shaped configuration and having at least first and second leg portions, said first core means being secured to said base means as to have both of said first and second leg portions generally juxtaposed to said first surface means, second core means extending generally through said bobbin tubular body and fixedly secured to said first leg portion of said first core means, said second core means serving to operatively secure said first bobbin wall portion against said first leg portion to thereby cause said second core means and said second leg portion to be generally parallel to each other and to the axis of said coil means, said first bobbin wall portion comprising an integrally formed enlarged first wall section extending generally tranversely to said first bobbin wall portion, said second bobbin wall portion comprising an integrally formed eblarged second wall section extending generally transversely thereof, first electrically conductive intermediate connecting means, second electrically conductive intermediate connecting means, said first intermediate connecting means comprising a cross-sectionally solid first connector substantially greater in cross-sectional area than said coil wire, said second intermediate connecting means comprising a cross-sectionally solid second connector substantially greater in cross-sectional area than said coil wire, said first solid connector being fitted through said first enlarged wall section as to have a first portion of said first solid connector extending through a first end of said first enlarged wall section and disposed generally between said first and second bobbin wall portions and as to have a second portion of said first solid connector extending through a second end of said first enlarged wall section opposite to said first end of said first enlarged wall section, said first portion of said first solid connector being electrically connected to said first coil wire end and extending generally toward said coil means as to thereby eliminate tension stresses in said coil wire leading from said first portion of said first solid connector and to said coil means, said second solid connector being fitted through said second enlarged wall section as to have a first portion of said second solid connector extending through a first end of said second enlarged wall section and disposed generally between said first and second bobbin wall portions and as to have a second portion of said second solid connector extending through a second end of said second enlarged wall section opposite to said first end of said second enlarged wall section, said first portion of said second solid connector being electrically connected to said second coil wire end and extending generally toward said coil as to thereby eliminate tension stresses in said coil wire leading from said first portion of said second solid connector and to said coil means, said second portion of said first solid connector being fixedly electrically connected to said second relatively rigid terminal portion, said second portion of said second solid connector being fixedly electrically connected to said fourth relatively rigid terminal portion, third terminal means extending through said base means and having a fifth relatively rigid connectible terminal portion extending away from said second surface means and a sixth relatively rigid terminal portion generally at said first surface means and electrically connected to said first core means, electrically conductive spring means, said spring means comprising a first body portion and a second body portion, said first and second body portions being operatively inter-connected by an intermediate bowed portion integrally formed with both of said first and second body portions, said first body portion being operatively connected to said first core means as to thereby cause said second body portion to extend generally transversely of said second core means and be normally spaced from said second bobbin wall portion, an armature member situated generally between said second body portion and said second core means, said armature member being fixedly secured to said second portion for movement in unison therewith, fixed electrical contact means, said coil means when electrically energized being effective to cause said armature member and said second body portion to move toward said second core means and cause said second body portion to move relative to said fixed electrical contact means, said fixed electrical contact means comprising first and second fixed electrical contacts, and said first surface means of said base means comprising at least first and second upstanding pedestal-like support portions for respectively supporting said first and second fixed electrical contacts.

51. A relay assembly, comprising base means, said base means comprising dielectric plastic material, said base means further comprising oppositely disposed first and second surface means, first terminal means extending through said base means and having a first relatively rigid connectible terminal portion extending away from said second surface means and a second relatively rigid terminal portion generally juxtposed to said first surface means, second terminal means extending through said base means and having a third relatively rigid connectible terminal portion extending away from said second surface means and a fourth relatively rigid terminal portion generally juxtaposed to said first surface means, bobbin means, said bobbin means comprising a generally tubular body portion and first and second flange-like bobbin wall portions carried by said tubular body, said first and second bobbin wall portions being generally transverse to said tubular body portion and extending generally radially outwardly thereof, said first and second bobbin wall portions being spaced from each other generally axially of said tubular body portion, coil means comprising electrically conductive coil wire carried by said bobbin means as to be situated generally about said bobbin tubular body portion and axially between said first and second bobbin wall portions, said electrically conductive coil wire comprising first and second coil wire ends, first core means fixedly secured to said base means at said first surface means, said first core means comprising a generally L-shaped configuration and having at least first and second leg portions, said first core means being secured to said base means as to have both of said first and second leg portions generally juxtaposed to said first surface means, second core means extending generally through said bobbin tubular body and fixedly secured to said first leg portion of said first core means, said second core means serving to operatively secure said first bobbin wall portion against said first leg portion to thereby cause said second core means and said second leg portion to be generally parallel to each other and to the axis of said coil means, said first bobbin wall portion comprising an integrally formed enlarged first wall section extending generally transversely to said first bobbin wall portion, said second bobbin wall portion comprising an integrally formed enlarged second wall section extending generally transversely thereof, first electrically conductive intermediate connecting means, second electrically conductive intermediate connecting means, said first intermediate connecting means comprising a cross-sectionally solid first connector substantially greater in cross-sectional area than said coil wire, said second intermediate connecting means comprising a cross-sectionally solid second connector substantially greater in cross-sectional area than said coil wire, said first solid connector being fitted through said first enlarged wall section as to have a first portion of said first solid connector extending through a first end of said first enlarged wall section and disposed generally between said first and second bobbin wall portions and as to have a second portion of said first solid connector extending through a second end of said first enlarged wall section opposite to said first end of said first enlarged wall section, said first portion of said first solid connector being electrically connected to said first coil wire end and extending generally toward said coil means as to thereby eliminate tension stresses in said coil wire leading from said first portion of said first solid connector and to said coil means, said second solid connector being fitted through said second enlarged wall section as to have a first portion of said second solid connector extending through a first end of said second enlarged wall section and disposed generally between said first and second bobbin wall portions and as to have a second portion of said second solid connector extending through a second end of said second enlarged wall section opposite to said first end of said second enlarged wall section, said first portion of said second solid connector being electrically connected to said second coil wire end and extending generally toward said coil as to thereby eliminate tension stresses in said coil wire leading from said first portion of said second solid connector and to said coil means, said second portion of said first solid connector being fixedly electrically connected to said second relatively rigid terminal portion, said second portion of said second solid connector being fixedly electrically connected to said fourth relatively rigid terminal portion, third terminal means extending through said base means and having a fifth relatively rigid connectible terminal portion extending away from said second surface means and a sixth relatively rigid terminal portion generally at said first surface means and electrically connected to said first core means, electrically conductive spring means, said spring means comprising a first body portion and a second body portion, said first and second body portions being operatively interconnected by an intermediate bowed portion integrally formed with both of said first and second body portions, said first body portion being operatively connected to said first core means as to thereby cause said second body portion to extend generally transversely of said second core means and be normally spaced from said second bobbin wall portion, an armature member situated generally between said second body portion and said second core means, said armature member being fixedly secured to said second body portion for movement in unison therewith, fixed electrical contact means, said coil means when electrically energized being effective to cause said armature member and said second body portion to move toward said second core means and cause said second body portion to move relative to said fixed electrical contact means, said base means comprising a tubular-like extension formed integrally with said second surface means of said base means and extending therefrom and generally normal thereto, cover means for covering the components situated at said first surface means of said base means, and detent-like latching means for latching said cover means to said base means.

52. A relay assembly according to claim 51 and further comprising mounting support means, said mounting support means being formed integrally with said cover means and enabling the mounting of said relay assembly to associated support structure.

53. A relay assembly according to claim 52 and further comprising metal plate means received by said mounting support means and effective for attachment to said associated support structure.

54. A relay assembly according to claim 52 wherein said metal plate means comprises a portion for completing a circuit with circuit means within said cover means for establishing a grounding circuit portion with said associated support structure.

55. A relay assembly according to claim 52 and further comprising resiliently deflectable securing means received by said mounting support means, said resiliently deflectable securing means being effective to be inserted into a cooperating aperture of said associated support means for operatively securing said relay assembly thereto.

56. A relay assembly, comprising base means, said base means comprising dielectric plastic material, said base means further comprising oppositely disposed first and second surface means, first terminal means extending through said base means and having a first relatively rigid connectible terminal portion extending away from said second surface means and a second relatively rigid terminal portion generally juxtaposed to said first surface means, second terminal means extending through said base means and having a third relatively rigid connectible terminal portion extending away from said second surface means and a fourth relatively rigid terminal portion generally juxtaposed to said first surface means, bobbin means, said bobbin means comprising a generally tubular body portion and first and second flangelike bobbin wall portions carried by said tubular body, said first and second bobbin wall portions being generally transverse to said tubular body portion and extending generally radially outwardly thereof, said first and second bobbin wall portions being spaced from each other generally axially of said tubular body portion, coil means comprising electrically conductive coil wire carried by said bobbin means as to be situated generally about said bobbin tubular body portion and axially between said first and second bobbin wall portions, said electrically conductive coil wire comprising first and second coil wire ends, first core means fixedly secured to said base means at said first surface means, said first core means comprising a generally L-shaped configuration and having at least first and second leg portions, second core means extending generally through said bobbin tubular body and fixedly secured to said first leg portion of said first core means, said second core means serving to operatively secure said first bobbin wall portion against said first leg portion to thereby cause said second core means and said second leg portion to be generally parallel to each other and to the axis of said coil means, said first bobbin wall portion comprising an integrally formed enlarged first wall section extending generally transversely to said first bobbin wall portion, said second bobbin wall portion comprising an integrally formed enlarged second wall section extending generally transversely thereof, first electrically conductive intermediate connecting means, second electrically conductive intermediate connecting means, said first intermediate connecting means comprising a cross-sectionally solid first connector substantially greater in cross-sectional area than said coil wire, said second intermediate connecting means comprising a cross-sectionally solid second connector substantially greater in cross-sectional area than said coil wire, said first solid connector extending through said first enlarged wall section as to have a first portion of said first solid connector projecting from a first end of said first enlarged wall section and disposed generally between said first and second bobbin wall portions and as to have a second portion of said first solid connector projecting from a second end of said first enlarged wall section opposite to said first end of said first enlarged wall section, said first portion of said first solid connector being electrically connected to said first coil wire end and being bent generally toward said coil means as to thereby eliminate tension stresses in said coil wire leading from said first portion of said first solid connector and to said coil means, said second solid connector extending through said second enlarged wall section as to have a first portion of said second solid connector projecting from a first end of said second enlarged wall section and disposed generally between said first and second bobbin wall portions and as to have a second portion of said second solid connector projecting from a second end of said second enlarged wall section opposite to said first end of said second enlarged wall section, said first portion of said second solid connector being electrically connected to said second coil wire end and being bent generally toward said coil as to thereby eliminate tension stresses in said coil wire leading from said first portion of said second solid connector and to said coil means, said second portion of said first solid connector being fixedly electrically connected to said second relatively rigid terminal portion, said second portion of said second solid connector being fixedly electrically connected to said fourth relatively rigid terminal portion, third terminal means extending through said base means and having a fifth relatively rigid connectible terminal portion extending away from said second surface means and a sixth relatively rigid terminal portion generally at said first surface means and electrically connected to said first core means, plate-like electrically conductive spring means, said spring means comprising a first generally flat body portion and a second generally flat body portion, said first and second generally flat body portions being operatively interconnected by an intermediate bowed portion integrally formed with both of said first and second generally flat body portions, said first generally flat body portion being operatively connected to said first core means as to thereby cause said second generally flat body portion to extend generally transversely of said second core means and be normally spaced from said second bobbin wall portion, an armature member carried by said second generally flat body portion, said armature member being fixedly secured to said second generally flat body portion for movement in unison therewith, and fixed electrical contact means, said coil means when electrically energized being effective to cause said armature member and said second generally flat body portion to move toward said second core means and cause said second generally flat body portion to move relative to said fixed electrical contact means.

* * * * *

UNITED STATES PATENT AND TRADEMARK OFFICE

CERTIFICATE OF CORRECTION

PATENT NO. : 4,342,017

DATED : July 27, 1982

INVENTOR(S) : Norman A. Rautiola

It is certified that error appears in the above—identified patent and that said Letters Patent is hereby corrected as shown below:

Column 5, line 22, change "76" to --- 64 ---.

Column 7, line 1, change "186" (second occurrence) to --- 188 ---.

Column 7, line 2, change "186" to --- 188 ---.

Column 8, line 45, after "base means" change "54" to --- 12 ---.

Column 9, line 40, change "controured" to --- contoured ---.

Column 13, line 37, change "flex" to --- flux ---.

Column 13, line 64, change "lardening" to --- hardening ---.

Claim 2, lines 40 and 41 thereof, after "structural" change "interconnecting" to --- interconnection ---.

Claim 12, lines 105 and 106 thereof, between "flat" and "portion" insert --- body ---.

UNITED STATES PATENT AND TRADEMARK OFFICE

CERTIFICATE OF CORRECTION

PATENT NO. : 4,342,017

DATED : July 27, 1982

INVENTOR(S) : Norman A. Rautiola

It is certified that error appears in the above—identified patent and that said Letters Patent is hereby corrected as shown below:

Claim 17, line 1 thereof, change "claim 12" to --- claim 14 ---.

Claim 20, line 9 thereof, change "is" to --- in ---.

Claim 21, line 82 thereof, between "end" and "being" insert --- and ---.

Claim 22, line 3 thereof, delete "flat" and substitute therefor --- first ---.

Claim 23, line 85 thereof, between "said" and "portion" insert --- second ---.

Claim 50, line 45 thereof, after "formed" change "eblarged" to --- enlarged ---.

Claim 54, line 1 thereof, change "claim 52" to --- claim 53 ---.

Signed and Sealed this

Ninth Day of August 1983

[SEAL]

Attest:

GERALD J. MOSSINGHOFF

Attesting Officer

Commissioner of Patents and Trademarks